US008486595B2

(12) United States Patent
Tamoto et al.

(10) Patent No.: US 8,486,595 B2
(45) Date of Patent: Jul. 16, 2013

(54) IMAGE BEARING MEMBER, IMAGE FORMING APPARATUS, AND PROCESS CARTRIDGE

(75) Inventors: Nozomu Tamoto, Numazu (JP); Mitsuaki Hirose, Shizuoka-ken (JP); Hideo Nakamori, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 308 days.

(21) Appl. No.: 12/879,529

(22) Filed: Sep. 10, 2010

(65) Prior Publication Data

US 2011/0059393 A1 Mar. 10, 2011

(30) Foreign Application Priority Data

Sep. 10, 2009 (JP) ..... 2009-209007

(51) Int. Cl.
*G03G 5/07* (2006.01)

(52) U.S. Cl.
USPC ..... 430/66; 430/58.65; 430/58.75; 399/159

(58) Field of Classification Search
USPC ..... 430/58.65, 58.75, 66; 399/159
See application file for complete search history.

(56) References Cited

U.S. PATENT DOCUMENTS 6,899,983 B2 5/2005 Tamoto et al.
7,251,437 B2 7/2007 Tamoto et al.

(Continued)

FOREIGN PATENT DOCUMENTS

JP 52-36016 3/1977
JP 53-95033 8/1978

(Continued)

*Primary Examiner* — Peter Vajda
(74) *Attorney, Agent, or Firm* — Oblon, Spivak, McClelland, Maier & Neustadt, L.L.P.

(57) ABSTRACT

An image bearing member including an electroconductive substrate, a photosensitive layer overlying the electroconductive substrate, and a protection layer overlying the photosensitive layer, the photosensitive layer containing a diamine compound represented by the chemical structure 1, more of the diamine compound being disposed on the photosensitive layer side than the surface side relative to the midpoint in a depth direction of the protection layer:

Chemical structure 1 where X represents a substituted or non-substituted arylene group, or a compound represented by a chemical structure 2:

Chemical structure 2 where R represents a hydrogen atom, an alkyl group having 1 to 4 carbon atoms, or an alkoxy group having 1 to 4 carbon atoms, where $A_1$, $A_2$, $A_3$, and $A_4$ independently represent an alkyl group having 1 to 4 carbon atoms, a substituted or non-substituted aryl group, or $—CH_2(CH_2)_mZ$, where Z represents a substituted or non-substituted aryl group, a substituted or non-substituted cycloalkyl group, and a substituted or non-substituted heterocycloalkyl group, and m represents 0 or 1, and where $B_1$ and $B_2$ represent $—CH_2—$, $—CH_2CH_2—$, $—CH_2—Ar_a—$, $—Ar_a—CH_2—$, $—CH_2CH_2—Ar_a—$, and $—Ar_a—CH_2CH_2—$, and $Ar_a$ represents a substituted or non-substituted arylene group.

12 Claims, 6 Drawing Sheets

U.S. PATENT DOCUMENTS

| | | | | |
|---|---|---|---|---|
| 7,371,490 | B2 | 5/2008 | Tamoto et al. | |
| 7,507,511 | B2 | 3/2009 | Tamoto et al. | |
| 7,560,203 | B2 | 7/2009 | Tamoto et al. | |
| 7,729,634 | B2 | 6/2010 | Nakamori et al. | |
| 2005/0136349 | A1* | 6/2005 | Mishra et al. | 430/58.05 |
| 2007/0019989 | A1 | 1/2007 | Nakamori | |
| 2007/0141491 | A1* | 6/2007 | Mishra et al. | 430/64 |
| 2008/0038649 | A1 | 2/2008 | Hirose et al. | |
| 2008/0069588 | A1* | 3/2008 | Inaba et al. | 399/116 |
| 2008/0112742 | A1 | 5/2008 | Nakamori et al. | |
| 2008/0113285 | A1 | 5/2008 | Nakamori et al. | |
| 2008/0124638 | A1 | 5/2008 | Hirose et al. | |
| 2008/0227007 | A1* | 9/2008 | Tamoto et al. | 430/58.75 |
| 2009/0180788 | A1 | 7/2009 | Tamoto et al. | |
| 2010/0015538 | A1 | 1/2010 | Nakamori | |

FOREIGN PATENT DOCUMENTS

| | | |
|---|---|---|
| JP | 53-132347 | 11/1978 |
| JP | 53-133445 | 11/1978 |
| JP | 54-2129 | 1/1979 |
| JP | 54-12742 | 1/1979 |
| JP | 54-14967 | 2/1979 |
| JP | 54-17733 | 2/1979 |
| JP | 54-21728 | 2/1979 |
| JP | 54-22834 | 2/1979 |
| JP | 56-48637 | 5/1981 |
| JP | 59-136744 | 8/1984 |
| JP | 2-139566 | 5/1990 |
| JP | 2-144551 | 6/1990 |
| JP | 2-150850 | 6/1990 |
| JP | 7-10912 | 2/1995 |
| JP | 3026645 | 1/2000 |
| JP | 2000-292959 | 10/2000 |
| JP | 3164426 | 3/2001 |
| JP | 3286711 | 3/2002 |
| JP | 2002-287567 | 10/2002 |
| JP | 2004-279972 | 10/2004 |
| JP | 3802787 | 5/2006 |
| JP | 2006-138956 | 6/2006 |
| JP | 2007-79244 | 3/2007 |
| JP | 2007-86522 | 4/2007 |
| JP | 3949550 | 4/2007 |
| JP | 3963445 | 6/2007 |
| JP | 3968089 | 6/2007 |
| JP | 3996490 | 8/2007 |
| JP | 2007-233425 | 9/2007 |
| JP | 2007-279678 | 10/2007 |
| JP | 2007-286306 | 11/2007 |
| JP | 2007-293247 | 11/2007 |
| JP | 2008-70540 | 3/2008 |
| JP | 2008-70553 | 3/2008 |
| JP | 4112444 | 4/2008 |
| JP | 2008-107491 | 5/2008 |
| JP | 4127803 | 5/2008 |
| JP | 2008-134470 | 6/2008 |
| JP | 2008-225043 | 9/2008 |
| JP | 4194776 | 10/2008 |
| JP | 4194973 | 10/2008 |
| JP | 4227061 | 12/2008 |
| JP | 4300279 | 5/2009 |
| JP | 4463129 | 2/2010 |

* cited by examiner

IMAGE BEARING MEMBER, IMAGE FORMING APPARATUS, AND PROCESS CARTRIDGE

BACKGROUND OF THE INVENTION

1. Field of the Invention

The present invention relates to an image bearing member, and an image forming apparatus and a process cartridge using the image bearing member. The image forming apparatus and the process cartridge are widely applicable to photocopiers, facsimile machines, laser printers, direct digital platenmakers, etc.

2. Discussion of the Background

In recent years, image forming apparatuses such as laser printers, digital photocopiers that employ an electrophotographic system have been improved with regard to image quality and reliability thereof and are now widely diffused.

Such image forming apparatuses use an image bearing member, the surface of which is charged and irradiated with light to form latent electrostatic images thereon, followed by development to obtain a visual image. This image bearing member may be a photoreceptor or photoconductor.

The image bearing members are classifiable generally into inorganic photoconductors and organic photoconductors. Organic photoconductors have become widely diffused due to the advantages they provide in terms of cost, productivity, variety of choices of usable materials, impact on the environment, etc. Such organic photoconductors are formed of a photosensitive layer mainly containing a photosensitive material, and can be classified into two main types: a single-layer type in which a single layer assumes both a charge generation function and a charge transport function, and a laminate type having a charge generation layer assuming a charge generation function and a separate charge transport layer assuming a charge transport function.

The mechanism of forming latent electrostatic images on an image bearing member of a functionally separated laminate type involves irradiating a uniformly charged image bearing member with light, which light then passes through the charge transport layer and is absorbed in charge generation material in the charge generation layer, resulting in generation of charge, actually a pair of charges. One of the pair is infused into the charge transport layer at the interface between the charge generation layer and the charge transport layer, and moved through the charge transport layer by an electric field to the surface of the image bearing member where it then neutralizes the surface charge provided by charging, resulting in formation of a latent electrostatic image. Organic photoconductors having such a laminate structure are advantageous in terms of stability of electrostatic characteristics and durability, so that organic photoconductors are currently the main type of image bearing member in use today.

Recently, with rapid advances in full-colorization and high-speed performance, demand for image forming apparatuses using such organic photoconductors has come from a wide range of fields, from the typical business office to the fields of SOHO (small office home office) or quick printing.

In the quick printing field in particular, printing volume has increased dramatically, together with demand for reliably high-quality images. Therefore, organic photoconductors having high durability and reliability are indispensable for meeting such requirements.

However, for an organic photoconductor to have a long working life, abrasion resistance thereof should be improved. Accordingly, a number of approaches have been tried.

For example, Japanese patent application publication nos. (hereinafter referred to as JP-A) JP-S56-48637-A describes using a curable binder resin for the surface layer; JP-S64-1728-A describes using a charge transport polymer; JP-H04-281461-A describes using an inorganic filler in the surface layer; and JP-2005-99688-A describes dispersing filler particulates in the surface layer.

However, these technologies are not sufficiently successful in the quick printing field because of problems related to abrasion resistance. Moreover, even if abrasion resistance is not a fatal problem, other factors such as filming, attachment of foreign matter, and cleaning performance cause problems. Therefore, the photoreceptors need replacing in a relatively short time.

This is because when using a photoreceptor having improved abrasion resistance, the surface of the photoreceptor is hardly refaced. Therefore, the surface of the photoreceptor is contaminated, resulting in production of abnormal images.

There are known technologies to prevent the filming or the attachment of foreign objects to the surface of a photoreceptor. For example, JP-H02-139566-A and JP-H02-150850-A describe roughening the surface of a photoreceptor. Also, JP-H02-144551-A describes adding a lubricant to the surface of a photoreceptor and JP-2002-287567-A and JP-2007-79244-A describe coating the surface of a photoreceptor with a lubricant.

These technologies are effective to improve the lubricant property of the surface of the photoreceptor. However, coating the surface of a photoreceptor with lubricant has a problem with sustainability of the effect.

That is, it is difficult to limit the contamination of a photoreceptor caused by repeated image formation processes such as charging, development, and cleaning for an extended period of time using only the lubricant contained in the photoreceptor from the beginning.

On the other hand, since the lubricant is securely applied to the surface of a photoreceptor by coating the surface of the photoreceptor with lubricant, the lubricating effect is sustained even when the surface of the photoreceptor is contaminated. Consequently, the operation of the cleaning blade is stabilized, which leads to a reduction in both poor cleaning performance and attachment of foreign matter.

Therefore, in the case of the quick printing field, which requires a highly durable, reliable photoreceptor, coating the surface of the photoreceptor with lubricant is extremely effective.

However, there are other problems to be solved to obtain a photoreceptor having improved durability.

Due to repetitive charging and irradiation of the photoreceptor, electrostatic stability deteriorates sharply, with a rise in the voltage of the irradiated portion of the photoreceptor and a decrease in the voltage of the dark portion extremely. This causes image density to fluctuate, and image blur occurs due to oxidized gas produced by a charger during charging.

To reduce image blur caused by oxidized gas, and improve gas resistance, JP-S59-136744-A and Japanese patent no. 4194776 (JP-4194776-B) describe adding various kinds of anti-oxidants to the photosensitive layer or the surface layer of the image bearing member.

However, known anti-oxidants have little effect in preventing image blur, and have a side effect of increasing the voltage at the irradiated portion. Therefore, to reduce image blur, a large quantity of anti-oxidant must be added. Consequently, the voltage at the irradiated portion increases sharply, which degrades image density stability.

JP-2000-292959-A describes reducing the voltage at the irradiated portion such that the ionization potential of the charge transport material contained in the protection layer is equal to or less than that of the charge transport material contained in the charge transport layer formed under the protection layer. Charge transport material having a small ionization potential is suitable for reducing the voltage at the irradiated portion in terms of the infusion barrier of the charge at the interface.

However, charge transport materials having a small ionization potential are generally inferior in stability and particularly susceptible to the effects of oxidized gas, resulting in occurrence of severe image blur. Therefore, just using a transport material having a small ionization potential is not necessarily a solution to the problem.

In addition, JP-2006-138956-A describes a photoreceptor having a cross-linked charge transport layer in which the cross-linked charge transport layer has the same charge transport material having a small molecular weight as the material contained in the charge transport layer provided below the cross-linked charge transport layer, and the density of the charge transport material gradually decreases from the side of the charge transport layer. Therefore, the abrasion resistance of the photoreceptor is improved and the residual voltage can be lowered. However, occurrence of image blur caused by repetitive use for an extended period of time is not prevented.

As an example of adding an anti-oxidant to the surface layer, JP-2008-70553-A describes a photoreceptor in which the surface layer contains a compound having both a hindered phenol structure and a hindered amine structure, and the density of the compound is different at the surface and in the interior of the photoreceptor. Although successful in reducing the occurrence of negative residual images, no description is given of handling image blur.

On the other hand, Japanese patent nos. 3963445 and 4112444, and JP-2007-233425-A and JP-2007-279678, describe adding a compound having an alkyl amino group to the photosensitive layer or the surface layer to serve the same purpose. These technologies are preferable because occurrence of image blur is reduced and the rise in the voltage at the irradiated portion has relatively less impact than in the case of the anti-oxidant.

However, although sufficient to solve the problems related to the durability of the photoreceptor that used to be required, these approaches fail to provide the durability required by the field of quick printing.

The image blur ascribable to the repetitive use of the photoreceptor is thought to occur by transmutation of a composition such as the charge transport material forming the photoreceptor when the photoreceptor is exposed to the oxidized gas produced by the charging device. A compound having an alkyl amino group is considered to be suitable to reduce this transmutation, but the amount of compound required must increase as the frequency of use or the period of use of the photoreceptor increases accordingly. However, if the amount increases, the problem that the voltage at the irradiated portion increases over time inevitably arises.

This problem of fluctuation in the voltage at the irradiated portion in the image forming apparatus for use in the quick printing field is more serious when printing is resumed after one job than when images are output for a relatively long period of time. Hereinafter, the latter is referred to as intraday fluctuation of the voltage at the irradiated portion, and, the former, intra-job fluctuation of the voltage at the irradiated portion.

In the case of the intraday fluctuation of the voltage at the irradiated portion, no adverse impact is noticeable, and the voltage can be corrected in the device so that this fluctuation does not cause a great problem. However, when the intra-job fluctuation of the voltage at the irradiated portion is significant, its impact cannot be ignored or go unnoticed. If the voltage fluctuates per output of several tens of images or several images, the correction of the voltage is difficult, which leads to a serious problem.

Moreover, often the same image pattern is output in a large quantity in one job particularly in the quick printing field. If the intra-job fluctuation at the irradiated portion is significant in such a case, the image density changes, resulting in deterioration of image consistency. This is not so noticeable when the image pattern is mainly formed of text. By contrast, when outputting, for example, a full color image, not only the image density but also the color tone change, which creates an extremely serious problem. That is, it is necessary to reduce the voltage at the irradiated portion of the photoreceptor, the fluctuation of the voltage in one day during repetitive printing for a long period of time, and the fluctuation of the voltage in one job.

Furthermore, the photoreceptor is required to be free from the occurrence of image blur or decrease in resolution, reduce the occurrence of filming, attachment of foreign matter, and poor cleaning performance, and have an abrasion resistance or durability good enough to lead a working life to the full.

As described above, the image forming apparatus for use in the quick printing field is required to have an image bearing member (photoreceptor) with good voltage stability over repetitive use, and which reduces production of blurred images as well as abnormal images stemming from filming, poor cleaning performance, etc.

SUMMARY OF THE INVENTION

For these reasons, the present inventors recognize that a need exists for an image bearing member that is free from production of abnormal images having image blur or stemming from filming, bad cleaning performance, etc., and reduces the fluctuation of the voltage at irradiated portions in one day and the intra-job fluctuation, resulting in a highly stable image bearing member having an excellent durability with constant image density and image consistency, and an image forming apparatus, and a process cartridge using the image bearing member.

Accordingly, an object of the present invention is to provide an image bearing member that is free from production of abnormal images having image blur or stemming from filming, bad cleaning performance, etc., and reduces the fluctuation of the voltage at irradiated portions in one day and the intra-job fluctuation, resulting in a highly stable image bearing member having an excellent durability with constant image density and image consistency, and an image forming apparatus, and a process cartridge using the image bearing member.

Briefly this object and other objects of the present invention as hereinafter described will become more readily apparent and can be attained, either individually or in combination thereof, by an image bearing member including an electroconductive substrate, a photosensitive layer overlying the electroconductive substrate, and a protection layer overlying the photosensitive layer, the photosensitive layer containing a diamine compound represented by the chemical structure 1, more of the diamine compound being disposed on the photosensitive layer side than the surface side relative to the midpoint in a depth direction of the protection layer:

Chemical structure 1

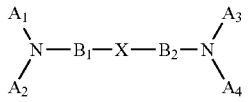

where X represents a substituted or non-substituted arylene group, or a compound represented by a chemical structure 2:

Chemical structure 2

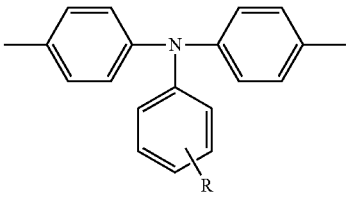

where R represents a hydrogen atom, an alkyl group having 1 to 4 carbon atoms, or an alkoxy group having 1 to 4 carbon atoms, where $A_1$, $A_2$, $A_3$, and $A_4$ independently represent an alkyl group having 1 to 4 carbon atoms, a substituted or non-substituted aryl group, or $—CH_2(CH_2)_mZ$, where Z represents a substituted or non-substituted aryl group, a substituted or non-substituted cycloalkyl group, and a substituted or non-substituted heterocycloalkyl group, and m represents 0 or 1, and where $B_1$ and $B_2$ represent $—CH_2—$, $—CH_2CH_2—$, $—CH_2—Ar_a—$, $—Ar_a—CH_2—$, $—CH_2CH_2—Ar_a—$, and $—Ar_a—CH_2CH_2—$, and $Ar_a$ represents a substituted or non-substituted arylene group.

It is preferred that, in the image bearing member mentioned above, the diamine compound has a molecular weight of from 300 to 900.

It is still further preferred that, in the image bearing member mentioned above, the diamine compound is represented by the chemical structure 3, Chemical structure 3

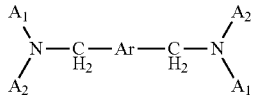

where Ar represents a substituted or non-substituted arylene group.

It is still further preferred that, in the image bearing member mentioned above, the protection layer includes a cured material formed by a radical polymerizable compound having a charge transport structure, and a radical polymerizable compound having no charge transport structure It is still further preferred that, in the image bearing member mentioned above, the photosensitive layer is formed of a laminate structure including a charge generation layer and a charge transport layer.

It is still further preferred that, in the image forming apparatus mentioned above, the diamine compound is included in the charge transport layer.

It is still further preferred that, in the image forming apparatus mentioned above, the protection layer comprises an anti-oxidant.

It is still further preferred that, in the image bearing member mentioned above, more of the anti-oxidant is disposed on the photosensitive layer side than the surface side relative to the midpoint in the depth direction of the protection layer.

It is still further preferred that, in the image forming apparatus mentioned above, the anti-oxidant is included in the charge transport layer.

It is still further preferred that, in the image bearing member mentioned above, the protection layer includes a filler.

As another aspect of the present invention, an image forming apparatus is provided which includes the image bearing member mentioned above, a charger that charges the image bearing member, a latent electrostatic image formation device that forms a latent electrostatic image on the charged image bearing member, and a development device that develops the latent electrostatic image with toner to obtain a visual image.

It is still further preferred that the image forming apparatus mentioned above employs a tandem system including a plurality of the image bearing members, a plurality of the charger, a plurality of the latent electrostatic image formation device, and a plurality of the development device are provided.

It is preferred that the image forming apparatus further includes a lubricant applicator that applies a lubricant to the surface of the image bearing member.

It is still further preferred that, in the image forming apparatus, the lubricant contains zinc stearate.

As another aspect of the present invention, a process cartridge detachably attachable to an image forming apparatus is provided which includes the image bearing member mentioned above, and at least one of a charger that charges the image bearing member, a latent electrostatic image formation device that forms a latent electrostatic image on the charged image bearing member, a development device that develops the latent electrostatic image with toner to obtain a visual image, a transfer device that transfers the visual image to a recording medium, a cleaning device that cleans a surface of the image bearing member, a discharging device that discharges the surface of the image bearing member, and a lubricant applicator that applies a lubricant to the surface of the image bearing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE DISCLOSURE

The present disclosure will be described below in detail with reference to several embodiments and accompanying drawings.

In the present disclosure, an image bearing member is provided that is free from production of abnormal images having image blur or stemming from filming, bad cleaning performance, etc., and reduces the fluctuation of the voltage at irradiated portions in one day and the intra-job fluctuation, resulting in a highly stable image bearing member having an excellent durability with constant image density and image consistency, and an image forming apparatus, i.e., less image density fluctuation, and less color tone change, and an image forming apparatus and a process cartridge using the image bearing member. The image bearing member has an electroconductive substrate; a photosensitive layer overlying the electroconductive substrate; and a protection layer overlying the photosensitive layer. The photosensitive layer has a diamine compound represented by the chemical structure 1. In addition, the diamine compound is located more on the photosensitive layer side than the surface side relative to the center with regard to the depth direction of the protection layer.

Chemical structure 1

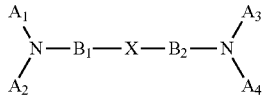

In the Chemical structure 1, X represents a substituted or non-substituted arylene group, or a compound represented by the chemical structure 2.

Chemical structure 2

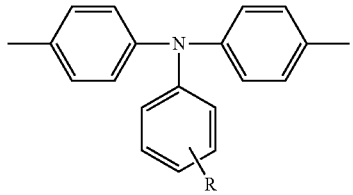

In the Chemical structure 2, R represents hydrogen atom, an alkyl group having 1 to 4 carbon atoms, or an alkoxy group having 1 to 4 carbon atoms.

$A_1$, $A_2$, $A_3$, and $A_4$ independently represent an alkyl group having 1 to 4 carbon atoms, a substituted or non-substituted aryl group or, $—CH_2(CH_2)_mZ$, where Z represents a substituted or non-substituted aryl group, a substituted or non-substituted cycloalkyl group, and a substituted or non-substituted heterocycloalkyl group, and m represents 0 or 1.

$B_1$, and $B_2$ represent $—CH_2—$, $—CH_2CH_2—$, $—CH_2—Ar_a—$, $—Ar_a—CH_2—$, $—CH_2CH_2—Ar_a—$, and $—Ar_a—CH_2CH_2—$, where $Ar_a$ represents a substituted or non-substituted arylene group.

The image bearing member (e.g. photoreceptor) and the method of manufacturing the image bearing member are described in detail with reference to accompanied drawings.

Layer Structure of Image Bearing Member

The photoreceptor manufactured in the present disclosure is described with reference to FIG. 1.

Figure 1A:
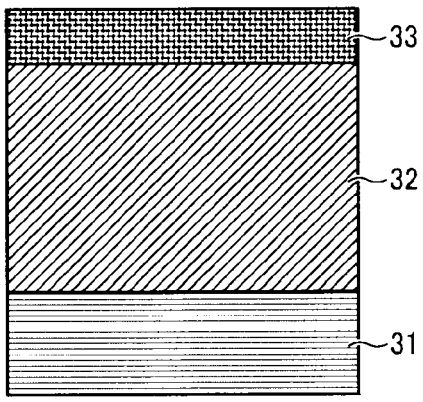
FIG. 1 is a diagram illustrating an embodiment of the image bearing member of the present disclosure.

FIG. 1A is a diagram illustrating a photoreceptor having a laminate structure formed of a photosensitive layer 32 having charge generation function and charge transport function provided on an electroconductive substrate 31 and a protection layer 33 laminated on the photosensitive layer 32.

Figure 1B:
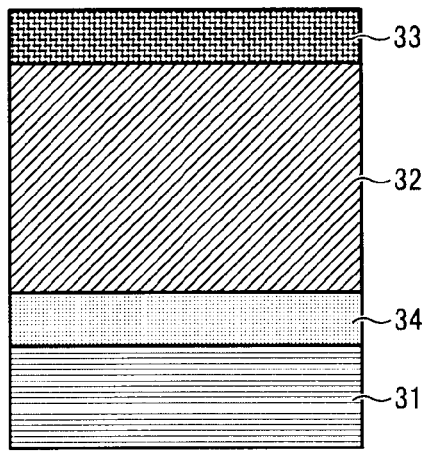

As illustrated in FIG. 1B, an undercoating layer 34 can be provided between the photosensitive layer 32 and the electroconductive substrate 31. In addition, the undercoating layer may have a two layer structure.

Figure 1C:
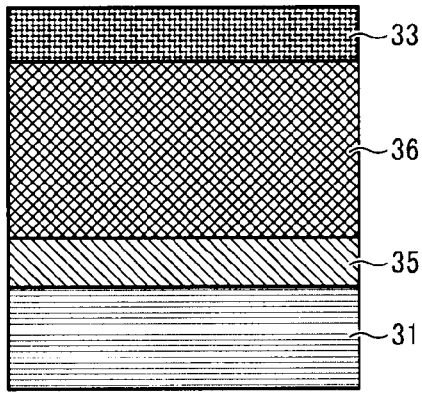

FIG. 1C is a diagram illustrating a photoreceptor having a laminate structure formed of a photosensitive layer 32 also having a laminate structure of a charge generation layer 35 that has a charge generation function and a charge transport layer 36 that has a charge transport function provided on the electroconductive substrate 31 and the protection layer 33 laminated on the laminate photosensitive layer.

Figure 1D:
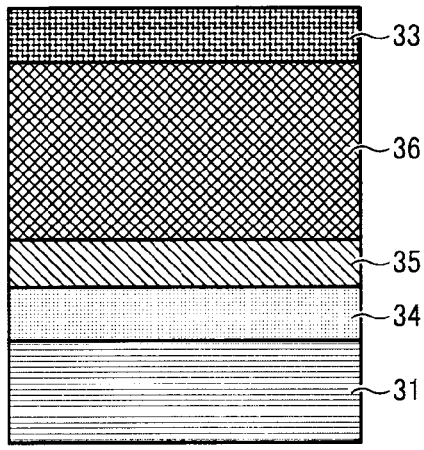

As illustrated in FIG. 1D, the undercoating layer 34 can be provided between the electroconductive substrate 31 and the charge generation layer 35.

In addition, the undercoating layer may have a two layer structure.

Electroconductive Substrate

The electroconductive substrate can be formed by using material having a volume resistance of not greater than $10^{10}\Omega\cdot$cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing and grinding is also usable. In addition, the endless nickel belt, and the endless stainless belt described in JP-S52-36016 can be used as the electroconductive substrate.

Furthermore, the electroconductive substrate can be formed by dispersing electroconductive powder in a binder resin on the above-mentioned electroconductive substrate to form an electroconductive layer formed by coating, etc.

Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curable resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenolic resin, and an alkyd resin.

Such an electroconductive layer can be formed by dispersing such electroconductive powder and the binder resin in a solvent, for example, tetrahydrofuran (THF), dichloromethane (MDC), methyl ethyl ketone (MEK), and toluene and applying the resultant to an electroconductive substrate.

In addition, an electroconductive substrate in which an electroconductive layer is formed on a cylindrical substrate by using a heat contraction tube can be used as the electroconductive substrate of the present invention. The heat contraction tube is formed of material containing electroconductive powder. Specific examples of the material include, but are not limited to, polyvinyl chloride, polypropylene, polyester, polystyrene, polyvinylidene chloride, polyethylene, chloride rubber, and polytetrafluoroethylene based fluorine resin.

Among these, a cylindrical substrate formed of aluminum which can be easily subject to anodization treatment. is suitably used.

This aluminum represents solid aluminum and alloy thereof.

To be specific, aluminum of JIS 1,000 to 1,999, 3,000 to 3,999, and 6,000 to 6,999 or alloy thereof are most suitable.

Anodized layer (film) is obtained by anodization treatment of metal, or alloy thereof in an electrolyte solution. Among these, a film referred to as alumite obtained by anodization of aluminum or alloy thereof hardly causes a rise in a residual voltage, and is effective to prevent background fouling occurring when reverse development is used.

The anodization treatment is conducted in an acid bathing using such as chromic acid, sulfuric acid, oxalic acid, phosphoric acid, acidum boricum, and sulfamic acid.

Among these, sulfuric acid bathing is most suitable.

For example, the anodization treatment is conducted in the following conditions: Density of sulfuric acid: 10 to 20% Temperature of bathing: 5 to 25 Current density: 1 to 4 A/dm$^2$ Electrolyzation voltage: 5 to 30 V Treatment time: about 5 to about 60 minutes The thus prepared anodization film is porous and has high insulation property so that the surface is extremely in unstable condition. Therefore, the anodization film changes over time and the physical values thereof are liable to change. To avoid this, the anodization film is preferably subject to sealing treatment.

The sealing treatment includes a method of dipping the anodization film in an aqueous solution containing nickel fluoride and nickel acetate, a method of dipping the anodization film in boiled water, a method of using steam under pressure, etc.

Among these, the method of dipping the anodization film in an aqueous solution containing nickel acetate is most preferable. Subsequent to the sealing treatment, the anodization film is subject to washing treatment. This is to remove metal salts extra attached by the sealing treatment. Metal salts that excessively remains on the surface of the electroconductive substrate (anodization film) have an adverse impact on the quality of film (layer) formed on the anodization film and in addition, cause the background fouling since a low resistance component generally remains. This washing treatment may be conducted only once but generally conducted at multiple steps. The washing liquid obtained after the final washing treatment is preferably as clean, i.e., deionized, as possible.

In addition, the washing processes in the multi-steps preferably include a process of physical rubbing washing with a contact member.

The thickness of the thus formed anodization film is preferably from about 5 to about 15 μm.

A film that is excessively thin tends to have insufficient barrier effect as the anodization film and by contrast, a film that is excessively thick tends to have an excessively high time constant as the electrode, which may cause occurrence of residual voltage and deterioration of the response of the image bearing member.

Photosensitive Layer

Next, the photosensitive layer is described.

The photosensitive layer has a single-layer structure or a laminate structure.

The photosensitive layer having a laminate structure is formed of a charge generation layer having a charge generation function and a charge transport layer having a charge transport function. The photosensitive layer having a single-layered structure has both a charge generation function and a charge transport function.

Charge Generation Layer

The charge generation layer is a layer mainly formed of a charge generation material.

Any known charge generation material can be used for the charge generation layer.

Specific examples thereof include, but are not limited to, azo pigments such as monoazo pigments, disazo pigments, asymmetry disazo pigments, trisazo pigments, azo pigments having a carbazole skeleton (refer to JOP S53-95033), azo pigments having a distyryl benzene skeleton (refer to JOP S53-133445), azo pigments having a triphenylamine skeleton (refer to JOP S53-132347), azo pigments having a diphenylamine skeleton, azo pigments having a dibenzothiophene skeleton (refer to JOP S54-21728), azo pigments having a fluorenone skeleton (refer to JOP S54-22834), azo pigments having an oxadiazole skeleton (refer to JOP S54-12742), azo pigments having a bis-stilbene skeleton (refer to JOP S54-17733), azo pigments having a distilyloxadiazole skeleton (refer to JOP S54-2129), azo pigments having a distylylcarbazole skeleton (refer to JOP S5-14967); azulenium salt pigments; squaric acid methine pigments; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bisbenzimidazole pigments, and phthalocyanine based pigments such as metal phthalocyanine represented by the following chemical formula (20), and metal free phthalocyanine.

Chemical formula 1

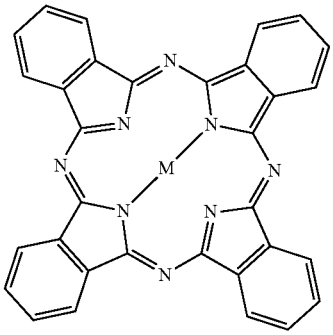

M (center metal) of the chemical formula 1 represents a metal element or non-metal (hydrogen atom).

Specific example of M (center metal) include, but are not limited to, H, Li, Be, Na, Mg, Al, Si, K, Ca, Sc. Ti, V. Cr, Mn, Fe, Co, Ni, Cu, Zn, ga, Ge, Y, Zr, Nb, Mo, Tc, Ru, Rh, Pd, Ag, Cd, In, Sn, Sb, Ba, Hf, ta, W, Re, Os, Ir, Pt, Au, Hg, TI, La, Ce, Pr, Nd, Pm, Sm, Eu, Gd, Tb, Dy, Ho, Er, Tm, Yb, Lu, Th, Pa, U, Np, and Am or two or elements of oxides thereof, fluorides thereof, hydroxides thereof, and bromide thereof.

The charge generation material having a phthalocyanine skeleton in the present invention has at least a basic skeleton structure of the general chemical formula (11) and includes a dimer or higher structure, and even a polymer structure.

In addition, the charge generation material also includes the basic skeleton with various kinds of substitution groups.

Among these phthalocyanines, titanyl phthalocyanine including TiO as the center metal, metal-free phthalocyanine, chrologallium phthalocyanine, hydroxygallium phthalocyanine are particularly preferable in terms of the characteristics of an image bearing member.

In addition, these phthalocyanines are known to have various kinds of crystal types, for example, titanylphthalocyanine has α, β, γ, m, Y, etc., and copper phthalocyanine has α, β, γ, etc. The characteristics of the phthalocyanines having the same center metal vary depending on the crystal type.

The characteristics of the image bearing member using the phthalocyanine pigments having various kinds of crystal types are reported to change accordingly (refer to Denshi Shashin Gakkaishi. Vol. 29, issue 4 published in 1990).

For this reason, the selection of the phthalocyanine crystal type is extremely important for characteristics of an image bearing member.

Among these phthalocyanine pigments, the titanyl phtalocyanine crystal having an X-ray (Cu—Kα: wavelength of 1.542 Å) diffraction spectrum such that the main peak is observed at a Bragg (2θ) angle of 27.2±0.2° has particularly high sensitivity and is suitably used in the present invention in terms of high speed image formation.

Furthermore, among these, the titanyl phthalocyanine crystal having an X-ray (Cu—Kα: wavelength of 1.542 Å) diffraction spectrum such that such that the maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as the lowest angle diffraction peak, and having no peak between the peak of 9.4°±0.2° and the peak of 7.3°±0.2° and no peak at 26.3° is extremely suitable because it has a high charge generation efficiency, and good electrostatic characteristics with less occurrence of background fouling.

These charge generation materials may be used alone or in combination.

The charge generation material mentioned above contained in the image bearing member of the present invention is more suitable when the particle size of the charge generation material is reduced in some cases. Particularly with regard to the phthalocyanine pigments, the average particle size is preferably 0.25 μm or less and more preferably 0.2 μm or less.

The method of manufacturing the charge generation material is described below.

The particle size of the charge generation material contained in the charge generation layer is controlled by a method of dispersing the charge generation material followed by removing coarse particles having a particle size larger than 0.25 μm.

The average particle size represents the volume average particle diameter and is obtained by an ultra-centrifugal particle size distribution analyzer (CAPA-700, manufactured by Horiba, Ltd.). Median diameter, which corresponds to 50% of the cumulative distribution, is calculated as the volume average particle diameter.

However, this method involves a problem that a minute quantity of coarse particles are not detected in some cases. Thus, to be more exact, it is preferable to obtain the size by directly observing the charge generation material powder, or liquid dispersion with an electron microscope.

Next, the method of removing coarse particles after dispersion of the charge generation material is described.

That is, in the method, a liquid dispersion in which particles are caused to be as fine as possible is filtered with a suitable filter.

The liquid dispersion is manufactured by a typical method in which a charge generation material and an optional binder resin are dispersed in a suitable solvent using a ball mill, an attritor, a sand mill, a bead mill, or ultrasonic.

The binder resin is selected based on the electrostatic characteristics of an image bearing member and the solvent is selected based on the wettability to a pigment and the dispersion property thereof.

This method is effective in that the coarse particles remaining in a minute quantity which is not detected by naked eyes (or particle size measurement) is removed and consequently the obtained particle size distribution is sharp.

To be specific, the liquid dispersion prepared as described above is filtered by a filter having an effective pore diameter of 5 μm or less, and preferably 3 or less. According to this method, a liquid dispersion containing only a charge generation material having a small particle size (0.25 or less and preferably 0.2 μm or less) is prepared, thereby improving the electrostatic characteristics such as sensitivity and chargeability of an image bearing member and sustaining the effect.

When the particle size of the liquid dispersion to be filtered is too large, or the particle size distribution thereof is too wide, the loss by the filtration tends to be great, which leads to clogging, thereby making filtration impossible.

Therefore, with regard to the liquid dispersions before filtration, it is desired to perform the dispersion by which the average particle size is not greater than 0.3 μm with a standard deviation of 0.2 μm.

When the average particle size is too large, the loss of the filtration tends to increase and when the standard deviation is too large, the filtration may take extremely long.

The charge generation material mentioned above has en extremely strong intermolecular hydrogen binding force, which is characteristic to a charge generation material having a high sensitivity.

Therefore, the particles of the dispersed pigment particles have an extremely strong mutual action therebetween.

As a result, the charge generation material particles dispersed by a dispersion device are likely to re-agglomerate by dilution, etc. However, as described above, such agglomerated substance can be removed after the dispersion with a filter having a specific size or less.

At this point, since the liquid dispersion is in thixotropic, particles having a size smaller than the effective pore diameter of a filter are also removed.

Alternatively, the liquid having a structure viscosity is filtered to have a state close to Newtonian.

Thus, the effect of the present invention is improved by removing coarse particles of the charge generation material as described above.

In addition, among the azo pigments, the azo pigments represented by the chemical formula (4) are preferably used. Particularly, asymmetry disazo pigment which has $Cp_1$ different from $Cp_2$ has an excellent carrier generation efficiency, which is effective in terms of high speed performance, and is preferably used as the charge generation material for use in the present invention.

Chemical formula 2

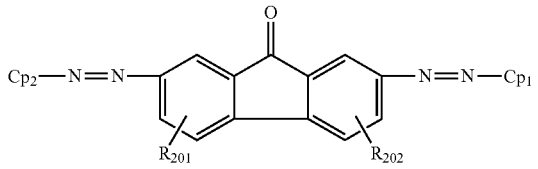

In Chemical formula 2, $Cp_1$ and $Cp_2$ represent coupler remaining groups.

$R_{201}$ and $R_{202}$ independently represent hydrogen atom, a halogen atom, an alkyl group, an alkoxy group, and cyano group.

$CP_1$ and $Cp_2$ are represented by the following chemical formula 3 and the asymmetry disazo pigment can be obtained by making the structure thereof different from each other.

Chemical formula 3

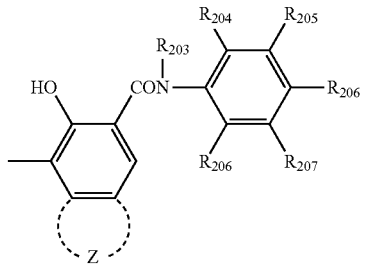

In Chemical formula 3, $R_{203}$ represents hydrogen atom, an alkyl group such as methyl group and ethyl group, and an aryl group such as phenyl group. $R_{203}$, $R_{205}$, $R_{206}$, $R_{207}$, and $R_{208}$ independently represent. Hydrogen atom, nitro group, cyano group, a halogen atom such as fluorine, chlorine, bromine and iodine, halogenized alkyl group such as trifluoromethyl group, an alkyl group such as methyl group and ethyl group, an alkoxy group such as methoxy group, and ethoxy group, dialkyl amino group, and hydroxyl group. Z represents a substituted or non-substituted carbon cyclic aromatic group, aromatic carbon ring, or a substituted or non-substituted heterocyclic aromatic group aromatic heterocyclic ring.

These charge generation materials can be used alone or in combination.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, polyacrylamides, polyvinyl benzale, polyester, phenoxy resin, copolymer of vinylchloride and vinyl acetate, polyvinyl acetate, polyphenylene oxide, polyvinylpyridine, cellulose based resin, casein, polyvinyl alcohol, and polyvinyl pyrolidone.

Among these, polyvinyl butyral is preferably used.

These binder resins can be used alone or as a mixture of two or more.

Specific examples of the solvents include, but are not limited to, known organic solvents such as isopropanol, acetone, methylethylketone, cyclohexanone, tetrahydrofuran, dioxane, ethylcellosolve, ethyl acetate, methylacetate, dichloromethane, dichloroethane, monochlorobenzene, cyclohexane, toluene, xylene, and ligroin. Among these, ketone based solvents, ester based solvents, and ether based solvents are preferably used.

These can be used alone or as a mixture of two or more.

Liquid application of the charge generation layer is prepared by dispersing a charge generation material with an optional binder resin in a solvent with a known dispersion method using a ball mill, an attritor, a sand mill, a bead mill, or ultrasonic.

The optional binder resin can be added before or after dispersion of the charge generation material.

The liquid application of the charge generation layer is mainly formed of a charge generation material, a solvent, and a binder resin and may also contain additives such as a sensitizer, a dispersion agent, a surface active agent, and silicone oil.

A charge transport material, which is described later, can be added to the charge generation layer.

The addition amount of the binder resin is from 0 to 500 parts by weight and preferably from 10 to 300 parts by weight based on 100 parts by weight of the charge generation material.

The charge generation layer is formed by applying the liquid application mentioned above to an electroconductive substrate, or an undercoating layer, followed by drying.

Known methods such as a dip coating method, a spray coating method, a bead coating method, a nozzle coating method, a spinner coating method, and a ring coating method can be used as the application method.

The layer thickness of the charge generating layer is from about 0.01 to about 5 μm and preferably from 0.1 to 2 μm.

The liquid application is heated and dried in an oven, etc. after application.

The drying temperature of the charge generation layer is preferably from 50 to 160° C., and more preferably from 80 to 140° C.

Charge Transport Layer

The charge transport layer is mainly formed of a charge transport material and a binder resin.

The charge transport material is typified into a positive hole transport material and an electron transport material.

Specific examples of such electron transport material include, but are not limited to, electron acceptance material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, and diphenoquinone derivatives.

These charge transport materials may be used alone or in combination.

Specific examples of the positive hole transport materials include, but are not limited to, poly(N-vinylvarbazole) and derivatives thereof, poly(γ-carbzoyl ethylglutamate) and derivatives thereof, pyrenne-formaldehyde condensation products and derivatives thereof, polyvinylpyrene, polyvinyl phnanthrene, polysilane, oxazole derivatives, oxadiazole derivatives, imidazole derivatives, monoaryl amine derivatives, diaryl amine derivatives, triaryl amine derivatives, stilbene derivatives, α-phenyl stilbene derivatives, aminobiphenyl derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, disstilbene derivatives, enamine derivatives and charge transport materials having a molecular weight of from 600 to 900.

These charge transport materials may be used alone or in combination.

In the present disclosure, among the charge transport materials specified above, compounds having an α-phenyl stilbene structure and compounds having a distyryl structure are preferable.

One example of the compounds having a distyryl structure is illustrated below.

Chemical formula 4

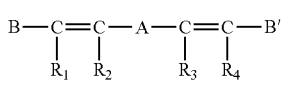

$R_1$ to $R_4$ independently represent hydrogen atom, an alkyl group having 1 to 4 carbon atoms, an alkoxy group having 1 to 4 carbon atoms, or a phenyl group.

The phenyl group can take an alkyl group having 1 to 4 carbon atoms, and an alkoxy group having 1 to 4 carbon atoms as a substitution group. "A" represents a substituted or a non-substituted arylene group, or a group represented by Chemical formula 1a. "B" and "B'" independently represent a substituted or a non-substituted arylene group, or a group represented by the following Chemical formula 5.

Chemical formula 5

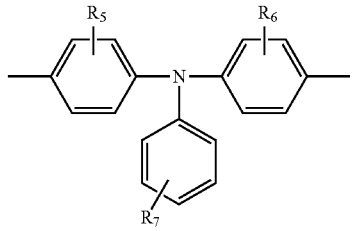

In the Chemical formula 5, $R_5$, $R_6$, and $R_7$ independently represent hydrogen atom, an alkyl group having 5 to 4 carbon atoms, an alkoxy group having 1 to 4 carbon atoms, or a substituted or non-substituted phenyl group. The phenyl group can take an alkyl group having 1 to 4 carbon atoms, and an alkoxy group having 1 to 4 carbon atoms as a substitution group.

Chemical formula 6

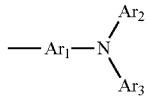

In the Chemical formula 6, $Ar_1$ represents an arylene group, which may take an alkyl group having 1 to 4 carbon atoms, and an alkoxy group having 1 to 4 carbon atoms as a substitution group.

In addition, $Ar_2$ and $Ar_3$ independently represent an aryl group, which may take an alkyl group having 1 to 4 carbon atoms, and an alkoxy group having 1 to 4 carbon atoms as a substitution group.

Among these compounds, the distyryl compound represented by the following Chemical formula 7 is particularly preferable in the present invention.

Chemical formula 7

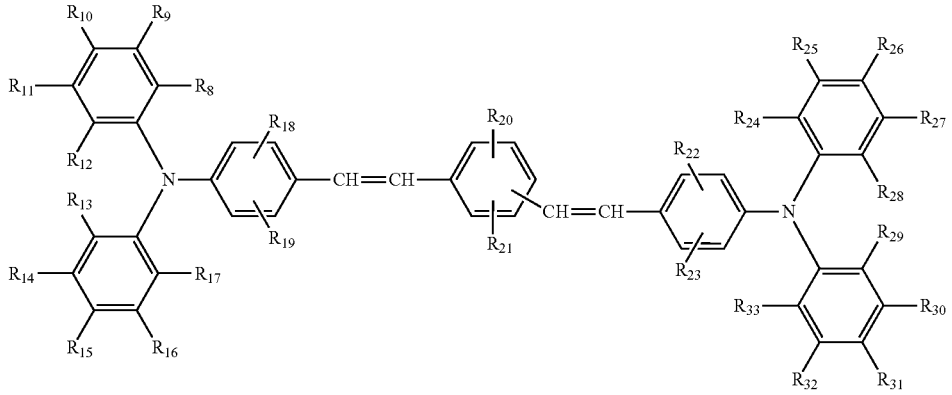

In the Chemical formula 7, $R_8$ to $R_{33}$ independently represent hydrogen atom, an alkyl group having 1 to 4 carbon atoms, an alkoxy group having 1 to 4 carbon atoms, or a substituted or non-substituted phenyl group.

In addition, the charge transport material illustrated by the following Chemical formula 8 is preferable in the present invention.

Chemical formula 8

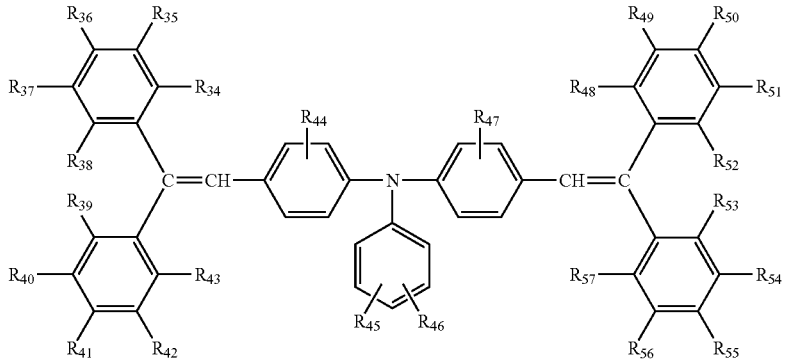

In the chemical formula 8, $R_{34}$ to $R_{57}$ independently represent hydrogen atom, an alkyl group having 1 to 4 carbon atoms, an alkoxy group having 1 to 4 carbon atoms, or a substituted or non-substituted phenyl group.

These charge transport materials have relatively large molecular structure and pi-conjugated systems are widely across the entire molecule. Therefore, the mobility and the charge transportability are high and the elution amount of the charge transport material to the protection layer is limited.

Specific examples of these compounds used as the charge transport materials in the present disclosure include, but are not limited to, the following.

CTM1

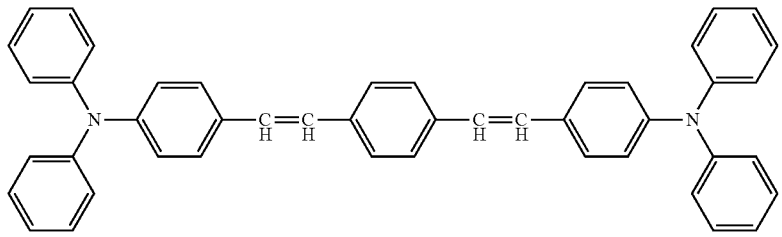

-continued
CTM2
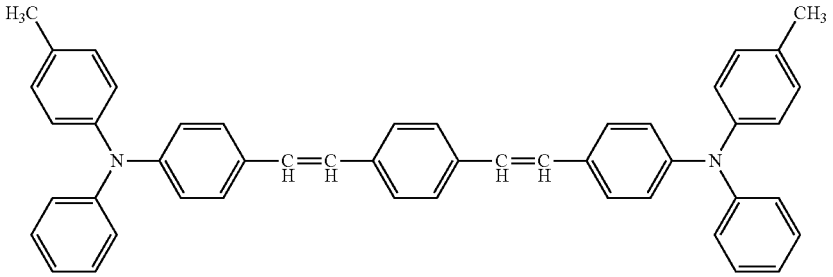
CTM3
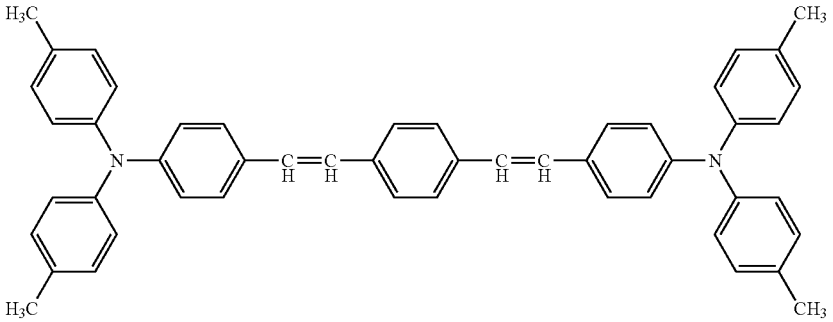
CTM4
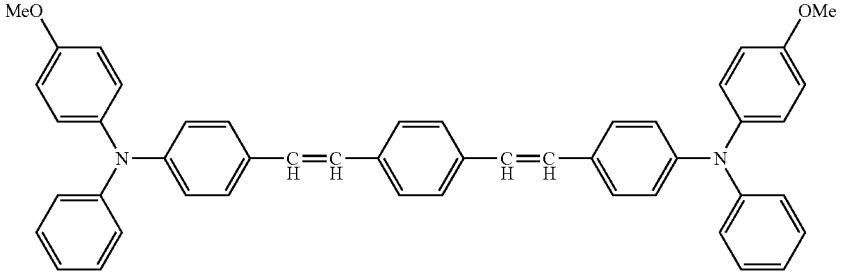
CTM5
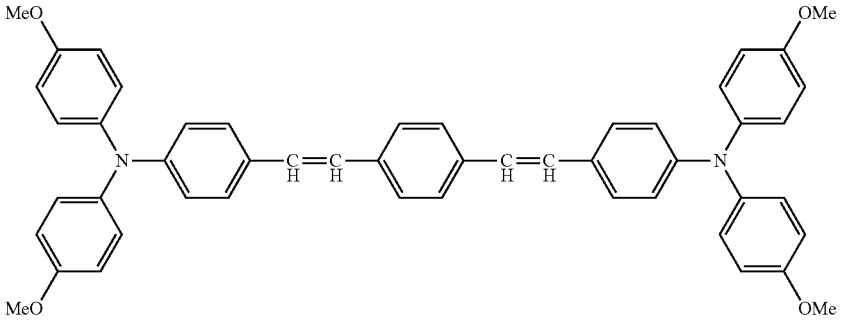
CTM6
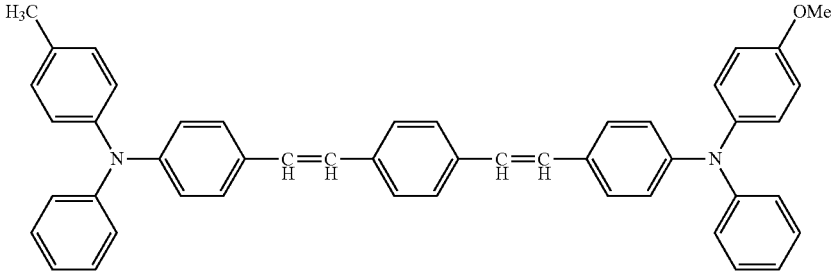

-continued
CTM7
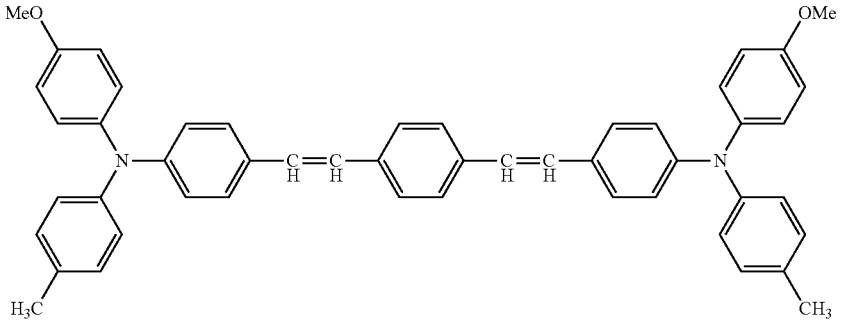
CTM8
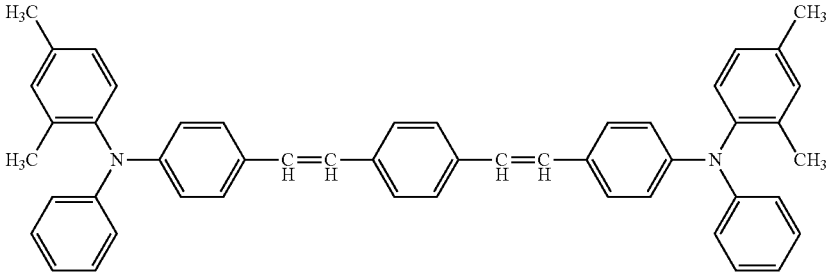
CTM9
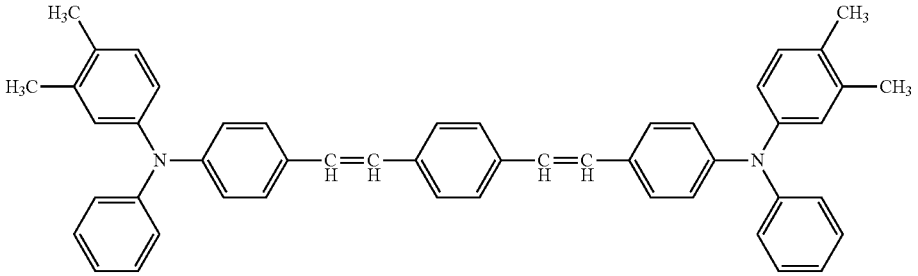
CTM10
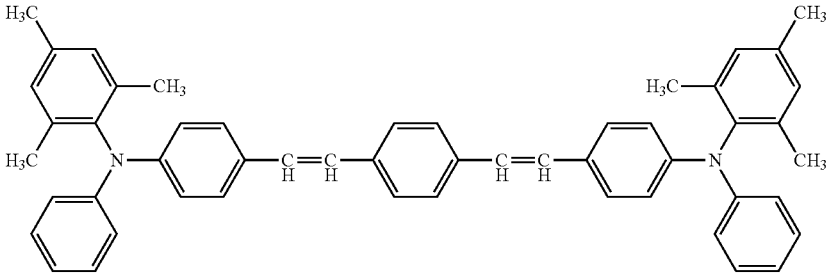
CTM11
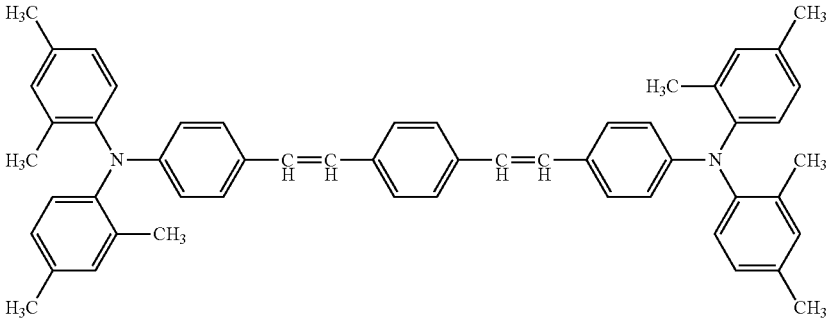

-continued
CTM12
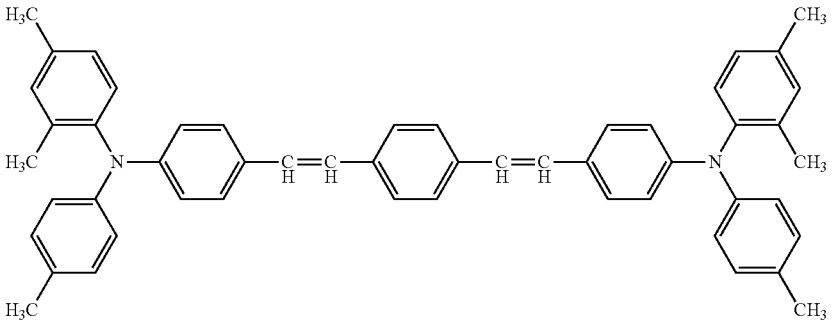
CTM13
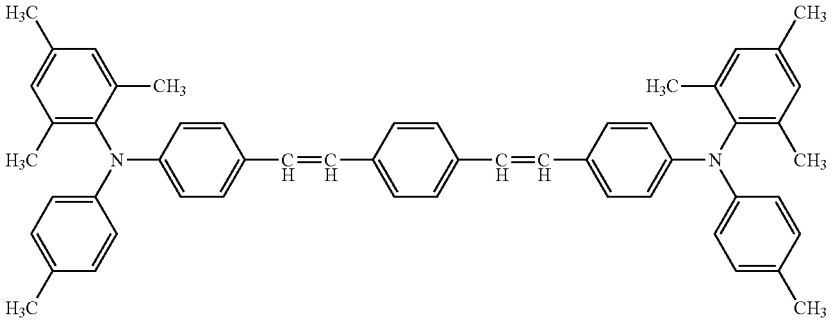
CTM14
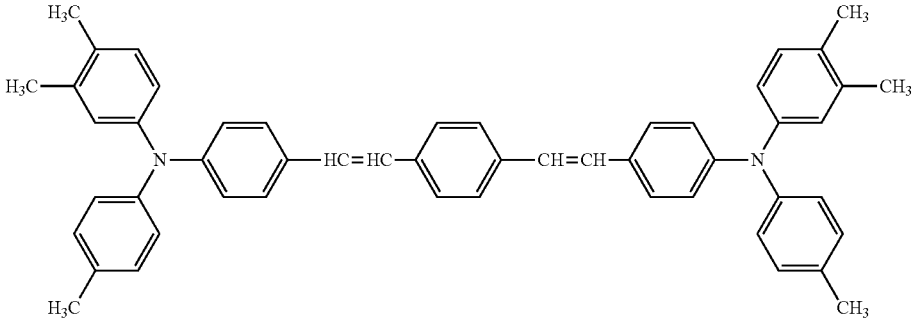
CTM15
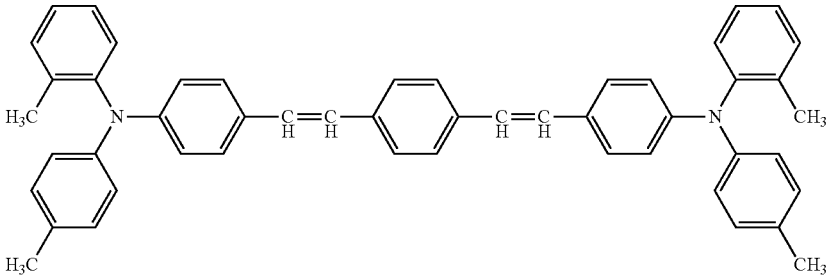
CTM16
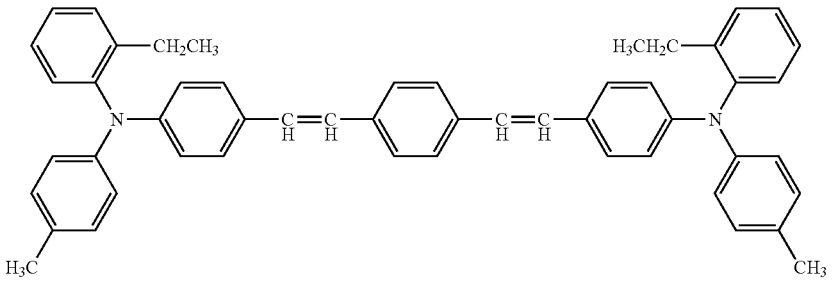

-continued
CTM17
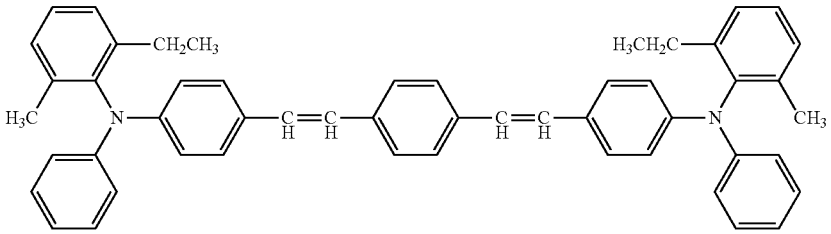
CTM18
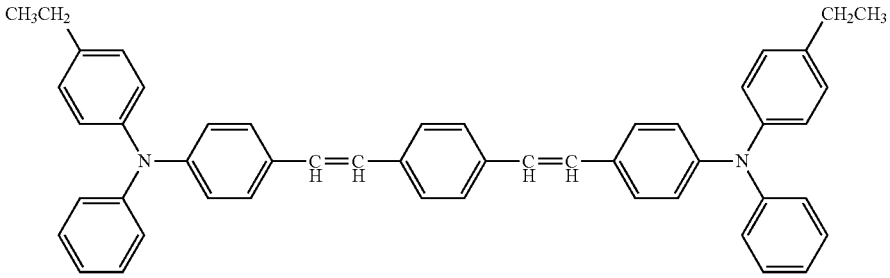
CTM19
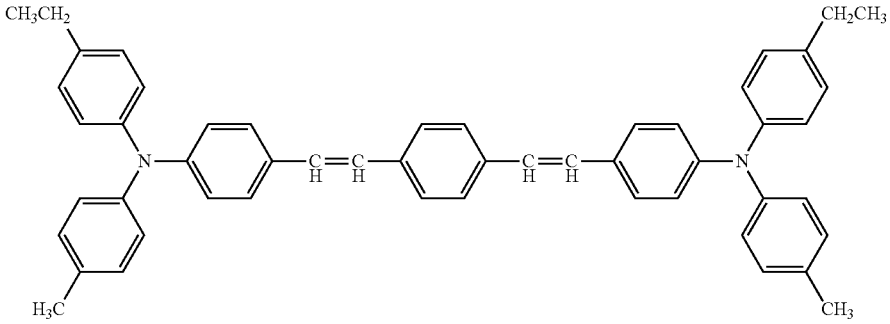
CTM20
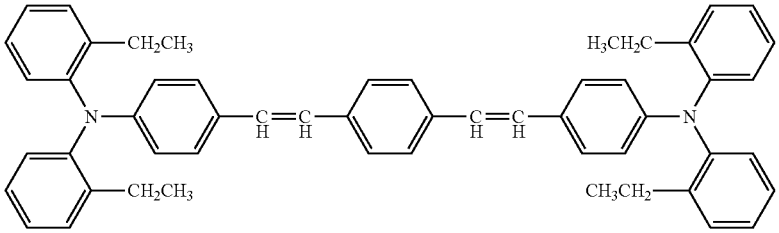
CTM21
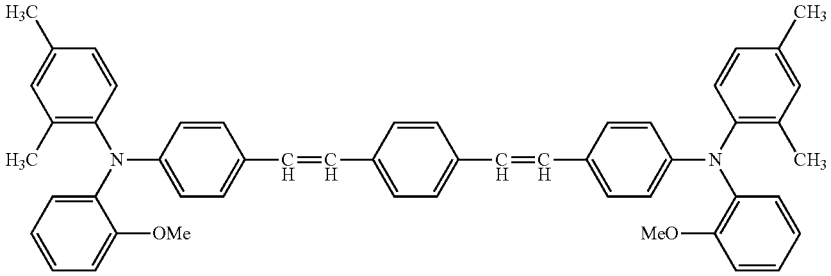

-continued
CTM22
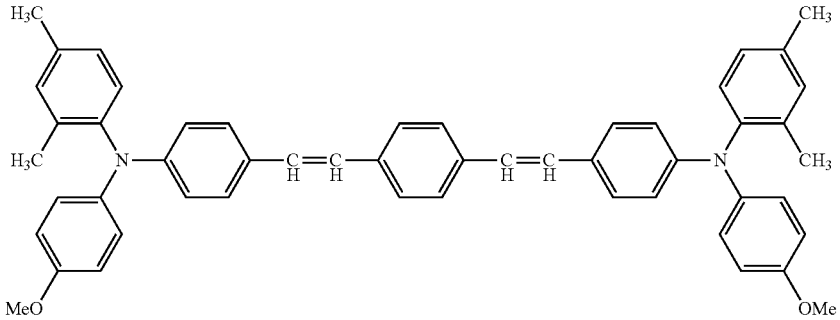
CTM23
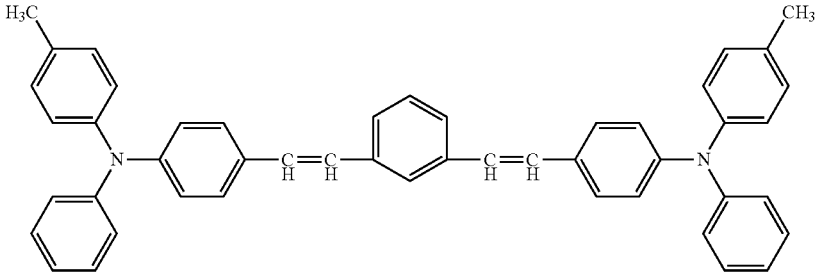
CTM24
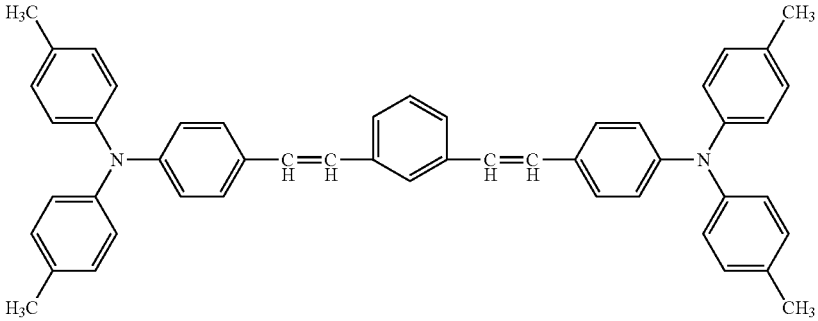
CTM25
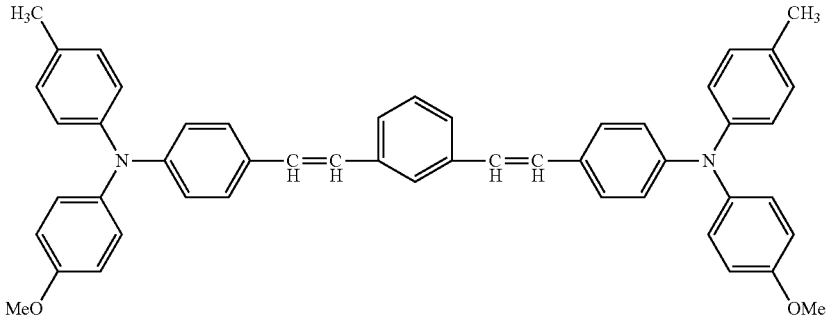
CTM26
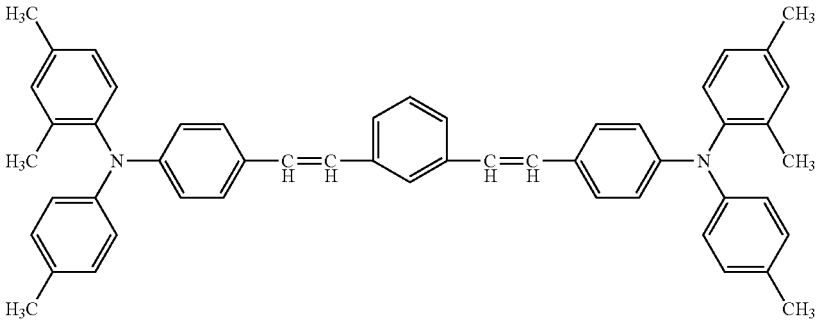

-continued
CTM27
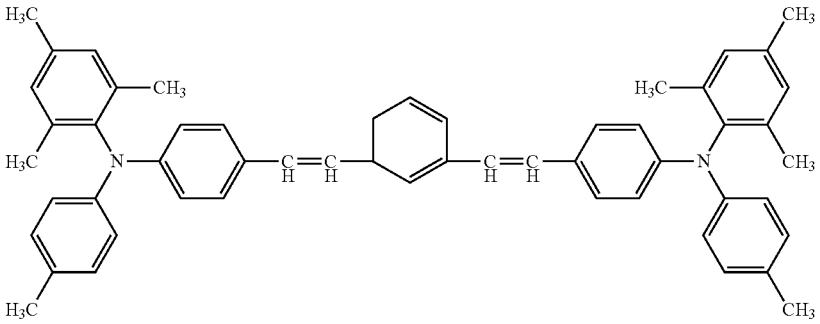
CTM28
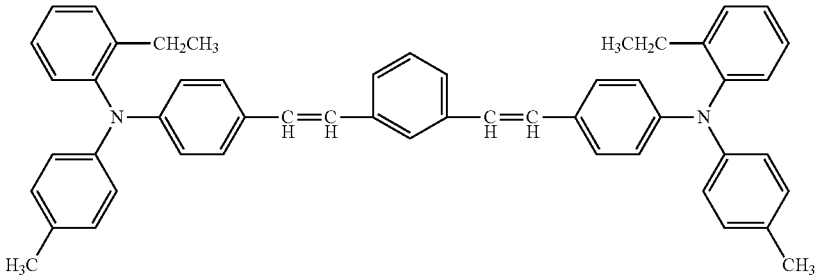
CTM29
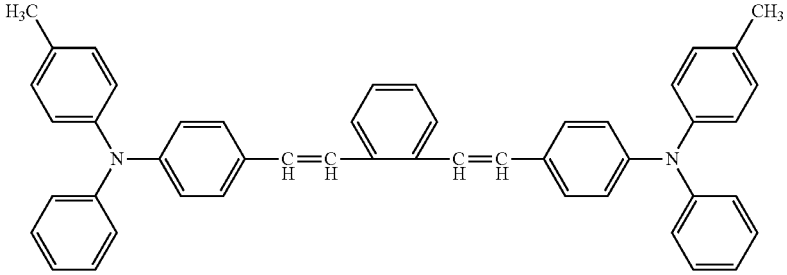
CTM30
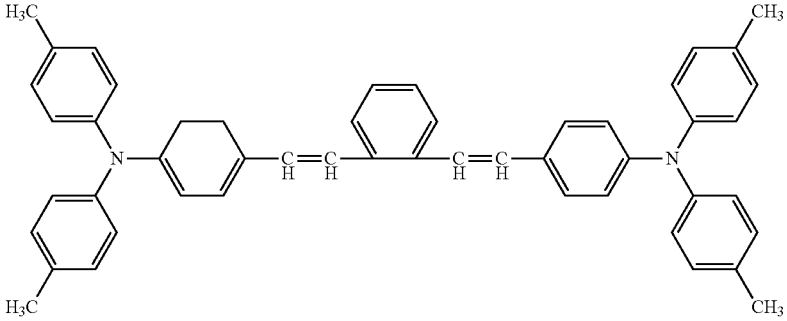
CTM31
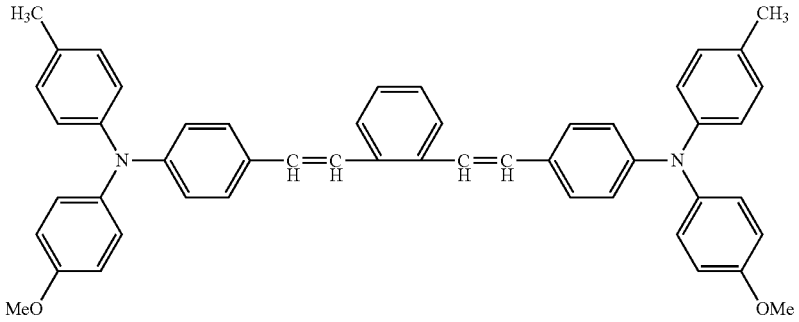

-continued
CTM32
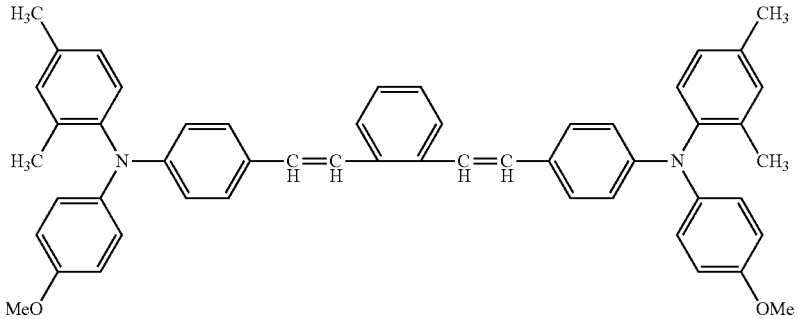
CTM33
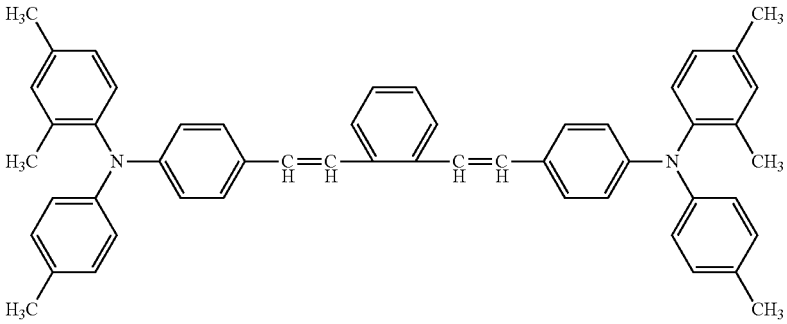
CTM34
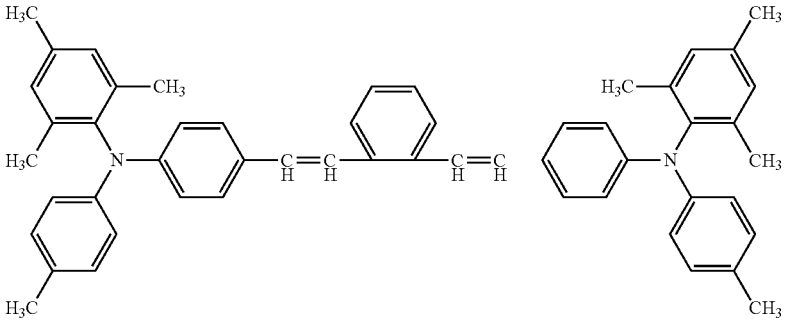
CTM35
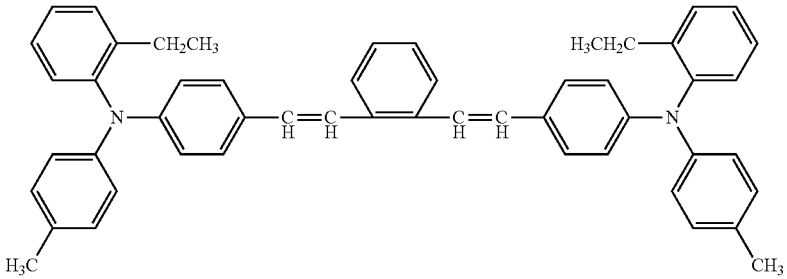
CTM36
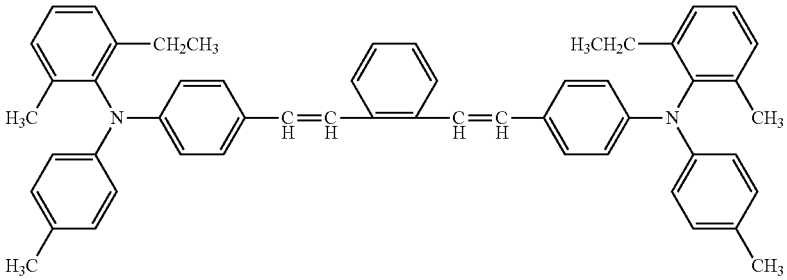

-continued
CTM37
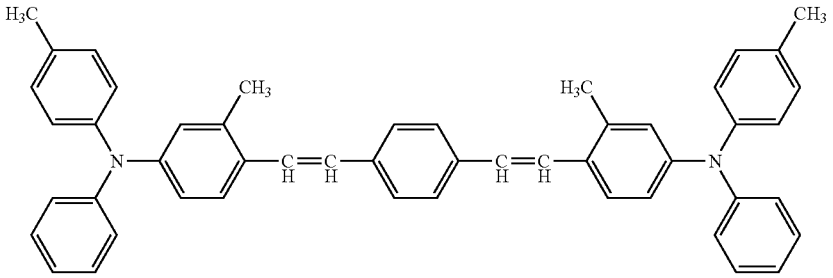
CTM38
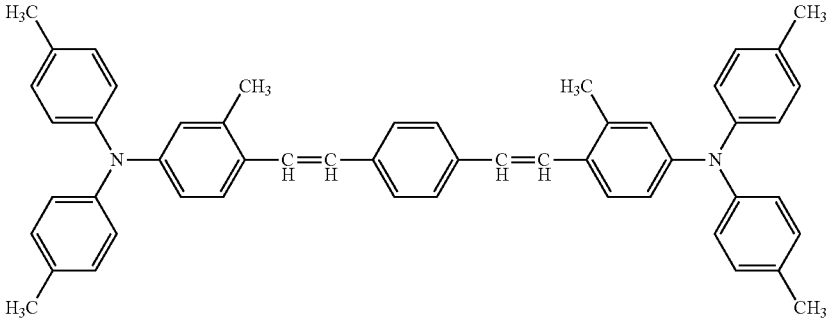
CTM39
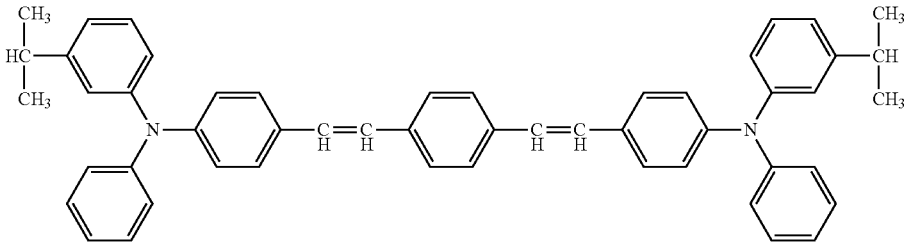
CTM40
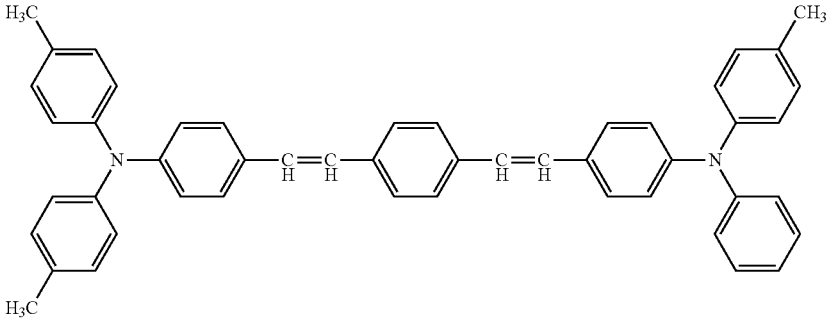
CTM41
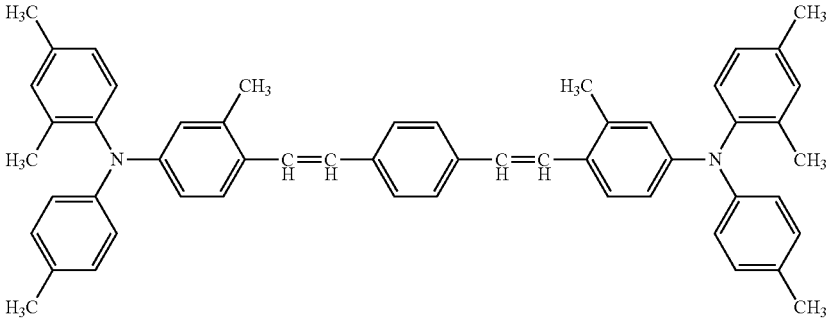

-continued
CTM42
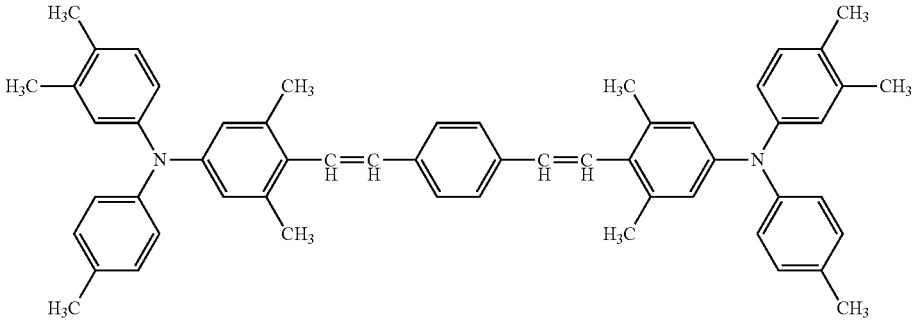
CTM43
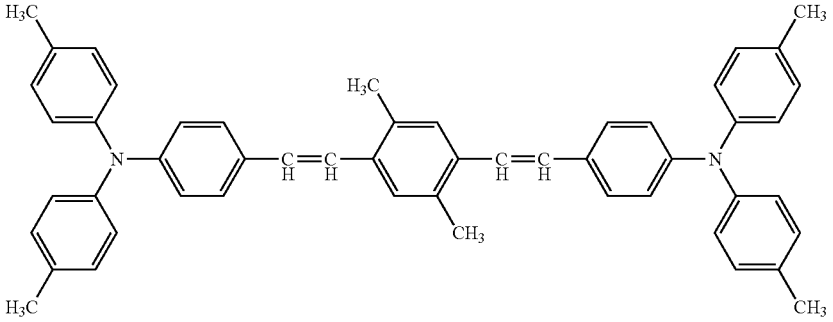
CTM44
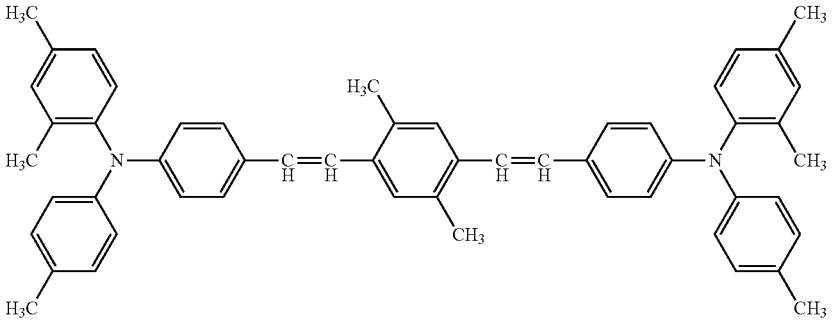
CTM45
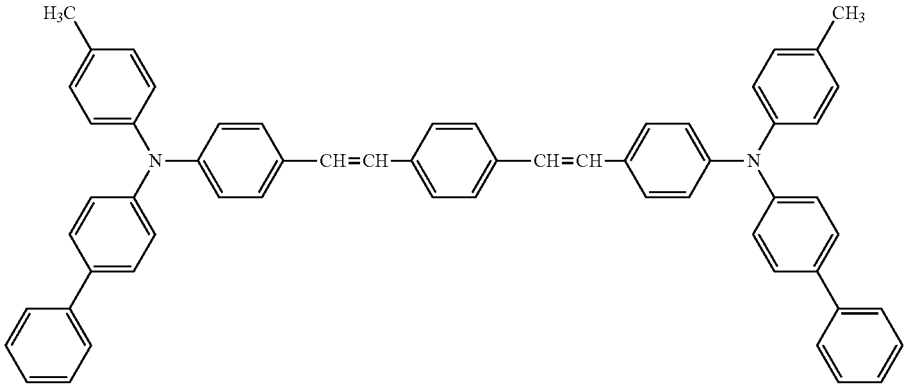

-continued
CTM46
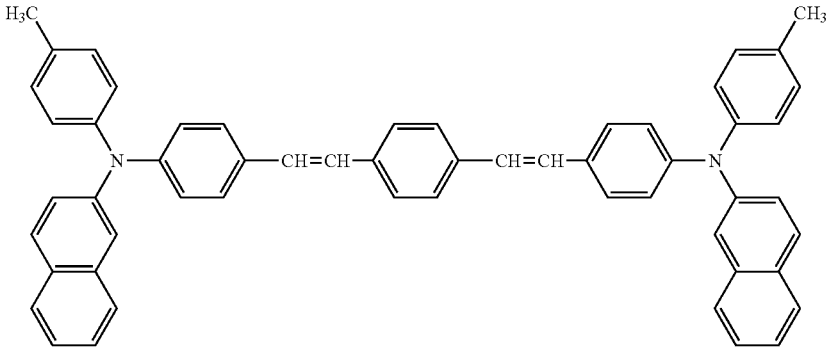
CTM47
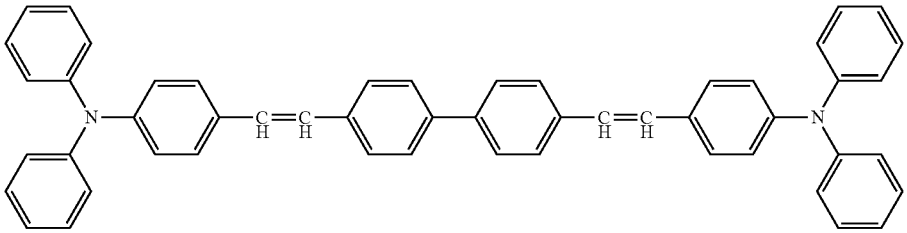
CTM48
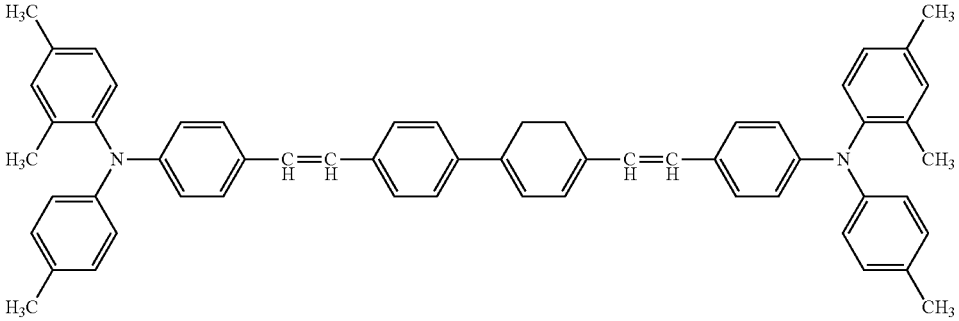
CTM49
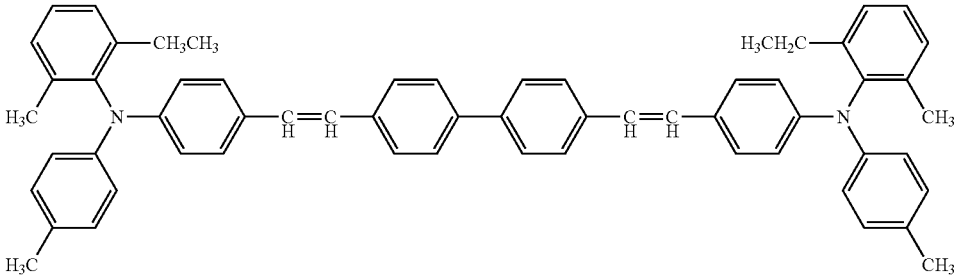
CTM50
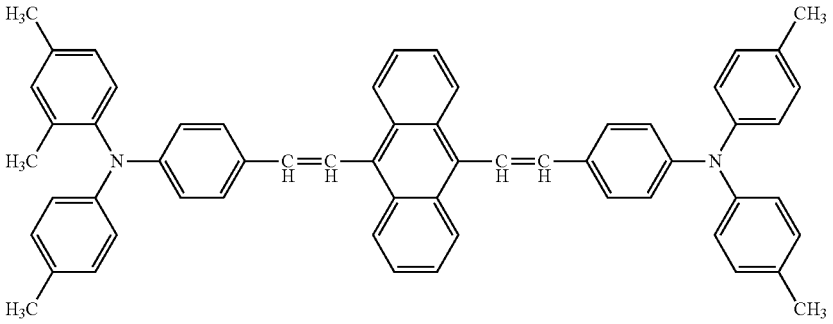

-continued
CTM51
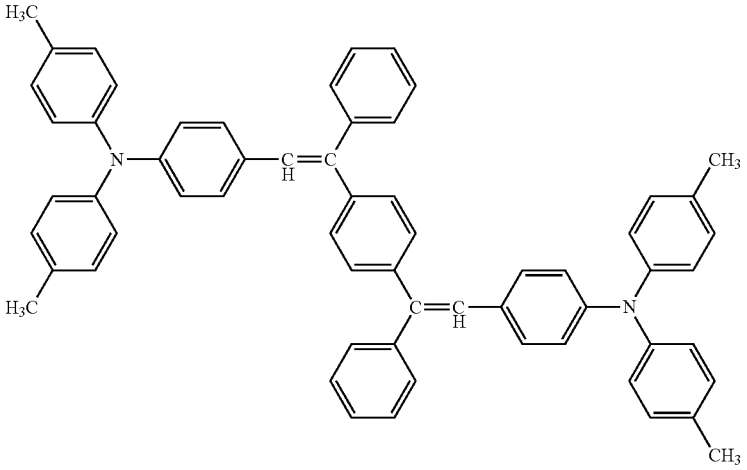
CTM52
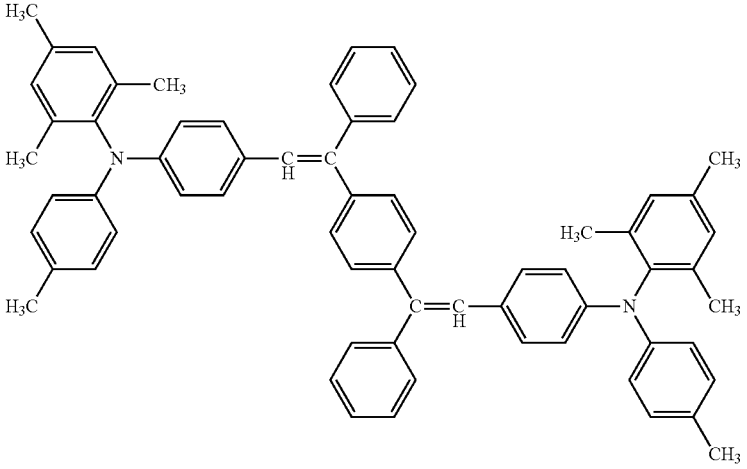
CTM53
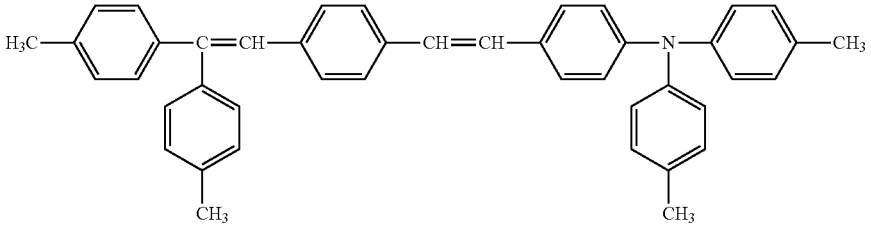
CTM54
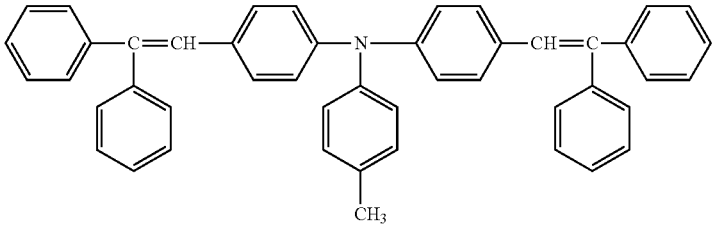

-continued
CTM55
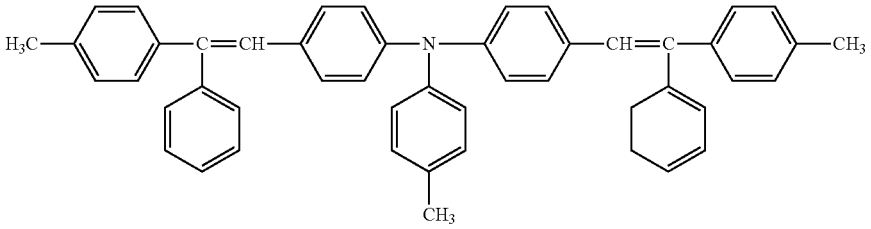
CTM56
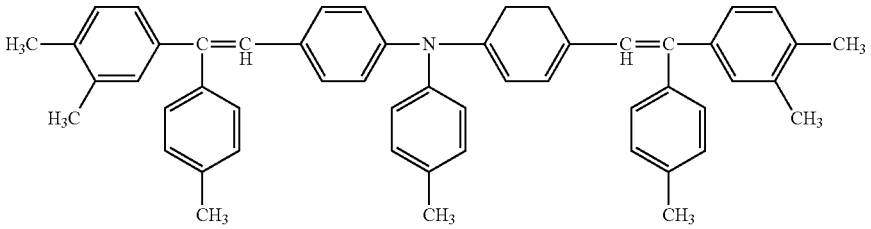
CTM57
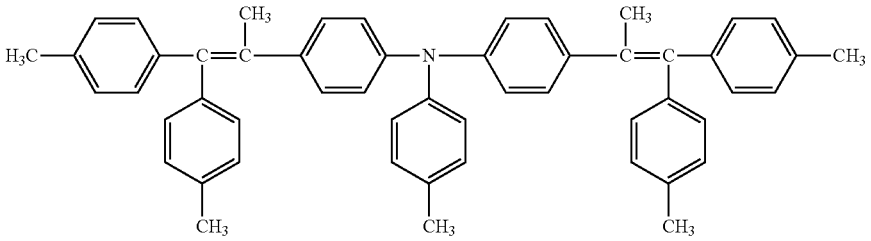
CTM58
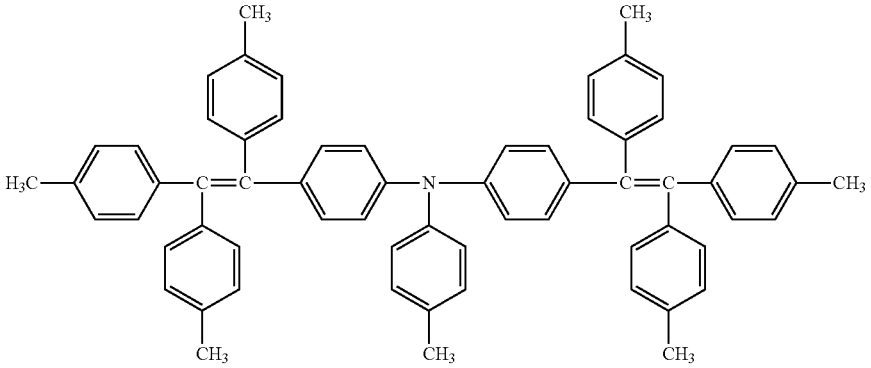
CTM59
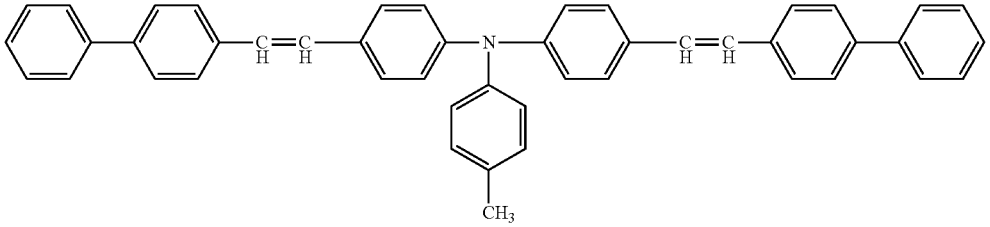
CTM60
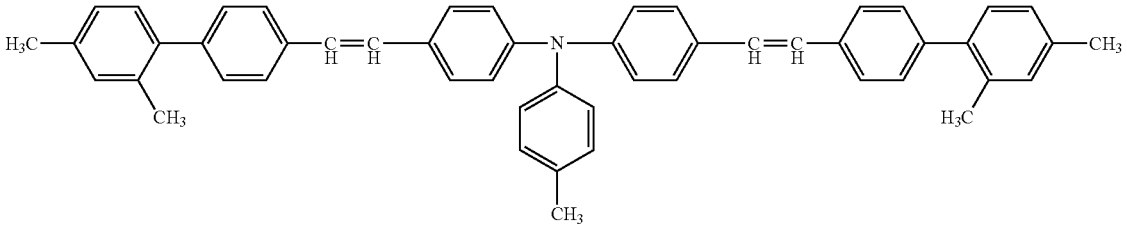

-continued

CTM61

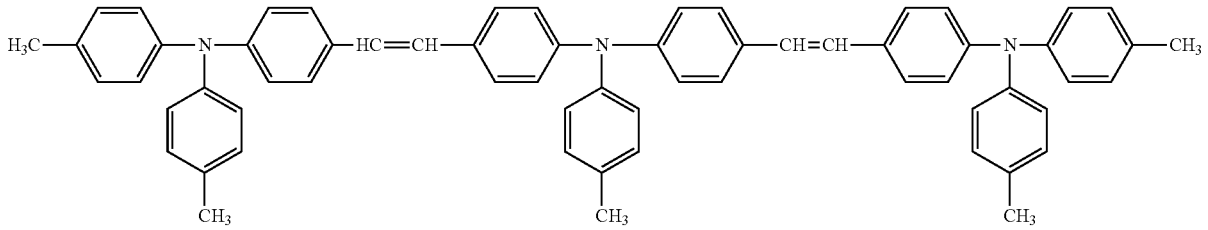

In the present disclosure, the charge transport material contained in the charge transport layer that has a small ionization potential is preferred because the infusion barrier of the charge from the charge generation layer is reduced and the fluctuation of the voltage at the irradiated portion of the image bearing member is significantly limited.

To be specific, although depending on the charge transport material, the ionization potential thereof is preferably from 5.20 to 5.5 eV.

When the ionization potential of the charge transport material is too small, the rise in the voltage at the irradiated portion is completely limited, but the voltage at the irradiated portion lowers and the voltage at dark portions also lowers.

In addition, image blur easily occurs during repetitive use.

To the contrary, when the ionization potential of the charge transport material is too large, image blur can be reduced but the voltage at the irradiated portion easily rises particularly in one job.

In the present disclosure, the charge transport material contains a diamine compound represented by the chemical structure 1 and the diamine compound is present more on the photosensitive layer side than the surface layer side. In addition, since the impact of the charge trap is reduced, a charge transport material having a small ionization potential can be used. Consequently, this contributes to have a good combination of reduction of image blur and reduction of fluctuation of the potential at the irradiated portion.

Image blur is thought to occur because the charge transport material present on the surface of the charge transport layer is degraded by oxidation by an oxidized gas that infuses from the surface of the image bearing member to the inside thereof.

When the oxidized gas infuses into the inside of the image bearing member, deterioration by oxidization progresses for the charge transport material present particularly on the surface of the charge transport layer. However, since the protection layer is provided on the surface, the area of deterioration by oxidization is not removed and thus the deterioration is steadily progresses.

The diamine compound of the present disclosure is thought to prevent this deterioration by oxidization of the charge transport material in the charge transport layer caused by infusion of an oxidized gas from the surface of the image bearing member into the inside thereof.

Therefore, the diamine compound is provided closer to the surface of the image bearing member than to the surface of the charge transport layer, that is, the diamine compound is provided in the protection layer to prevent image blur more effectively.

However, the image blur is caused to occur in the surface area of the charge transport layer where the charge transport material is densely present. Therefore, if the diamine compound is contained in the charge transport layer as well, the image blur is furthermore reduced, resulting in a long working life of the image bearing member.

The ionization potential mentioned above represents an amount of energy required to take one electron out from the ground state of a material.

The ionization potential of the charge transport layer, and the ionization potential of the protection layer are directly measured by using a film of the charge transport layer and the protection layer as is, respectively.

The ionization potential is measured by irradiating a sample with ultra-violet beams dispersed by a monochrometer in the atmosphere while changing the energy level of the beams to calculate the energy by which a photoelectron is discharged according to the photoelectric effect.

Photoelectron spectrometer surface analyzer (AC-1, AC-2, or AC-3, manufactured by Riken Keiki Co., Ltd.) can be used for measuring the ionization potential.

Specific examples of the binder resins for the charge transport layer include, but are not limited to, thermoplastic resins, or thermosetting resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, an urethane resin, a phenol resin, and an alkyd resin.

Among these, polycarbonate and polyarylate are preferably used.

The content of the charge transport material is from 20 to 300 parts by weight and preferably from 40 to 150 parts by weight based on 100 parts by weight of the binder resin.

In addition, the charge transport material and the binder resin are independently used alone or in combination.

Specific examples of the solvent for use in the liquid application for the charge transport layer include, but are not limited to, tetrahydrofuran, dioxane, dioxolan, toluene, cyclohexanone, cyclopentanone, methylethylketone, xylnene, acetone, diethylether, and methylethylketone.

Among these, tetrahydrofuran, toluene, xylene and cyclopentanone are preferably used.

These can be used alone or as a mixture of two or more.

In addition, an additive such as a plasticizer, a leveling agent, anti-oxidant, and a lubricant can be optionally added to the liquid application of the charge transport layer. These can be used alone or in combination.

The charge transport layer has an improved gas-resistance and/or cracking-resistance by addition of such plasticizers.

Specific examples of the plasticizers include, but are not limited to, dibutylphthalate and dioctyl phthalate.

The addition amount is preferably from 0 to 30% by weight and more preferably from 1 to 10% by weight based on the binder resin.

By addition of an oxidant, the decrease in the voltage in the dark portion is limited, the gas-resistance is improved, and the image blur is reduced.

Specific examples of the anti-oxidants include, but are not limited to, known materials such as phenol based compounds, paraphenylene diamines, hydroquinones, organic sulfur compounds and hindered amines.

The film quality of the charge transport layer is improved by addition of the leveling agent so that occurrence of the film defect is prevented.

In addition, the uneven thickness of the film is also reduced and thus a smooth film is obtained. Specific examples of the leveling agent include, but are not limited to, silicone oils, for example, dimethyl silicone oil and methyl phenyl silicone oil, and polymers or oligomers having perfluoroalkyl groups in its side chain. The addition amount of the leveling agent is preferably from 0 to 1% by weight and more preferably from 0.01 to 0.05% by weight based on the binder resin.

Known methods such as a dip coating method, a spray coating method, a bead coating method, a nozzle coating method, a spinner coating method, and a ring coating method can be used as the method of applying the charge transport layer. Among these, the dip coating method is preferable.

Subsequent to application and drying by finger touching, the applied layer is heated and dried in an oven, etc. The drying temperature of the charge transport layer varies depending on the kind of the solvent contained in the liquid application of the charge transport layer and is preferably from 80 to 150° C. and more preferably from 100 to 140° C.

The thus obtained charge transport layer has a thickness of from 10 to 50 μm and preferably from 15 to 35 μm.

Photosensitive Layer of Single Layer

The photosensitive layer of a single layer structure has both a charge generation function and a charge transport function at the same time and can be formed by dissolving or dispersing a charge generation material having a charge generation function, a charge transport material having a charge transport function, and a binder resin in a suitable solvent followed by coating and drying.

In addition, a plasticizing agent and/or a leveling agent can be added, if desired.

The same dispersion method, the charge generation materials, the charge transport materials, the plasticizers, and the leveling agents as described above for the charge generation layer and the charge transport layer are suitably used for the photosensitive layer.

The binder resin specified for the charge transport layer and a mixture of the binder resin with the binder resin specified in the charge generation layer can be used.

The content of the charge generation material contained in the photosensitive layer having a single layer structure is preferably from 1 to 30% by weight based on the total amount of the photosensitive layer. The content of the binder resin contained in the photosensitive layer having a single layer structure is preferably from 20 to 80% by weight based on the total amount of the photosensitive layer. The content of the charge transport material contained in the photosensitive layer having a single layer structure is preferably from 10 to 70% by weight based on the total amount of the photosensitive layer.

The layer thickness of the photosensitive layer is suitably from about 5 to about 30 μm, and preferably from 10 to about 25 μm.

Protection Layer

The protection layer is described next.

The protection layer in the present disclosure has the diamine compound represented by the chemical structure 1 and the diamine compound is present more on the side of the photosensitive layer than the side of the surface of the protection layer relative to the center of the protection layer in the depth direction.

The diamine compound is described first.

The diamine compound in the present disclosure is as illustrated below.

Chemical structure 1

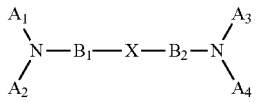

In the chemical structure 1, X represents a substituted or non-substituted arylene group, or a compound represented by the chemical structure 2.

Chemical structure 2

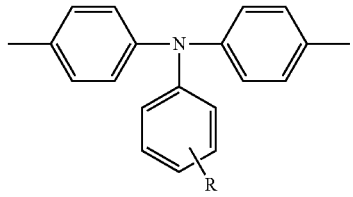

In the Chemical structure 2, R represents hydrogen atom, an alkyl group having 1 to 4 carbon atoms, and an alkoxy group having 1 to 4 carbon atoms.

$A_1$, $A_2$, $A_3$, and $A_4$ independently represent an alkyl group having 1 to 4 carbon atoms, a substituted or non-substituted aryl group or, —$CH_2(CH_2)_mZ$, where Z represents a substituted or non-substituted aryl group, a substituted or non-substituted cycloalkyl group, and a substituted or non-substituted heterocycloalkyl group, and m represents 0 or 1.

$B_1$, and $B_2$ represent —$CH_2$—, —$CH_2CH_2$—, —$CH_2$—$Ar_a$—, —$Ar_a$—$CH_2$—, —$CH_2CH_2$—$Ar_a$—, and —$Ar_a$—$CH_2CH_2$—, where $Ar_a$ represents a substituted or non-substituted arylene group.

Although the mechanism of the impact on reduction of image blur of the diamine compound is not clear at this point of time, the amino group contained in the diamine compound is of strong base, which is considered to prevent the transmutation of the charge transport material by oxidized gas.

Different from the anti-oxidant, the diamine compound does not have a polar group that easily traps charges, but has charge transportability. Therefore, the diamine compound is capable of reducing the impact of a rise in the voltage at the irradiated portion and the residual voltage even if the diamine compound is added in a large amount, Among the selected groups, the group having most effective to reduction on image blur is thought to be (i): an alkyl group having 1 to 4 carbon atoms, then, (ii): —$CH_2(CH_2)_mZ$, and finally, (iii): a substituted or non-substituted aryl group.

This is also the sequence of the magnitude of the impact on the rise in the voltage at irradiated portions.

Therefore, in the chemical structure 1, it is preferable to select suitable combinations of groups of $A_1$, $A_2$, $A_3$, and $A_4$ from an alkyl group having 1 to 4 carbon atoms, —$CH_2(CH_2)_mZ$, and a substituted or non-substituted aryl group Specific examples of the combinations of $A_1$, $A_2$, $A_3$, and $A_4$ include, but are not limited to, $A_1$, and $A_3$: (i) an alkyl group having 1 to 4 carbon atoms, and $A_2$, and $A_4$: (i) an alkyl group having 1 to 4 carbon atoms;

$A_1$, and $A_3$: (i) an alkyl group having 1 to 4 carbon atoms, and $A_2$, and $A_4$: (ii) —$CH_2(CH_2)_mZ$;

$A_1$, and $A_3$: (i) an alkyl group having 1 to 4 carbon atoms, and $A_2$, and $A_4$: (iii) A substituted or non-substituted aryl group;

$A_1$, and $A_6$: (ii) —$CH_2(CH_2)_mZ$, and $A_2$, and $A_4$: (ii) —$CH_2(CH_2)_mZ$, and $A_1$, and $A_3$: (ii) —$CH_2(CH_2)_mZ$, and $A_2$, and $A_4$: (iii) A substituted or non-substituted aryl group.

In the combination of $A_1$, and $A_3$, and $A_2$, and $A_4$ having both (iii) A substituted or non-substituted aryl group, the charge transportability is extremely improved, but the image blur is not reduced, which is not preferable.

The diamine compound preferably has a molecular weight of from 300 to 900, and more preferably from 400 to 600.

In the case of a diamine compound having an excessively small molecular weight, the diamine compound tends to have an excessive sublimation property.

To the contrary, in the case of a diamine compound having an excessively large molecular weight, the compatibility tends to deteriorate and curing inhibition may be caused if a curable resin is used for the protection layer.

Among these, the diamine compound represented by the following chemical structure 3 is extremely suitable.

Chemical Structure 3

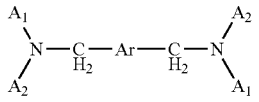

In the chemical structure 3, $A_1$, and $A_2$ are the same as described in the Chemical structure 1, and Ar represents a substituted or non-substituted arylene group.

Specific examples thereof are as follows:

No. 1

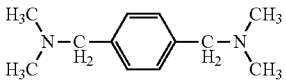

No. 2

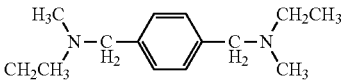

No. 3

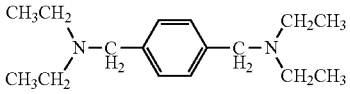

No. 4

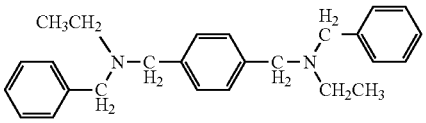

No. 5

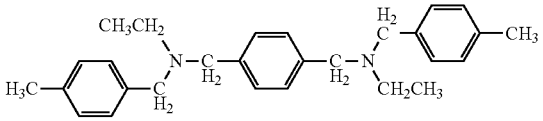

No. 6

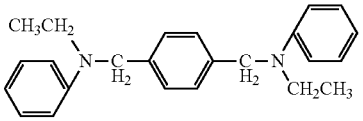

No. 7

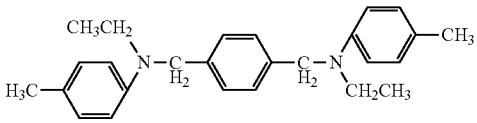

No. 8

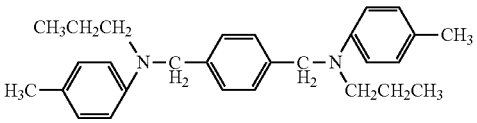

No. 9

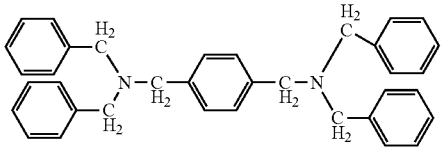

No. 10

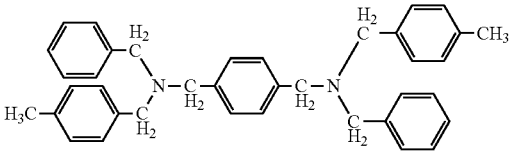

No. 11

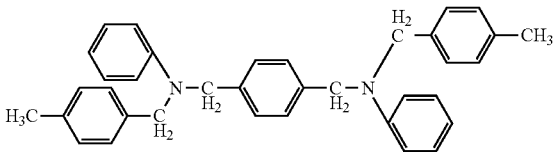

No. 12

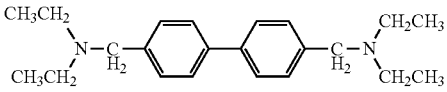

No. 13

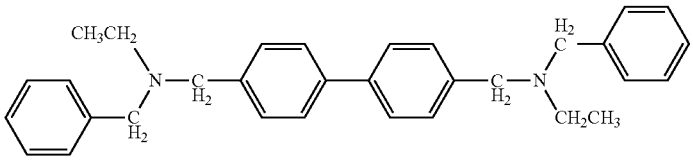

No. 14

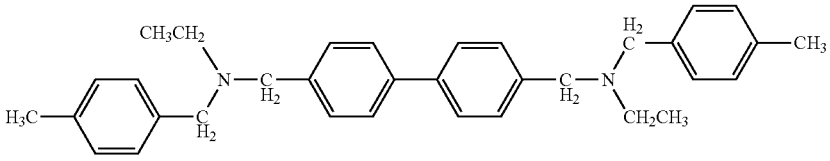

-continued
No. 15
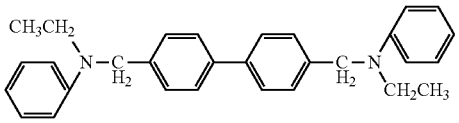
No. 16
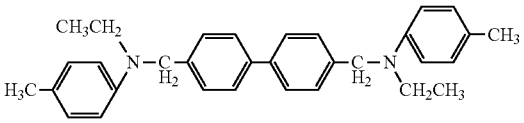
No. 17
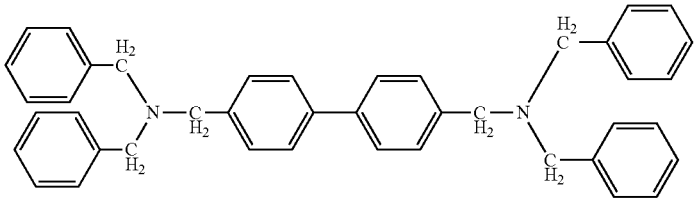
No. 18
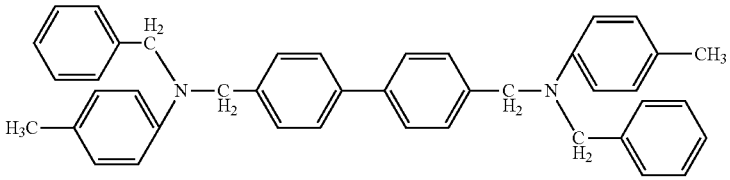
No. 19
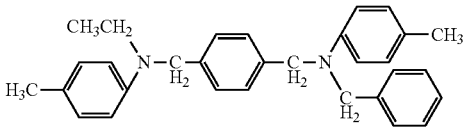
No. 20
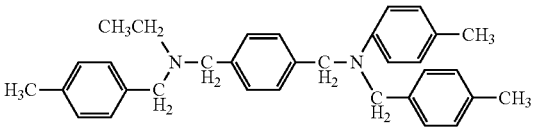
No. 21
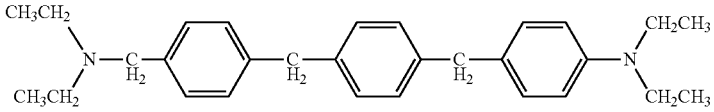
No. 22
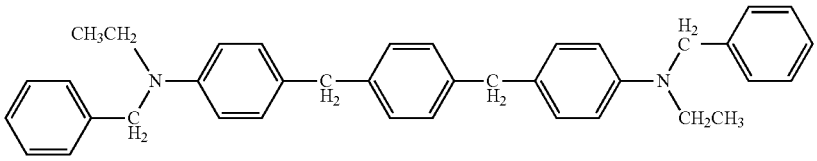
No. 23
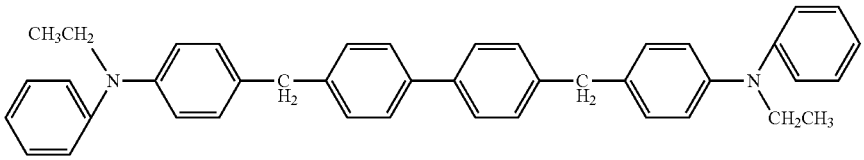
No. 24
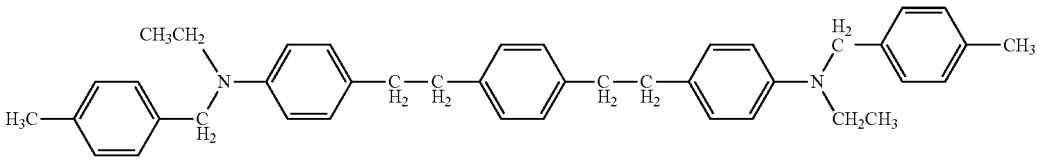
No. 25
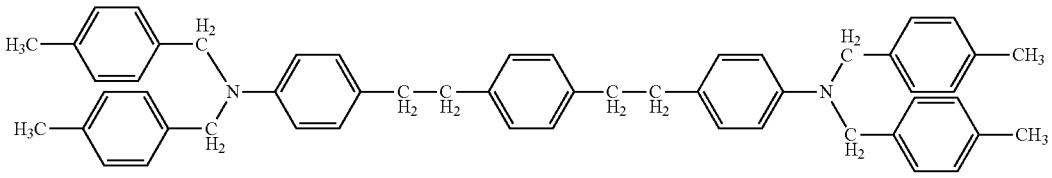

-continued

No. 26

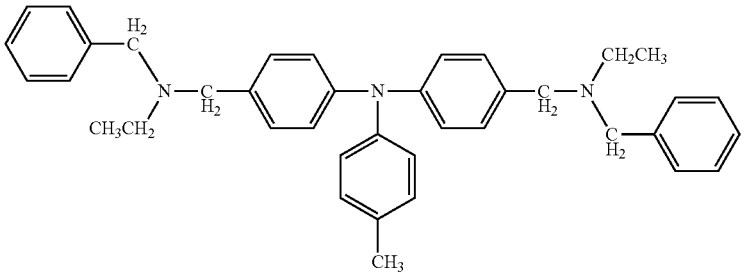

No. 27

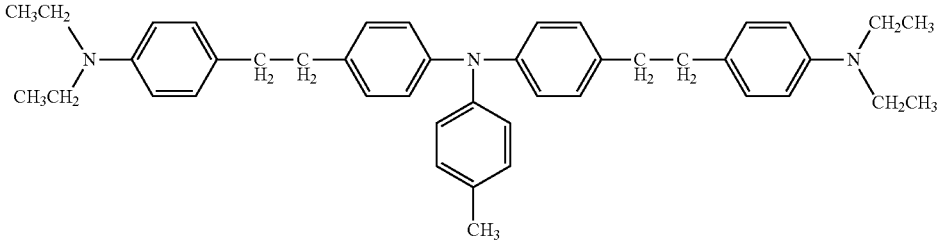

No. 28

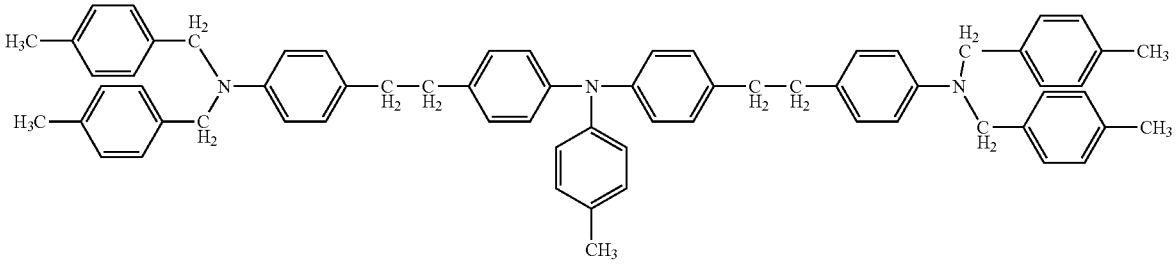

No. 29

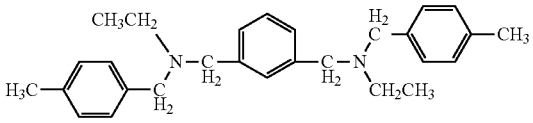

No. 30

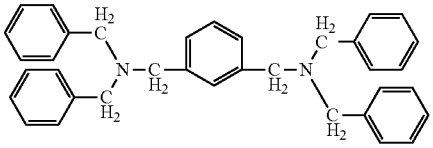

No. 31

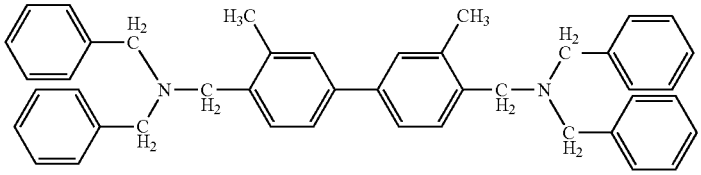

The diamine compound represented by the chemical structure 1 is present more on the side of the photosensitive layer than the side of the surface of the protection layer relative to the center of the protection layer in the depth direction.

When the diamine compound is evenly contained in the entire area of the protection layer, the fluctuation of the voltage at the irradiated portion in one day is limited but the fluctuation of the voltage at the irradiated portion in one job increases.

In the present disclosure, since the diamine compound is present more on the side of the photosensitive layer than the side of the surface of the protection layer relative to the center of the protection layer in the depth direction, not only the fluctuation of the voltage at the irradiated portion in one day but also the fluctuation of the voltage at the irradiated portion in one job can be reduced so that the image density and the color tone are stabilized.

The mechanism of this phenomenon is not clear, but the transmutation of the diamine compound during repetitive use is deduced to be one of the causes.

When the diamine compound is present on the surface of the protection layer in a large quantity, the diamine compound is transmutated by the oxidized gas. As a result, the thus produced secondary amine is considered to accelerate charge trap.

When the diamine compound is present more on the side of the photosensitive layer than on the surface of the protection layer, the diamine compound is hardly affected by the oxidized gas so that the fluctuation of the voltage at the irradiated portion in one day is reduced and at the same time the fluctuation of the voltage at the irradiated portion in one job is limited for an extended period of time.

In addition, the impact of containing the dimaine compound more on the side of the photosensitive layer than on the surface of the protection layer is seen particularly when a curable resin is used for the protection layer.

When the diamine compound is present excessively on the side of the surface of the protection layer, curing may be inhibited.

In particular, when curing is conducted using irradiation, curing may not fully proceed to the inside of the protection layer.

Furthermore, the diamine compound itself is transmuted by light irradiation, which may become another factor for charge trap.

By reducing the amount of the diamine compound on the side of the surface of the protection layer, the impact described above can be reduced. Therefore, the voltage at the irradiated portion is stabilized and occurrence of image blur is limited without sacrificing the durability and abrasion resistance of the image bearing member.

The binder resin of the protection layer is described next.

The binder resin in the protection layer can be thermoplastic resins or thermocuring resins.

Specific examples of the binder resin include, but are not limited to, thermoplastic resins or thermocuring resins, for example, polystyrene, copolymers of styrene and acrylonitrile, copolymers of styrene and butadiene, copolymers of styrene and maleic anhydrate, polyesters, polyvinyl chlorides, copolymers of a vinyl chloride and a vinyl acetate, polyvinyl acetates, polyvinylidene chloride, polyarylate resins, phenoxy resins, polycarbonate reins, cellulose acetate resins, ethyl cellulose resins, polyvinyl butyral, polyvinyl formal, polyvinyl toluene, poly-N-vinylcarbozole, phenol resins, melamine resins, epoxy resins, alkyd resins, urethane resins, amino resins, polyimide resins, silicone resins, and acrylic resins. Among these, urethane resins, phenol resins, acrylic/methacrylic resins, siloxane, epoxy resins, etc. are suitably used as a curable resin.

Thermoplastic resins are suitable but not enough to improve the durability and abrasion resistance. In terms of this improvement, thermocuring resins are preferable.

Therefore, when a curable resin is used for the protection layer, it is preferable to cure a polymerizable compound having a charge transport structure and a polymerizable compound having no charge transport structure.

Therefore, the charge transportability in the image bearing member can be maintained without having an adverse impact on the durability and the abrasion resistance.

When the production reaction of polymers are classified into chain reaction polymerization and successive polymerization, polymerization is the polymerization reaction form of the former and includes unsaturated polymerization, ring opening polymerization, isomerization polymerization, etc. in which the reaction form mainly proceeds via an intermediate such as an ion or radical.

In addition, the polymerizable compound represents a compound having a functional group that enables the reaction form described above.

In addition, curing typically represents a reaction forming a three dimensional network structure formed by binding monomers or oligomers having the functional group mentioned above upon application of heat, light such as optical light or ultraviolet, or energy such as electron beam or radiation such as gamma ray through, for example, covalent binding.

The curable resin includes thermoplastic resins polymerized by heat, optical curable resins polymerized by light such as ultraviolet and optical light, electron beam curable resins polymerized by electron beam, etc. Optionally, curing agents, catalysts and polymerization initiators are added in combination.

Polymerizable compounds such as monomers or oligomers that include a functional group that causes polymerization reaction are used to obtain a cured protection layer.

Any functional groups that cause polymerization reaction can be used and generally unsaturated polymerizable functional groups and ring opening polymerizable functional groups are well known.

Specific examples of the unsaturated polymerizable functional groups include, but are not limited to, carbon carbon double bond, carbon carbon triple bond, carbon oxygen double bond, carbon nitrogen double bond, and carbon nitrogen triple bond. The unsaturated groups therein conduct polymerization reaction via radicals and ions.

The ring opening polymerizable functional groups conduct reaction in which polymerization reaction starts and repeats at the same time when the unstable ring structure formed of a carbon ring, an oxo ring, and nitrogen hetero ring that have distortion opens to produce chained polymers mostly via ions as active species.

Specific examples thereof include, but are not limited to, groups having carbon carbon double bond such as acryloyl group, methacryloyl group, and vinyl group, functional groups causing ring opening polymerization such as silanol group and a cyclic ether group. Two or more kinds of molecules may be included in the polymerization reaction.

In addition, in the curing reaction, as the number of functional groups contained in one molecule of a reactive monomer increases, the obtained three dimensional network structure is solid and firm. Therefore, three or more functional groups are preferably contained in one molecule.

Therefore, the curing density is high, thereby improving the hardness, elasticity, uniformity, smoothness of the protection layer, which leads to improvement on durability of an image bearing member using the protection layer, and the image quality The protection layer in the present disclosure is preferably a layer formed by curing a polymerizable compound having a charge transport structure and a polymerizable compound having no charge transport structure. Any known material can be used to obtain an excellent protection layer irrespective of the material and the method.

In the present disclosure, acryl/methacryl resins are particularly preferable because they are strong for abrasion and damage and have excellent electrostatic characteristics.

These curable resins form a three-dimensional network structure and are insoluble in an organic solvent.

Therefore, in the present invention, the cured state of the curable resin represents that when, for example, an alcohol based organic solvent is attached to the cured resin, the layer is not dissolved therein.

When the protection layer is cured, a three-dimensional network structure is formed by curing reaction of a polymerizable compound having a charge transport structure and a polymerizable compound having no charge transport structure.

The degree of curing can be improved by preliminarily mixing a curing agent, a catalyst, a polymerization initiator, etc.

Therefore, the abrasion resistance of the protection layer is markedly improved. Furthermore, non-reacted functional groups hardly remain, which is preferable to improve the abrasion resistance and limit deterioration of electrostatic characteristics.

In addition, the reaction proceeds uniformly so that cracking or distortion hardly occurs, thereby improving the cleaning property. This leads to improvement in durability of the obtained image bearing member and image quality.

With regard to the polymerizable compound having a charge transport structure, any known materials can be used as long it has a charge transport structure and a functional group reactive with the cured resin described above.

The charge transport structure represents a structure contained in a charge transport material, thereby demonstrating the charge transport property.

The charge transport structure is typically classified into a structure that transports positive holes, and a structure that transport electrons. Both are included in the present invention.

The number of the charge transport structure, i.e., the structure that transports positive holes, or the structure that transport electrons, in a compound is at least one. A charge transport structure having multiple charge transport structures is preferable in terms of the charge transport property.

In addition, a charge transport structure demonstrating a bipolar property, meaning that a positive hole transport structure and an electron transport structure are contained in the molecule of a polymerizable compound having a charge transport structure simultaneously, can be also used.

Specific examples of the positive hole transport structures among the charge transport structures include, but are not limited to, structures demonstrating electron donating property such as poly-N-vinylcarbazole, poly-γ-carbazolyl ethylglutamate, condensation product of pyrene-form aldehyde, polyvinylpyrene, polyvinyl phenanthrene, polysilane, oxazole, oxadiazol, imidazole, monoarylamine, diaryla mine, triaryl amine, stilbene, α-phenyl stilbene, bendidine, diarylmethane, triarylmethane, 9-styryl anthracene, pyrazoline, divinyl benzene, hydrazone, indene, butadiene, bisstilbene, and enamine.

Specific examples of such electron transport structures include, but are not limited to, electron accepting structure material such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothhiophene-5,5-dioxide, condensed heterocyclic quinine, diphenoquinone, benzoquinone, naphtharene tetracarboxylic acid diimide, and aromatic rings having a cyano group or a nitro group.

Next, acrylic resins are described in detail as an example of the cured resin.

The polymerizable compound having no charge transport structure for use in the present invention represents a compound having a polymerizable functional group without a positive hole transport structure such as triaryl amine, hydrazone, pyrazoline, or carbazole, or an electron transport structure such as condensed polycyclic quinone, diphenoquinone or an electron absorbing aromatic ring having a cyano group or a nitro group.

The polymerizable functional group is any polymerizable functional group which has a carbon-carbon double bond.

For example, 1-substituted ethylene functional groups and 1,1-substituted ethylene functional groups are suitably used as the polymerizable functional group.

A specific example of 1-substituted ethylene functional groups is the functional group represented by $CH_2{=}CH{-}X_1{-}$.

In the chemical formula of $CH_2{=}CH{-}X_1{-}$, $X_1$ represents an arylene group such as a substituted or non-substituted phenylene group, and a naphthylene group, a substituted or non-substituted alkenylene group, —CO—, —COO—, —CON($R_{30}$)($R_{30}$ represents hydrogen atom, an alkyl group such as methyl group and ethyl group, an aralkyl group such as benzyl group, naphthyl methyl group, and phenethyl group, and an aryl group such as phenyl group and naphthyl group), or —S—.

Specific examples of such functional groups include, but are nor limited to, vinyl group, styryl group, 2-methyl-1,3-butadienyl group, vinyl carbonyl group, acryloyloxy group, acryloyl amide group, and vinylthio ether group.

A specific example of 1,1-substituted ethylene functional groups is the functional group represented by $CH_2{=}C(Y){-}X_2{-}$.

In the chemical formula of $CH_2{=}C(Y){-}X_2{-}$, Y represents a substituted or non-substituted alkyl group, a substituted or non-substituted aralkyl group, an aryl group such as a substituted or non-substituted phenyl group and naphtylene group, a halogen atom, cyano group, nitro group, an alokoxy group such as methoxy group and ethoxy group, —$COOR_{31}$ ($R_{31}$ represents hydrogen atom, an alkyl group such as a substituted or non-substituted methyl group and ethyl group, an aralkyl group such as a substituted or non-substituted benzyl group, naphthylmethyl group, and phenethyl group, an aryl group such as substituted or non-substituted phenyl group and naphtyl group or —$CONR_{32}R_{33}$ ($R_{32}$ and $R_{33}$ independently represent a hydrogen atom, an alkyl group such as a substituted or non-substituted methyl group and ethyl group, an aralkyl group such as a substituted or non-substituted benzyl group, naphthyl methyl group, and phenethyl group, or an aryl group such as substituted or non-substituted phenyl group and naphtyl group).

$X_2$ represents a single bond, the same substitution group as $X_1$, or an alkylene group.

At least one of $Y_4$ and $X_2$ is an oxycarbonyl group, cyano group, an alkenylene group and an aromatic ring.

Specific examples of these functional groups include, but are not limited to, α-acryloyloxy chloride group, methacryloyloxy group, α-cyanoethylene group, α-cyanoacryloyloxy group, α-cyanophenylene group and methacryloyl amino group.

Specific examples of substitution groups further substituted to the substitution groups of $X_1$, $X_2$ and Y include, but are not limited to, a halogen atom, nitro group, cyano group, an alkyl group such as methyl group and ethyl group, an alkoxy group such as methoxy group and ethoxy group, aryloxy group such as phenoxy group, aryl group such as phenyl group and naphtyl group, and an aralkyl group such as benzyl group and phenetyl group.

Among these polymerizable functional groups, acryloyloxy group and methacryloyloxy group are particularly preferable.

With regard to the number of the functional groups of the polymerizable compound (monomer or oligomer) having no charge transport structure, the greater, the better. Particularly, a polymerizable compound having 3 or more functional groups is preferable. When a polymerziable monomer having 3 or more functional groups is cured, a three dimensional network structure is developed and thus a layer having a high hardness with an extremely high density and a high elasticity is obtained. In addition, the layer is uniform and smooth while demonstrating a high abrasion resistance and durability.

However, since a great number of bonds are instantly formed in the curing reaction depending on the curing condition and materials, volume contraction or internal stress may occur, which leads to cracking or peeling-off of the layer. If this is the case, a polymerizable monomer having one or two functional groups or mixture thereof is used to deal with such cracking or peeling-off.

Next, the polymerizable compound having no charge transport structure with three or more functional groups suitable to improve the abrasion resistance is described.

A compound having at least three acryloyloxy groups is obtained by performing ester reaction or ester conversion reaction using, for example, a compound having at least three hydroxyl groups therein and an acrylic acid (salt), a halide acrylate and an ester of acrylate. A compound having at least three methacryloyloxy groups is obtained in the same manner.

In addition, the radical polymerizable functional groups in a monomer having at least three radical polymerizable functional groups can be the same or different from each other.

Specific examples of the radical polymerizable compound, i.e., monomer, having at least three functional groups with no charge transport structure include, but are not limited to, the following compounds, but are not limited thereto.

Specific examples of the radical polymerizable monomers mentioned above for use in the present invention include, but are not limited to, trimethylol propane triacrylate (TMPTA), trimethylol propane trimethacrylate, HPA (i.e., alkylene) modified trimethylol propane triacrylate, EO (i.e., ethyleneoxy) modified trimethylol propane triacrylate, PO (i.e., propyleneoxy) modified trimethylol propane triacrylate, caprolactone modified trimethylol propane triacrylate, HPA modified trimethylol propane triacrylate, pentaerythritol triacrylate, pentaerythritol tetra acrylate (PETTA), glycerol triacrylate, ECH (i.e., epichlorohydrin) modified glycerol triacrylate, EO modified glycerol triacrylate, PO modified glycerol triacrylate, tris(acryloxyrthyl) isocyanulate, dipenta erythritol hexacrylate (DPHA), caprolactone modified dipenta erythritol hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, EO modified phosphoric acid triacrylate, and 2,2,5,5-tetrahydroxy methyl cyclopentanone tetracrylate. These can be used alone or in combination.

The reason why the compound is modified is to handle it with ease by decreasing the viscosity thereof.

In addition, the radical polymerizable compound having no functional group preferably has a ratio (molecular weight/the number of functional groups) of the molecular weight to the number of functional groups in the compound (i.e., monomer) of 250 or less to form a dense cross linking bonds in the protection layer.

Furthermore, when the ratio (molecular weight/the number of functional groups) is too large, a cross linked surface layer formed of such a monomer is soft and thus the anti-abrasion property of the cross linked surface layer tends to deteriorate. Therefore, among the monomers mentioned above, usage of a monomer having an extremely long modified (e.g., HPA, EO, PO modified) group is not suitable.

In addition, the content ratio of the radical polymerizable compound having no charge transport structure for use in the protection layer is from 20 to 80% by weight and preferably from 30 to 70% by weight based on the total weight of the protection layer.

When the monomer content ratio is too small, the density of three-dimensional cross-linking in the surface layer tends to be low. Therefore, the abrasion resistance thereof is not drastically improved in comparison with a case in which a typical thermoplastic binder resin is used.

When the monomer content ratio is too large, the content of the charge transport compound decreases, thereby degrading the electric characteristics.

Desired electric characteristics and abrasion resistance vary depending on the process used. Therefore, it is difficult to jump to any conclusion but considering the balance of the combination, the range of from 30 to 70% by weight is most preferred.

Next, the polymerizable compound having a charge transport structure is described.

The radical polymerizable compound (i.e., monomer) having a charge transport structure represents a monomer having a radical polymerizable functional group, and a positive hole structure such as triaryl amine structure, hydrazone structure, pyrazoline structure, or carbazole structure, or an electron transport structure such as condensed polycyclic quinone, diphenoquinone or an electron absorbing aromatic ring having a cyano group or a nitro group.

As the radical polymerizable functional group, the radical polymerizable functional group mentioned in the radical polymerizable monomer specified above can be suitably used. Among these, acryloyloxy group and methcryloyloxy group are particularly suitable.

The polymerizable compound having a charge transport structure for use in the protection layer for use in the present disclosure can be used irrespective of the number of functional groups. However, a polymerizable compound that has one functional group is preferable in terms of the stability of the electrostatic characteristics and the film quality.

A polymerizable compound having a charge transport structure having two or more functional groups is advantageous in terms of the cross linking density because multiple bonds are used to fix the compound in the cross linking structure. However, the charge transport structure is extremely bulky, which increases distortion in the cured layer structure and thus internal stress in the layer.

In addition, the intermediate structure (cation radical) during charge transport is not stabilized. This leads to deterioration of the sensitivity due to the charge trap and a rise of the residual voltage.

Any material that can impart the charge transport function can be used to form the charge transport structure of the polymerizable compound having a charge transport structure. Among these, triaryl amine structure is preferable.

For example, when the compound represented by the following chemical formulae 9 and 10, the voltage at the irradiated portion decreases and image blur caused by oxidized gas is also reduced.

Chemical formula 9

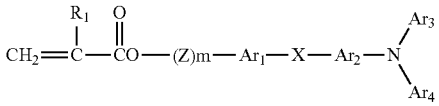

Chemical formula 10

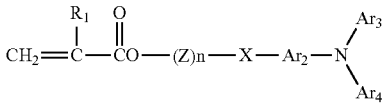

In the Chemical formulae 9 and 10, $R_1$ represents hydrogen atom, a halogen atom, a substituted or non-substituted alkyl group, a substituted or non-substituted aralky group, a substituted or non-substituted aryl group, a cyano group, a nitro group, an alkoxy group, —$COOR_2$, where $R_2$ represents hydrogen atom, a substituted or non-substituted alkyl group, a substituted or non-substituted aralkyl group or a substituted or non-substituted aryl group, a halogenated carbonyl group or $CONR_3R_4$, where $R_3$ and $R_4$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent an arylene group. $Ar_3$ and $Ar_4$ independently represent a substituted or non-substituted aryl group.

X represents a single bond, a substituted or non-substituted alkylene group, a substituted or non-substituted cycloalkylene group, a substituted or non-substituted alkylene ether group, oxygen atom, sulfur atom, or vinylene group. Z represents a substituted or non-substituted alkylene group, a substituted or non-substituted alkylene ether group, or a substituted or non-substituted alkyleneoxycarbonyl group. m and n represent 0 or an integer of 1 to 3.

In the Chemical formulae 9 and 10, among the substitution groups of $R_1$, specific examples of the alkyl groups of $R_1$ include, but are not limited to, methyl group, ethyl group, propyl group, and butyl group. Specific examples of the aryl groups of $R_1$ include, but are not limited to, phenyl group and naphtyl group. Specific examples of the aralkyl groups of $R_1$ include, but are nor limited to, benzyl group, phenthyl group, naphtyl methyl group. The alkoxy group of $R_1$ include, but are nor limited to, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_1$, hydrogen atom and methyl group are particularly preferable.

$Ar_3$ and $Ar_4$ independently represent a substituted or non-substituted aryl group.

In the present disclosure, the aryl group includes polycyclic hydrocarbon groups, non-condensed polycyclic hydrocarbon groups, and heterocyclic groups.

Specific examples of the condensed polycyclic hydrocarbon groups include, but are not limited to, a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include, but are not limited to, a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include, but are not limited to, a single-valent group such as carbazol, dibenzofuran, dibenzothiophene, oxadiazole, and thiadiazole.

The aryl groups represented by $Ar_3$ and $Ar_4$ can have a substitution group. Specific examples thereof are as follows:

(1) Halogen Atom, Cyano Group, and Nitro Group;

(2) Alkyl Group

A straight chained or side chained alkyl group having 1 to 12, more preferably 1 to 8 and furthermore preferably from 1 to 4 carbons is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methyl group, ethyl group, n-butyl group, I-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) Alkoxy Group (—$OR_a$)

$R^a$ represents the alkyl group defined in (2).

Specific examples thereof include, but are not limited to, methoxy group, ethoxy group, n-propoxy group, i-propoxy group, t-butoxy group, n-butoxy group, s-butoxy group, i-butoxy group, 2-hydroxy ethoxy group, benzyl oxy group, and trifluoromethoxy group;

(4) Aryloxy Group

The aryl group thereof is, for example, phenyl group and naphtyl group. These can contain an alkoxy group having 1 to 4 carbon atoms, an alkyl group having a 1 to 4 carbon atoms, or a halogen atom as a substitution group.

Specific examples include, but are not limited to, phenoxy group, 1-naphtyloxy group, 2-naphtyloxy group, 4-methoxyphenoxy group, and 4-methylphenoxy group;

(5) Alkylmercapto Group or Arylmercapto Group

Specific examples of these groups include, but are not limited to, methylthio group, ethylthio group, phenylthio group, and p-methylphenylthio group.

(6) Group Represented by Following Chemical Formula 11

Chemical formula 11

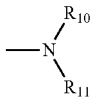

In Chemical formula 11, $R_{10}$ and $R_{11}$ independently represent a hydrogen atom, the alkyl group defined in (2), or an aryl group.

Specific examples of the aryl groups include, but are not limited to, phenyl group, biphenyl group, or naphtyl group. These can contain an alkoxy group having 1 to 4 carbon atoms, an alkyl group having 1 to 4 carbon atoms or a halogen atom as a substitution group.

$R_{10}$ and $R_{11}$ can share a linkage to form a ring.

Specific examples thereof include, but are not limited to, amino group, diethyl amino group, N-methyl-N-phenyl amino group, N,N-diphenyl amino group, N,N-di(tolyl) amino group, dibenzyl amino group, piperidino group, morpholino group, and pyrrolidino group;

(7) An Alkylene Dioxy Group or an Alkylene Dithio Such as Methylene Dioxy Group and Methylene Dithio Group; and (8) A Substituted or Non-Substituted Styryl Group, a Substituted or Non-Substituted β-Phenyl Styryl Group, Diphenyl Aminophenyl Group, Ditolyl Aminophenyl Group, etc.

The arylene groups represented by $Ar_1$ and $Ar_2$ are divalent groups derived from the aryl group represented by $Ar_3$ and $Ar_4$ mentioned above.

X in the Chemical formulae 9 and 10 represents a single bond, a substituted or non-substituted alkylene group, a substituted or non-substituted cycloalkylene group, a substituted or non-substituted alkylene ether group, oxygen atom, sulfur atom, or vinylene group.

A straight chained or side chained alkyl group having 1 to 12, more preferably 1 to 8 and furthermore preferably from 1 to 4 carbons is preferably specified. These alkyl groups can have a fluorine atom, a hydroxyl group, an alkoxy group having 1 to 4 carbon atoms, a phenyl group or a phenyl group substituted by a halogen atom, an alkyl group having 1 to 4 carbon atoms or an alkoxy group having 1 to 4 carbon atoms.

Specific examples thereof include, but are not limited to, methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the cycloalkylene groups in X mentioned above include, but are not limited to, cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms.

Specific examples thereof include, but are not limited to, cyclohexylidene group, cyclohexylene group, and 3,3-dimethyl cyclohexylidene group.

Specific examples of the substituted or non-substituted alkylene ether group include, but are not limited to, ethyleneoxy, propyleneoxy, ethylene glycol, propylene glycol, diethylene glycol, tetraethylene glycol, and tripropylene glycol, and the alkylene group of the alkylene ethere group may have a substitution group such as hydroxyl group, methyl group and ethyl group.

The vinylene group in the X mentioned above is represented by the following chemical formula 12 or 13.

Chemical formula 12

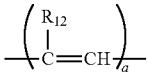

or

Chemical formula 13

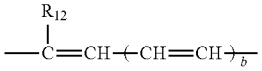

In the chemical formula 12 or 13, $R_{12}$ represents hydrogen or an alkyl group (the same as the alkylene groups defined in (2)) and an aryl group (the same as the aryl group represented by $Ar_3$, and $Ar_4$), and "a" represents 1 or 2 and "b" denotes an integer of from 1 to 3.

Z in the Chemical formulae 9 and 10 represents a substituted or non-substituted alkylene group, a substituted or non-substituted divalent alkylene ether group or a divalent alkyleneoxy carbonyl group.

Specific examples of the alkylene group are the same as the alkylene group specified for X.

Specific examples of the substituted or non-substituted divalent alkylene ether group are the same as the divalent group of the alkylene ether group specified for X.

A specific example of the divalent alkyleneoxy carbonyl group is a divalent caprolactone modified group.

Preferred radical polymerizable compound having a charge transport structure of the present disclosure is represented by the following chemical formula 14.

The radical polymerizable compound having a functional group with a charge transport structure for use in the present invention represented by the chemical formulae 9, I0, or 14 in particular, is polymerized in a manner that both sides of the carbon-carbon double bond are open. Therefore, the radical polymerizable compound does not constitute an end of the structure but is set in a chained polymer. The radical polymerizable compound having a functional group is present in a main chain of a polymer in which cross-linking is formed by polymerization with a radical polymerizable monomer having at least three functional groups or a cross-linking chain between main chains. There are two kinds of the cross-linking chains. One is the cross-linking chain between a polymer and another polymer, and the other is the cross-linking chain formed by cross-linking a portion in the main chain present in a folded state in a polymer with a moiety deriving from a monomer polymerized away from the portion. Regardless of whether or not the radical polymerizable compound having a functional group with a charge transport structure is present in the main chain or in the cross-linking chain, the triaryl amine structure suspends from the chain portion. The triaryl amine structure has at least three aryl groups disposed in the radial directions relative to the nitrogen atom therein. Such a triaryl amine structure is bulky but does not directly joint with the chain portion and suspends from the chain portion via the carbonyl group, etc. That is, the triaryl amine structure is stereoscopically fixed in a flexible state. Therefore, these triaryl amine structures can be adjacent to each other with a moderate space in the polymer. Therefore, the structural distortion in the molecule is slight. In addition, the surface layer of a photoreceptor having such a structure is deduced to have an internal molecular structure with relatively few disconnections in the charge transport route.

Chemical formula 14

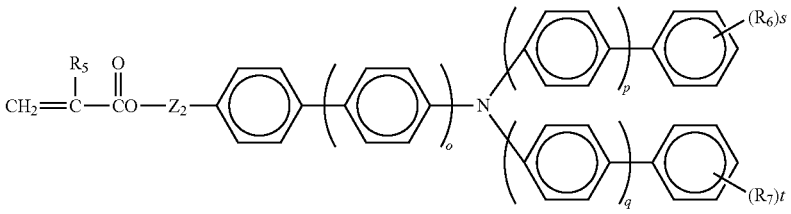

In Chemical formula 14, "o", "p", "q" represent 0 or 1, Ra represents hydrogen atom or methyl group, Rb and Rc are not hydrogen atom and independently represent an alkyl group having 1 to 6 carbon atoms. "s" and "t" represent an integer of from 0 to 3. $Z_2$ represents a single bond, methylene group, ethylene group, compounds represented by Chemical formula 15.

Chemical formula 15

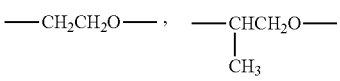

or

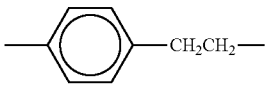

Among the compounds represented by the chemical formula 14 illustrated above, the compounds having methyl group or ethyl group as a substitution group of $R_6$ and $R_7$ are particularly preferred.

In the present disclosure, the particular acrylate compound represented by chemical formula 16 can be suitably used as a radical polymerizable compound having a charge transport structure.

$$B_1—Ar_5—CH=CH—Ar_6—B_2$$ Chemical formula 16

$Ar_5$ is a monovalent or divalent aromatic hydrocarbon skeleton with or without a substitution group.

Specific examples of the aromatic hydrocarbon skeletons include, but are not limited to, benzene, naphtahlene, phenathrene, biphenyl, and 1,2,3,4-tetrahydro naphthalene.

Specific examples of the substitution groups include, but are not limited to, an alkyl group having 1 to 12 carbon atoms, an alkoxy group having 1 to 12 carbon atoms, benzyl group, and a halogen atom.

In addition, the alkyl group and the alkoxy group may have a halogen atom, or a phenyl group as a substitution group.

$Ar_6$ in the chemical formula 16 represents a monovalent or divalent aromatic hydrocarbon skeleton having at least one tertiary amino group, or a monovalent or divalent heterocyclic compound skeleton having at least one tertiary amino group. The aromatic hydrocarbon skeleton having a tertiary amino group is represented by the following chemical formula 17.

Chemical formula 17

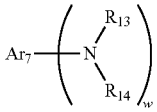

$R_{13}$ and $R_{14}$ independently represent an acyl group, a substituted or non-substituted alkyl group, or a substituted or non-substituted aryl group. $AR_7$ represents aryl group. "w" represents an integer of from 1 to 3.

Specific examples of the acyl groups of $R_{13}$ and $R_{14}$ include, but are not limited to, acetyl group, propionyl group, or benxoyl group.

Specific examples of the substituted or non-substituted alkyl group of $R_{13}$ and $R_{14}$ include, but are not limited to, the alkyl group specified for $Ar_5$ in the chemical formula 16.

Specific examples of the substituted or non-substituted aryl group of $R_{13}$ and $R_{14}$ include, but are not limited to, phenyl group, naphtyl group, biphenyl group, terphenyl group, pyrenyl group, fuluorenyl group, 9,9-dimethyl-2-fluorenyl group, azulenyl group, anthril group, triphenylenyl group, crycenyl group and a group represented by the following chemical formula 18.

Chemical formula 18

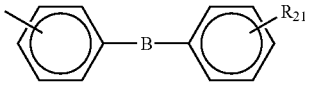

In the chemical formula 18, B is selected from, —O—, —S—, —SO—, —$SO_2$—, —CO—, and the following divalent groups.

Chemical formula 19

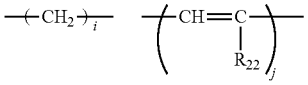

In the Chemical formula 18, $R_{21}$ represents hydrogen atom, a substituted or non-substituted alkyl group defined for $Ar_5$, an alkoxy group, a halogen atom, a substituted or non-substituted aryl group defined for $R_{13}$, amino group, nitro group, or cyano group, $R_{22}$ represents hydrogen atom, a substituted or non-substituted alkyl group defined for $Ar_5$, or a substituted or non-substituted aryl group defined for $R_{13}$. "i" represents an integer of from 1 to 12 and "j" represents an integer of from 1 to 3.

Specific examples of the alkoxy groups of $R_{21}$ include, but are not limited to, methoxy group, ethoxy group, n-propoxy group, i-propoxy group, n-butoxy group, i-butoxy group, s-butoxy group, t-butoxy group, 2-hydroxy ethoxy group, benzyl oxy group, 4-methylbenzyloxy group, and trifluoromethoxy group.

The halogen atoms of $R_{21}$ are fluorine atom, chlorine atom, bromine atom and iodine atom.

Specific examples of the alkoxy groups of $R_{21}$ include, but are not limited to, diphenylamino group, ditolyl amino group, dibenzyl amino group, and 4-methyl benzyl group.

Specific examples of the aryl group of $Ar_7$ in the chemical formula 17 include, but are not limited to, phenyl group, naphtyl group, biphenyl group, terphenyl group, pyrenyl group, fuluorenyl group, 9,9-dimethyl-2-fluorenyl group, azulenyl group, anthril group, triphenylenyl group, and crycenyl group.

$AR_7$, $R_{13}$ and $R_{14}$ may include the alkyl group, the alkoxy group, and/or the halogen atom defined for $Ar_5$ as a substitution group.

Specific examples of the heterocyclic compound skeleton having a tertiary amino group include, but are not limited to, heterocyclic compound having an amino structure such as pyrrole, pyrazole, imidazole, triazonle, dioxazole, indol, isoindol, benz imidazole, benz imidazole, benz triazole, benz isoxazine, carbazole, and phenoxazine.

These can contain the alkyl group, the alkoxy and the halogen atom defined for $Ar_5$ in the chemical formula 16 as a substitution group.

$B_1$ and $B_2$ in the chemical formula 16 represent acryloyloxy group, methacryloyloxy group, vinyl group; an alkyl group having an acryloyloxy group, methacryloyloxy group, or vinyl group; or an alkoxy group having an acryloyloxy group, methacryloyloxy group, or vinyl group.

The same specified for $Ar_5$ are applied to the alkyl group and the alkoxy group.

$B_1$ and $B_2$ are not present at the same time.

In addition to the acrylate compounds represented by the chemical formula 16, the compounds represented by the following chemical formula 20 can be suitably used.

Chemical formula 20

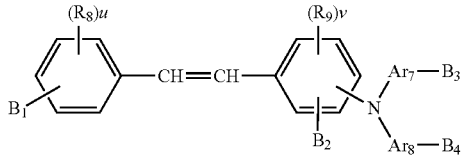

In the Chemical formula 20, $R_8$ and $R_9$ represent a substituted or non-substituted alkyl group, a substituted or non-substituted alkoxy group, or a halogen atom. $Ar_7$ and $Ar_8$ represent a substituted or non-substituted aryl group, an arylene group, or a substituted or non-substituted benzyl group.

The same specified for $Ar_5$ are applied to the alkyl group, the alkoxy group, and the halogen atom.

The aryl group is the same as defined for $R_{13}$ and $R_{14}$ in the Chemical formula 17. The arylene group is a divalent group deriving from its aryl group.

$B_1$ to $B_4$ in the chemical formula 20 are the same as $B_1$, and $B_2$ in the chemical formula 16.

"u" represents an integer of from 0 to 5 and "v" represents an integer of from 0 to 4.

The particular acrylate compound has the following characteristics.

The particular acrylate compound is a tertiary amine compound having a stilbene type conjugation structure.

By using such a charge transport compound having a developed conjugation structure, the charge infusion property at the protection layer interface is excellent and when the compound is fixed between the cross-linking bondings, the intermolecular interaction is hardly prohibited, meaning that the charge mobility is sustained good.

In addition, the particular acrylate compound contains an acryloyloxy group or a methacryloyloxy group having a high radical polymerization property and is quickly gelatinized at radical polymerization without excessive cross-linking distortion.

The double bonding in the stilbene structure in the molecule is partially used in the polymerization. In addition, the polymerization property of the stilbene structure is relatively low in comparison with that of an acryloyloxy group or a methacryloyloxy group, thereby causing the time lag in the cross-linking reaction, which prevents an increase in distortion. Furthermore, the number of cross-linking reaction per molecule increases since the double bonding in the molecule is used. Thus, the cross-linking density is high. Therefore, duration against abrasion is further improved.

In addition, this double bonding can be adjusted with regard to the polymerization degree depending on the cross-linking condition.

Such participation in the cross-linking to the radical polymerization is unique characteristic of the acrylate compound. This does not apply to the structure of the amorphous phenyl stilbene type described above.

Therefore, by using a charge transport compound having a radical polymerizable functional group represented by the chemical formula 16, the chemical formula 20 in particular, good electric characteristics are sustained. In addition, a film (layer) having an extremely high cross-linking density is formed without causing cracking.

With regard to uniformity of the cross-linking structure, the number of the radical polymerizable functional groups is preferably small. With regard to resistance against abrasion, the number of the radical polymerizable functional groups is preferably large. In the present invention, selection of the number of the radical polymerizable functional group should be made taking into consideration the balance between the uniformity and resistance against abrasion.

Specific examples of the radical polymerizable monomer (compound) having a charge transport structure include, but are not limited to, the following compounds.

No. 1

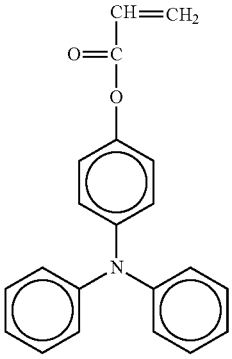

No. 2

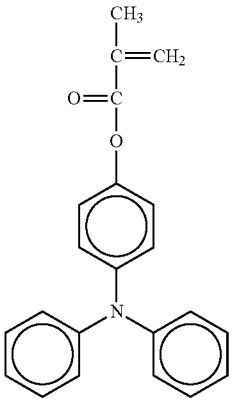

-continued

No. 3

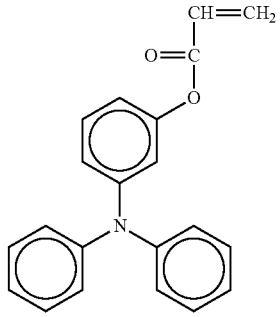

No. 4

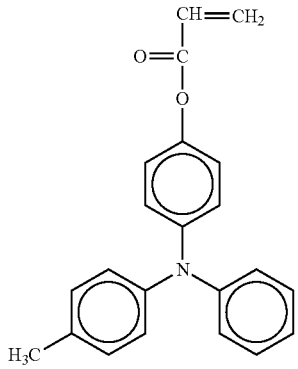

No. 5

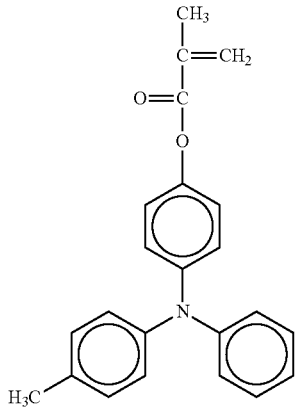

No. 6

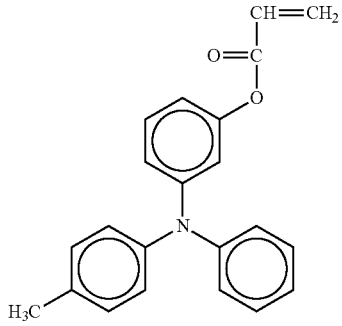

-continued
No. 7
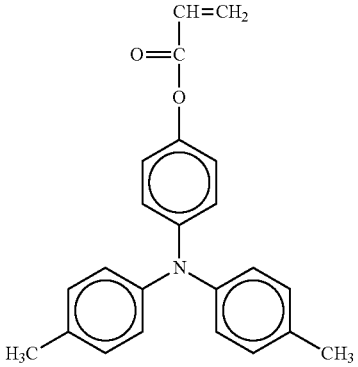
No. 8
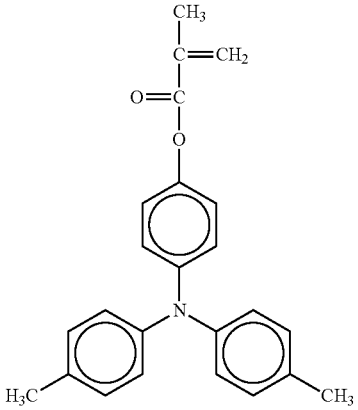
No. 9
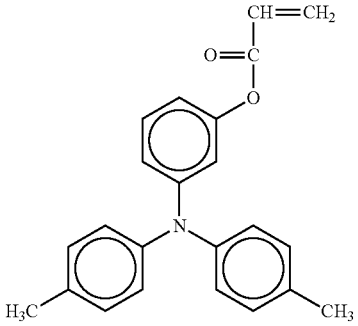
No. 10
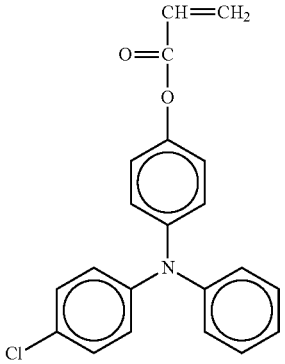
-continued
No. 11
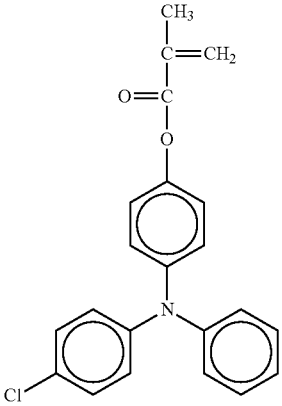
No. 12
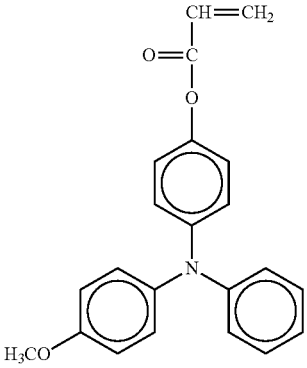
No. 13
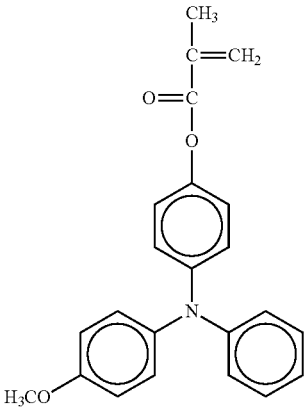
No. 14
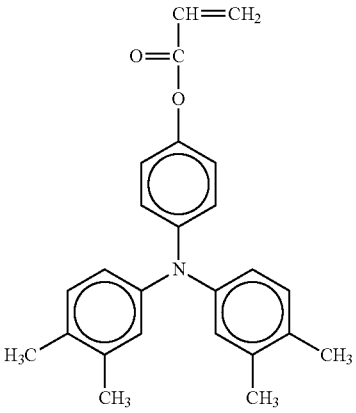

-continued
No. 15
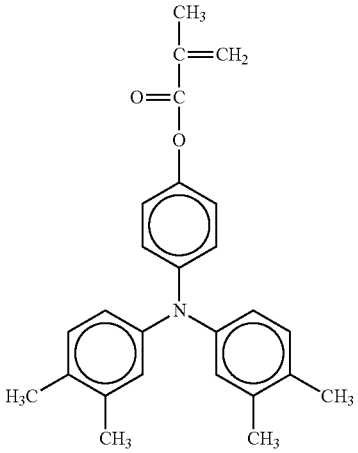
No. 16
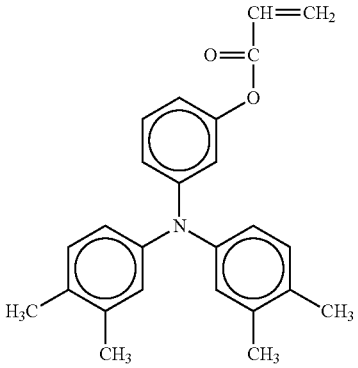
No. 17
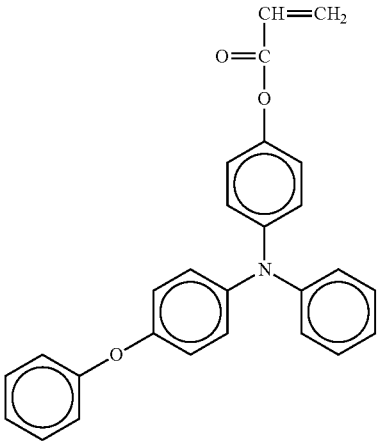
-continued
No. 18
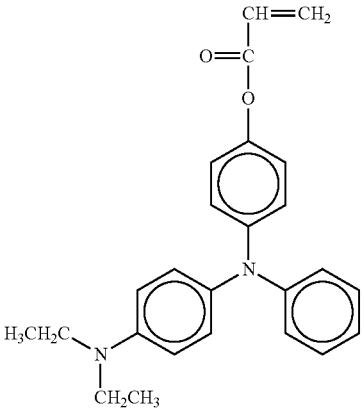
No. 19
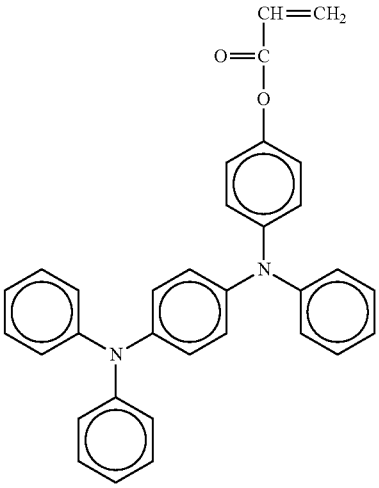
No. 20
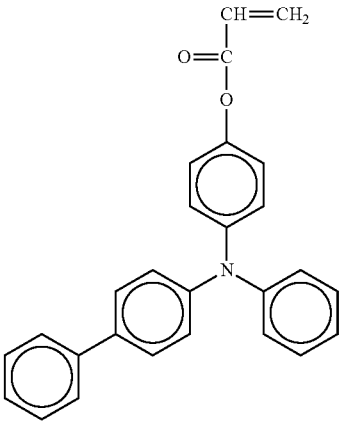

-continued
No. 21
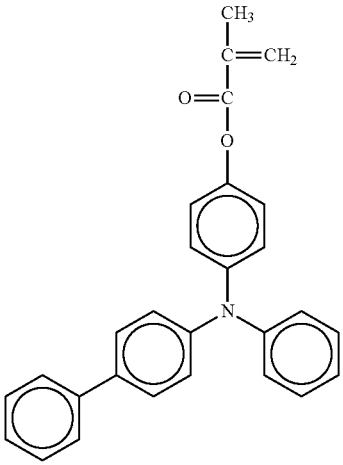
No. 22
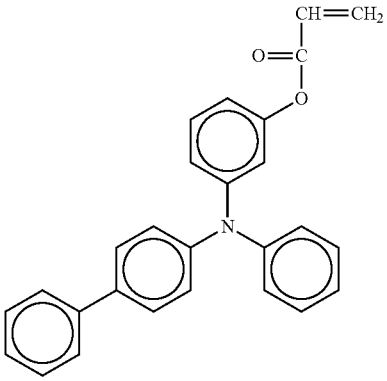
No. 23
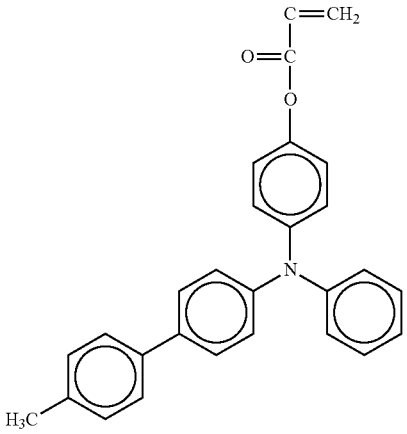
-continued
No. 24
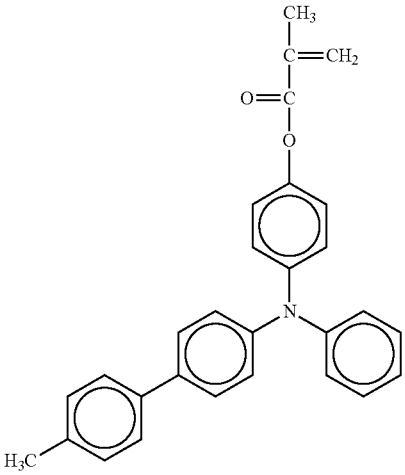
No. 25
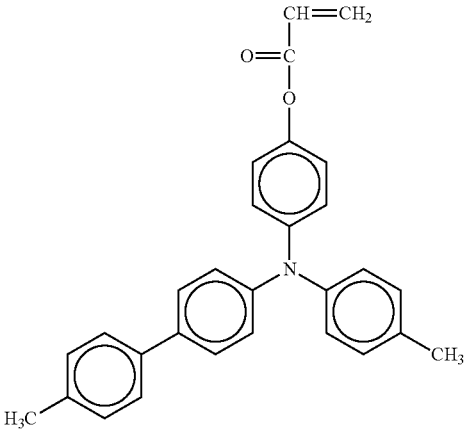
No. 26
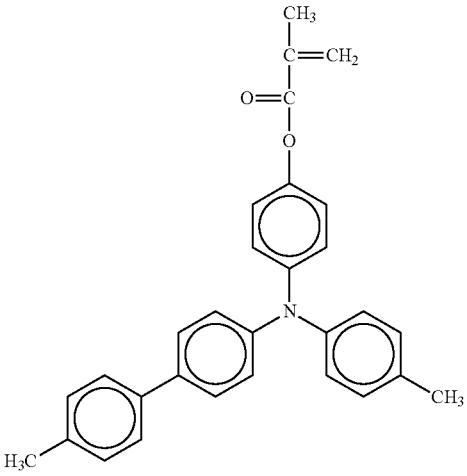

-continued
No. 27
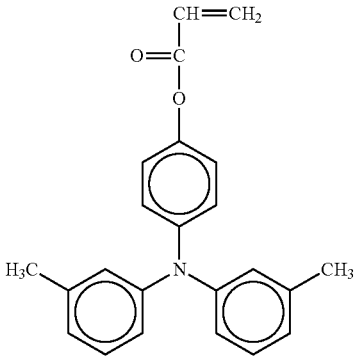
No. 28
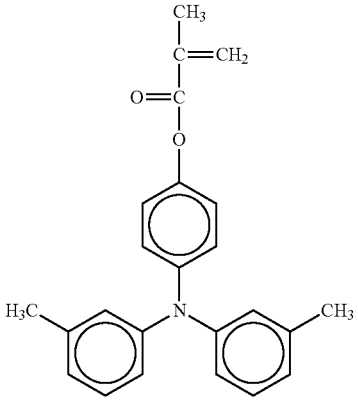
No. 29
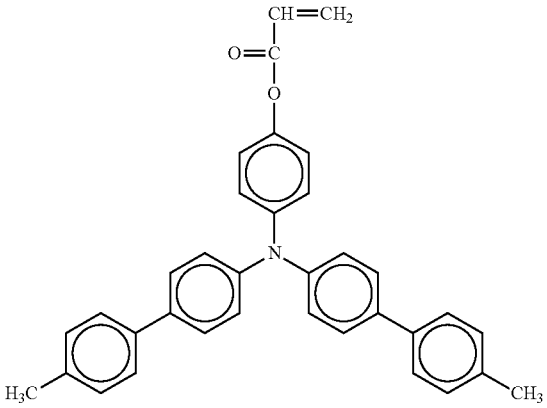
No. 30
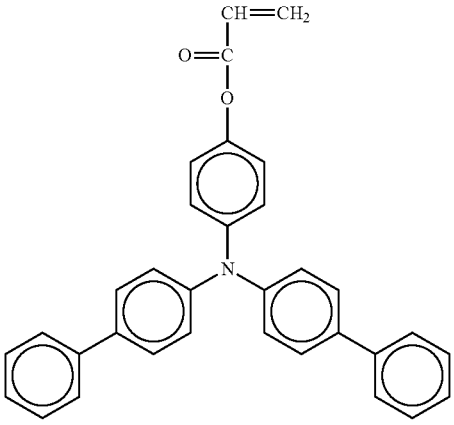
-continued
No. 31
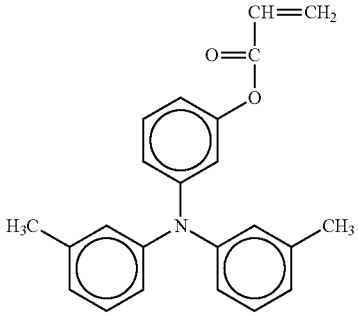
No. 32
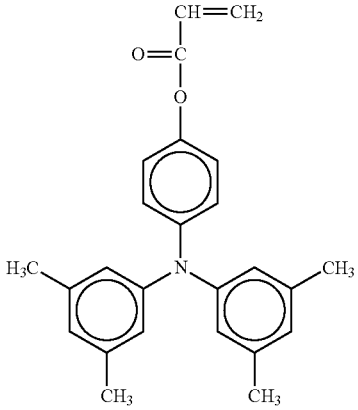
No. 33
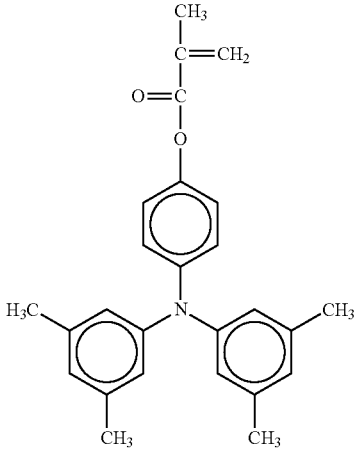
No. 34
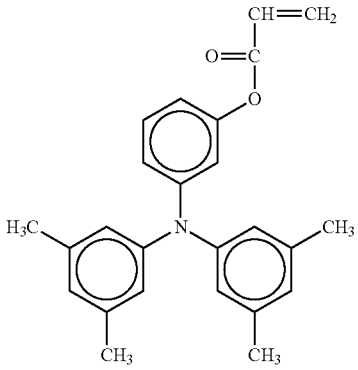

-continued
No. 35
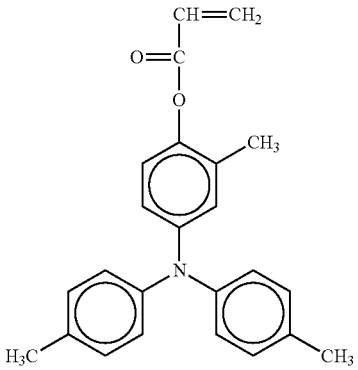
No. 36
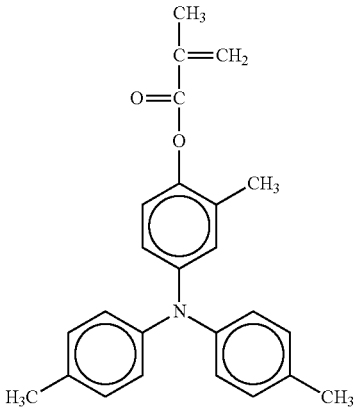
No. 37
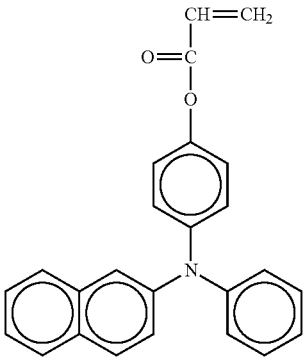
No. 38
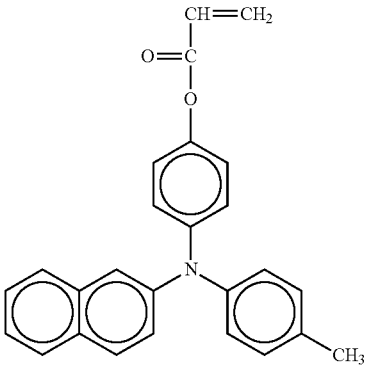
-continued
No. 39
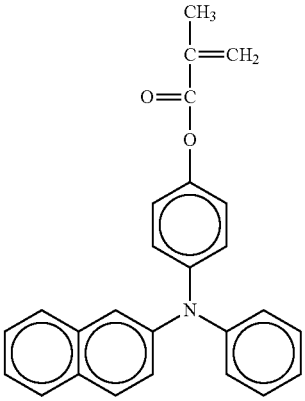
No. 40
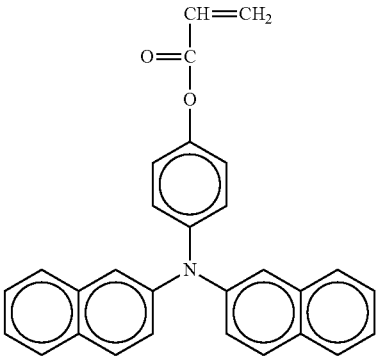
No. 41
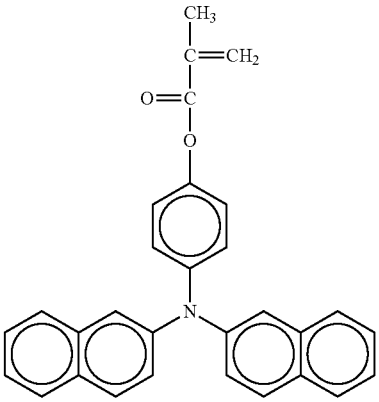
No. 42
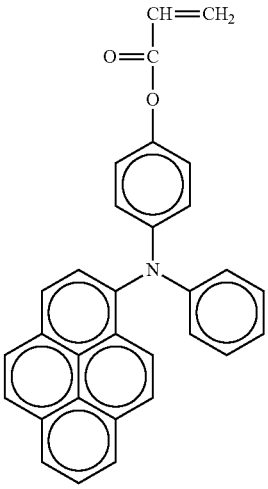

-continued
No. 43
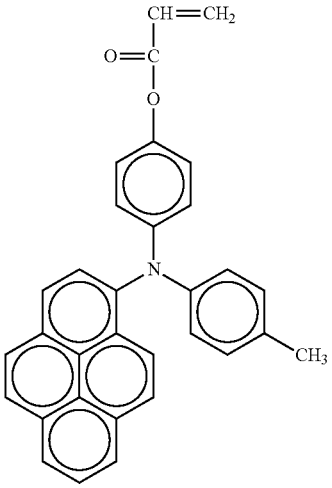
No. 44
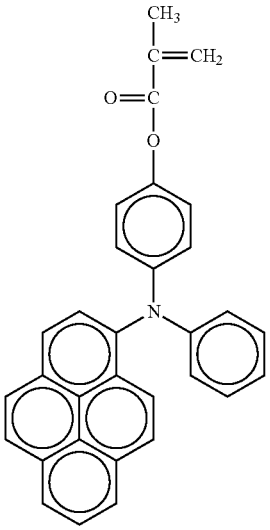
No. 45
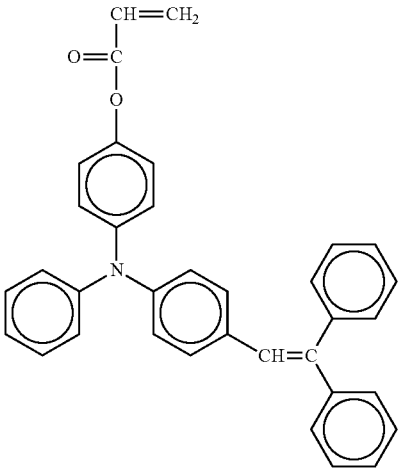
-continued
No. 46
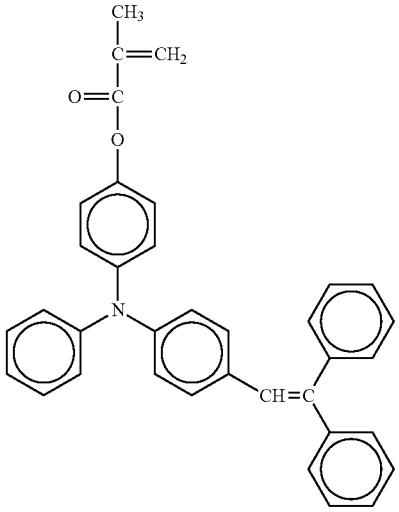
No. 47
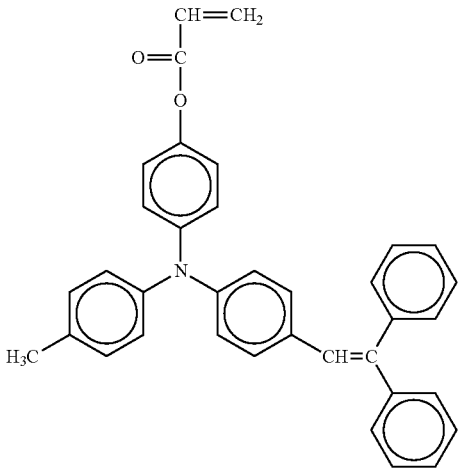
No. 48
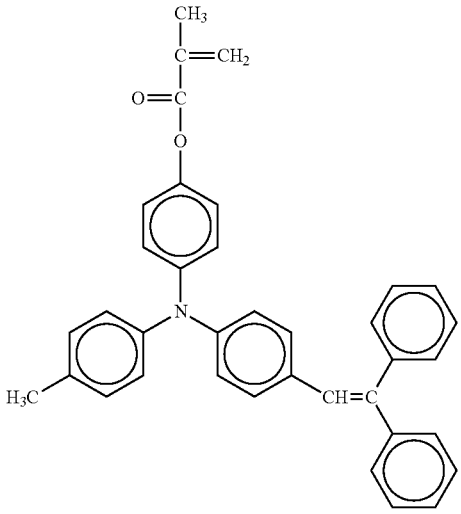

-continued
No. 49
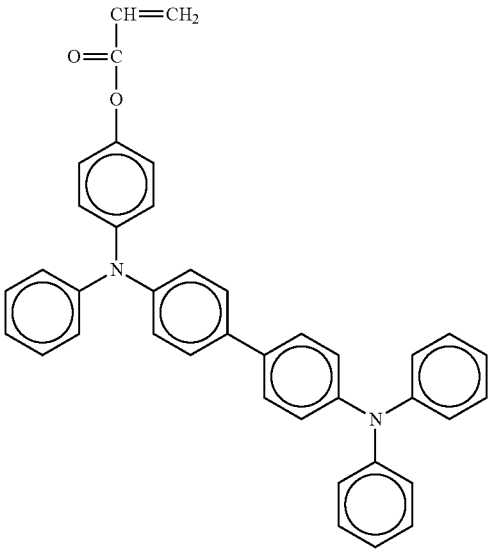
No. 50
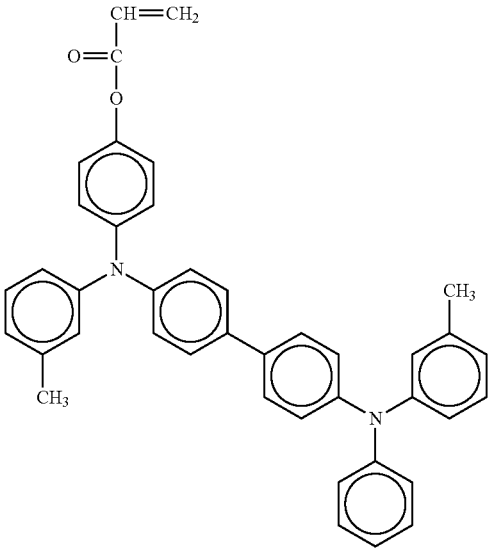
No. 51
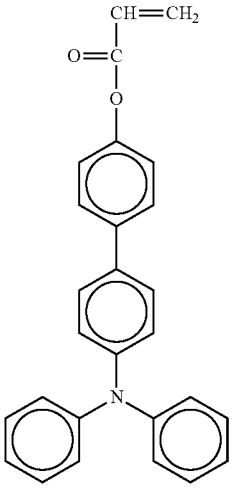
-continued
No. 52
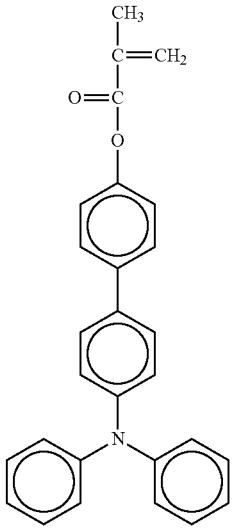
No. 53
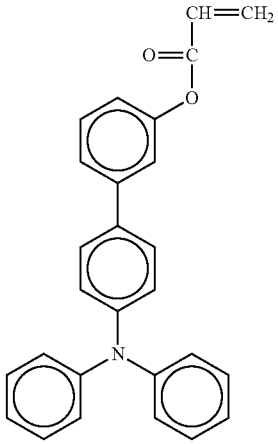
No. 54
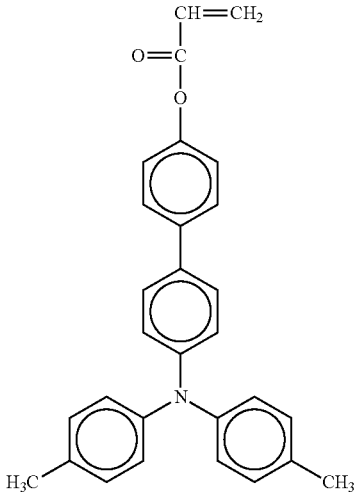

No. 55
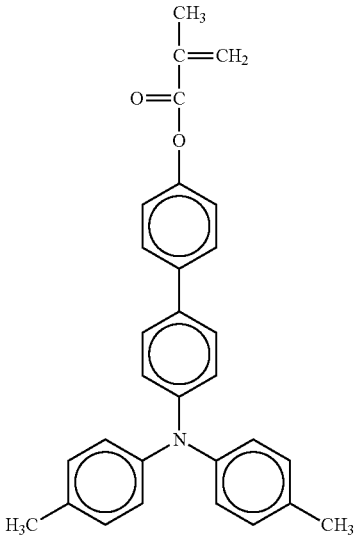
No. 56
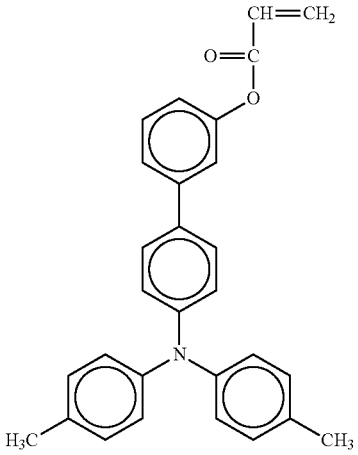
No. 57
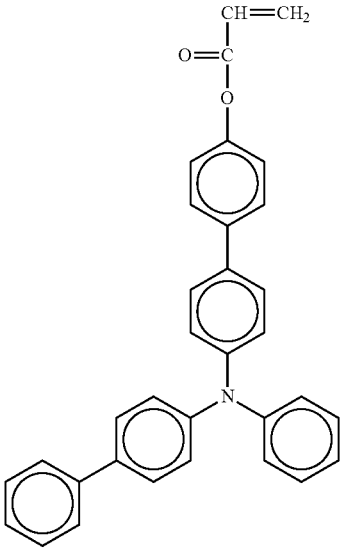
No. 58
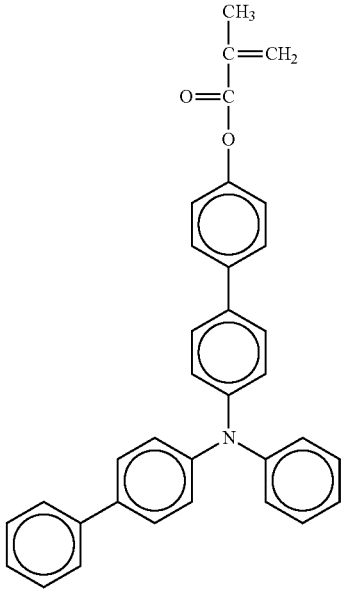
No. 59
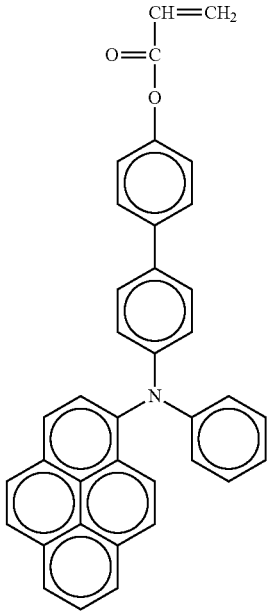

-continued
No. 60
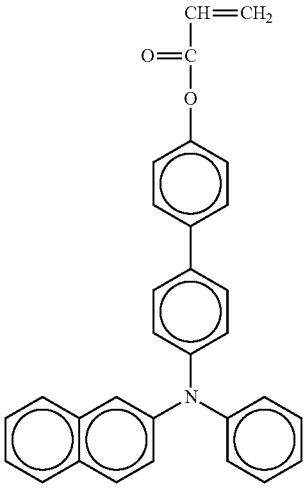
No. 61
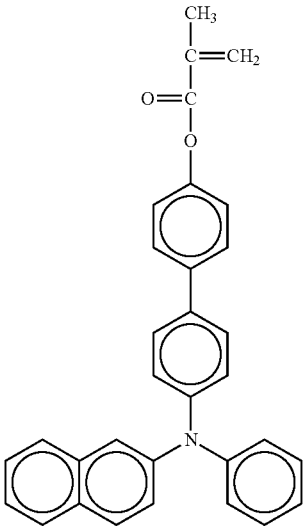
No. 62
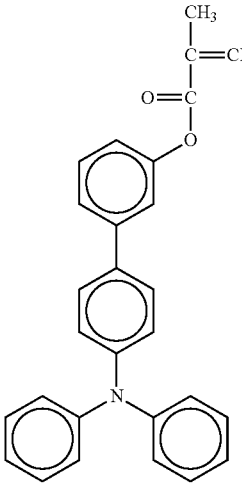
-continued
No. 63
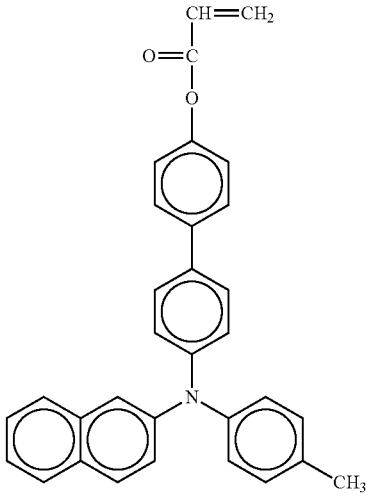
No. 64
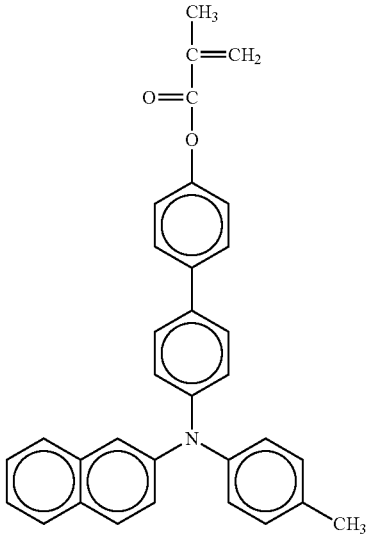
No. 65
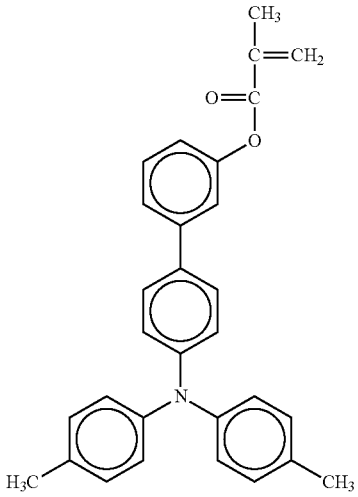

-continued
No. 66
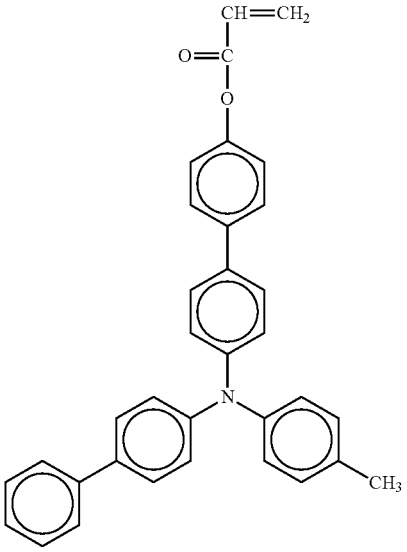
-continued
No. 68
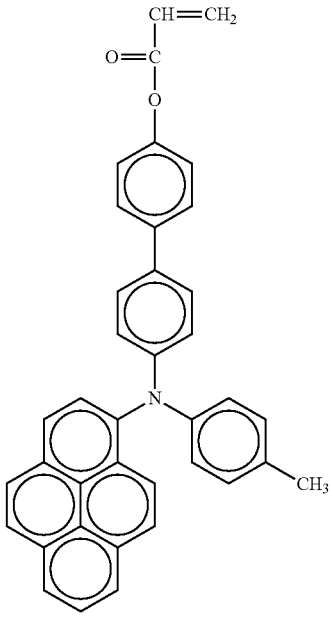
No. 67
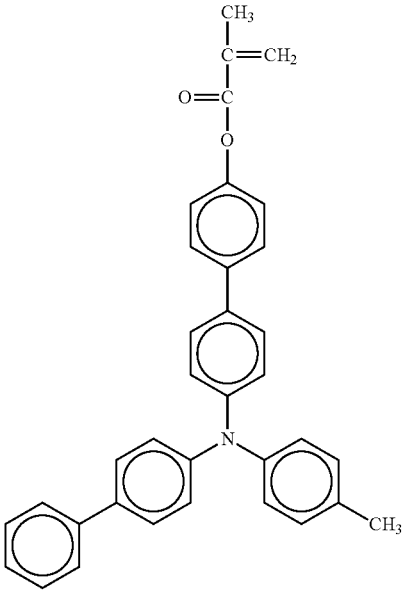
No. 69
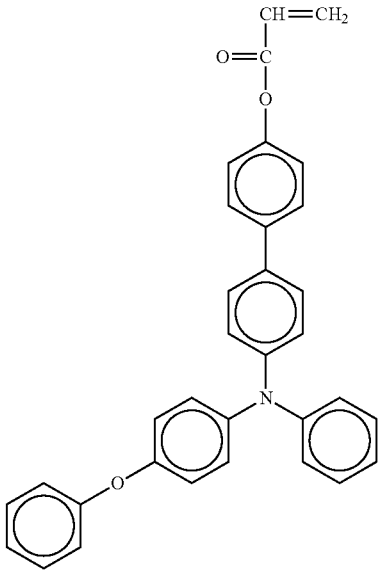

-continued
No. 70
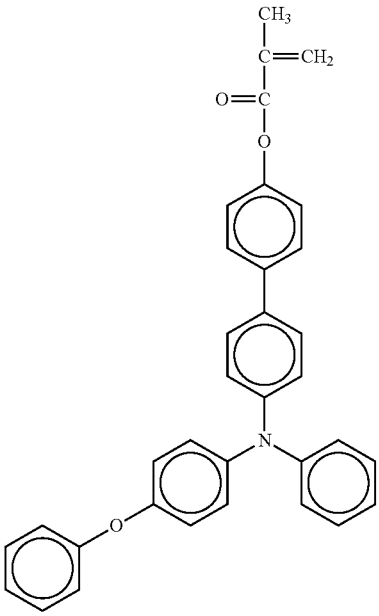
No. 71
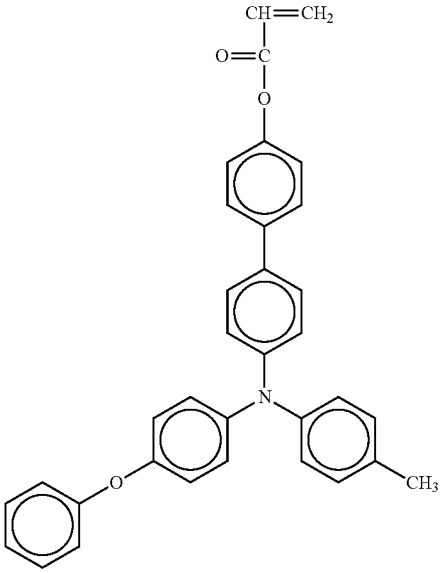
-continued
No. 72
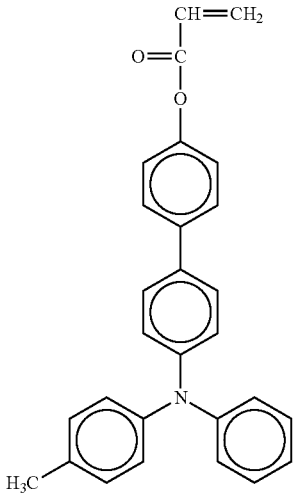
No. 73
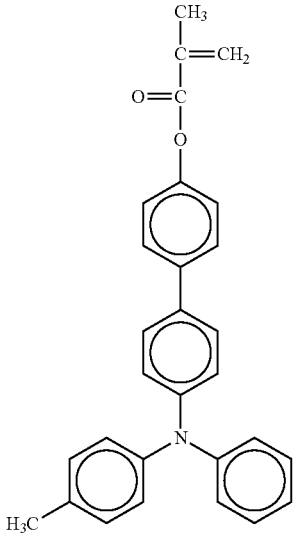
No. 74
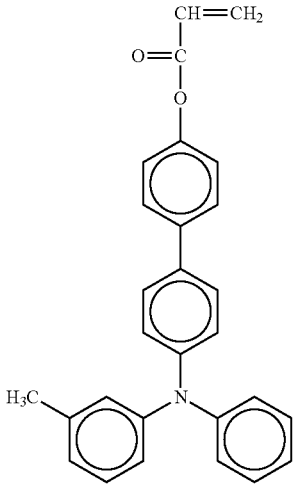

-continued
No. 75
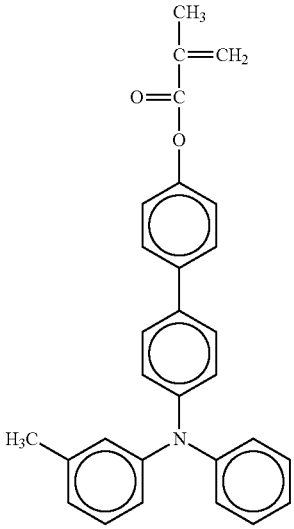
No. 76
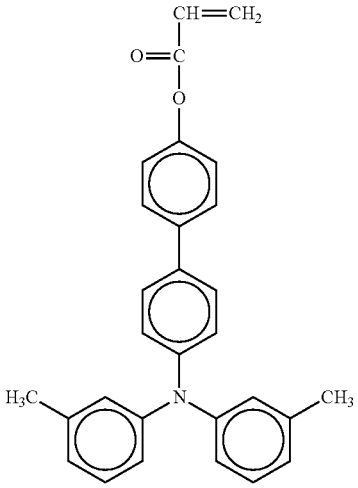
No. 77
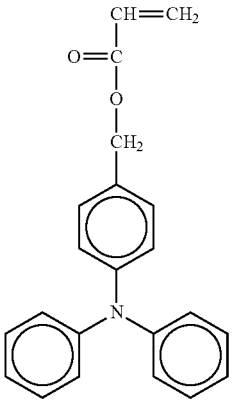
-continued
No. 78
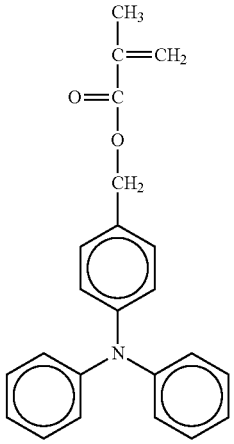
No. 79
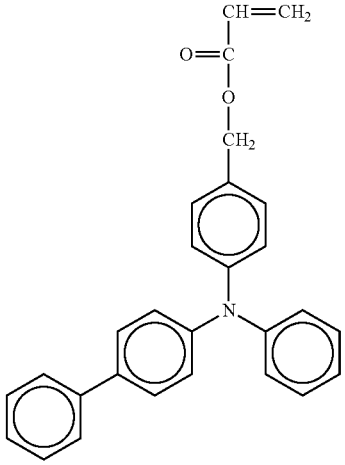
No. 80
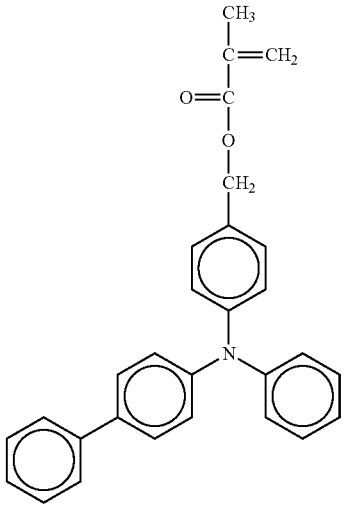

-continued
No. 81
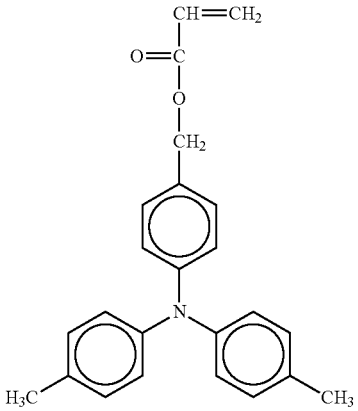
No. 82
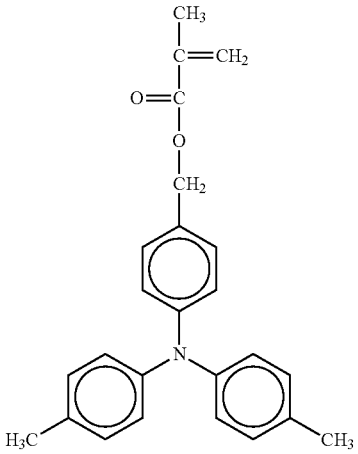
No. 83
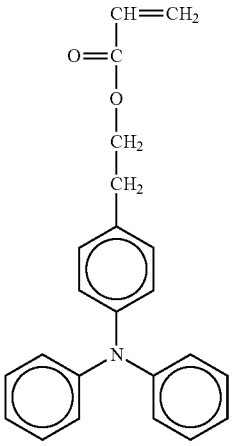
-continued
No. 84
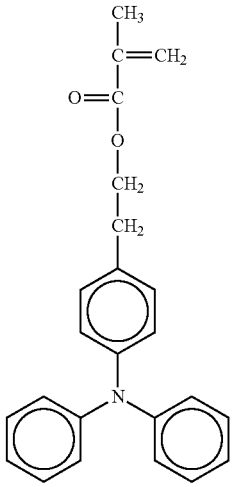
No. 85
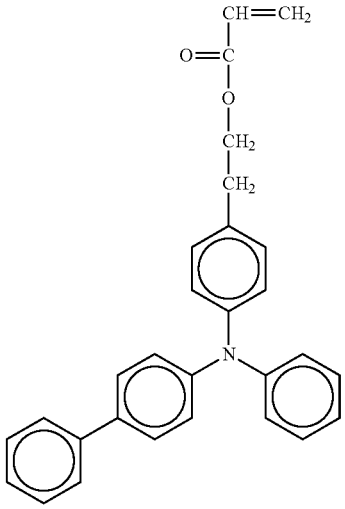
No. 86
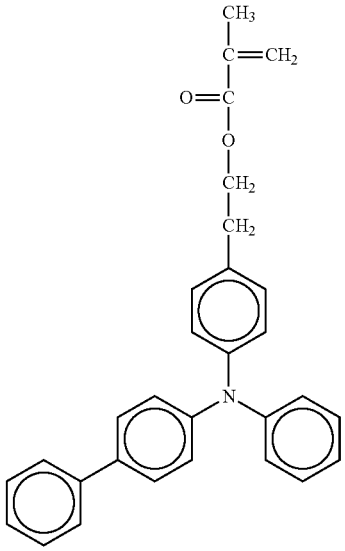

-continued
No. 87
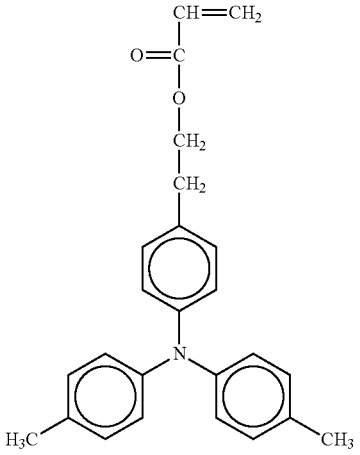
No. 88
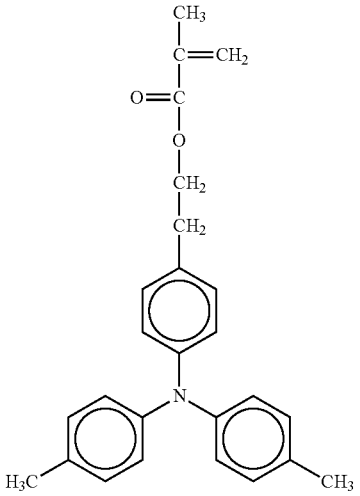
No. 89
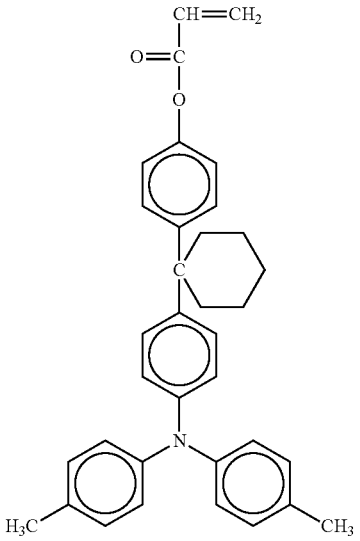
-continued
No. 90
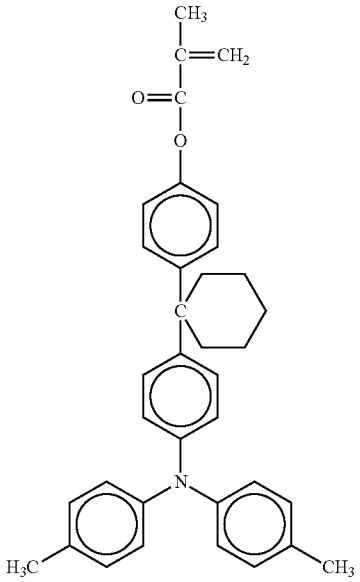
No. 91
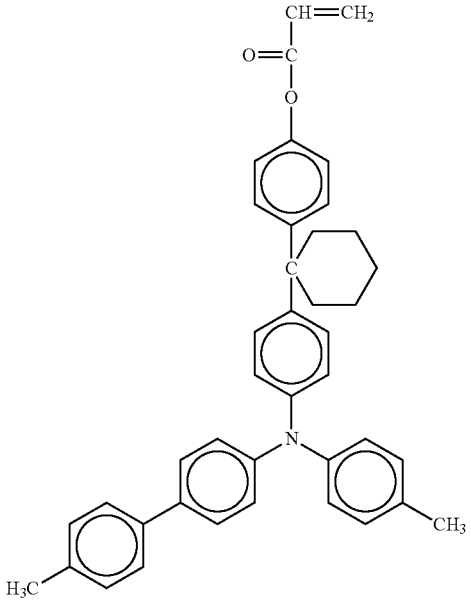

-continued
No. 92
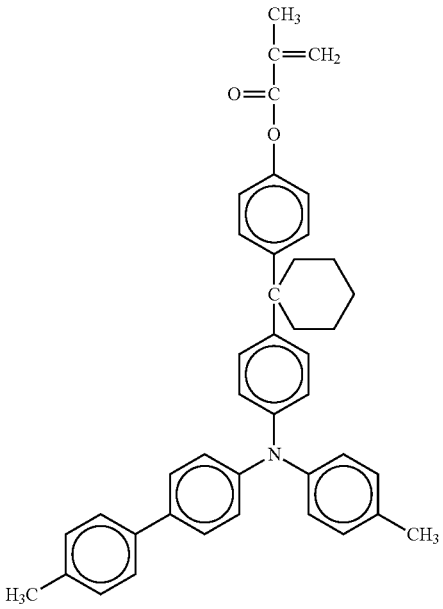
-continued
No. 94
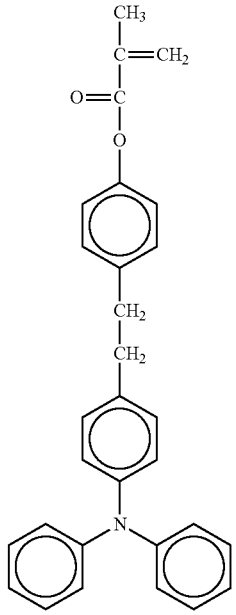
No. 93
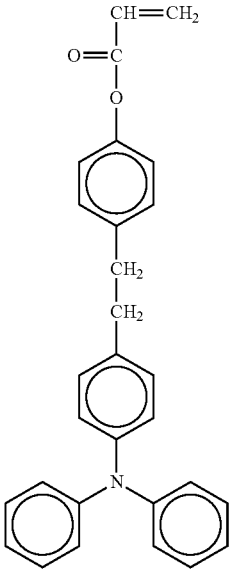
No. 95
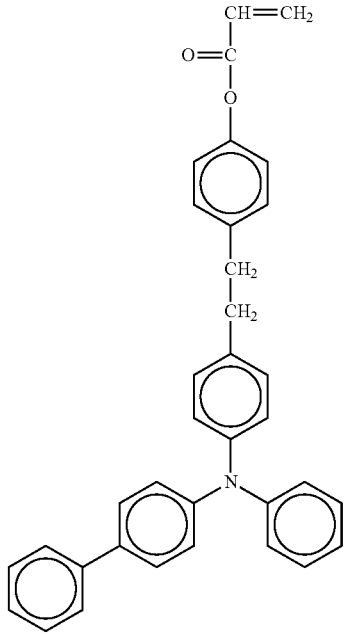

-continued
No. 96
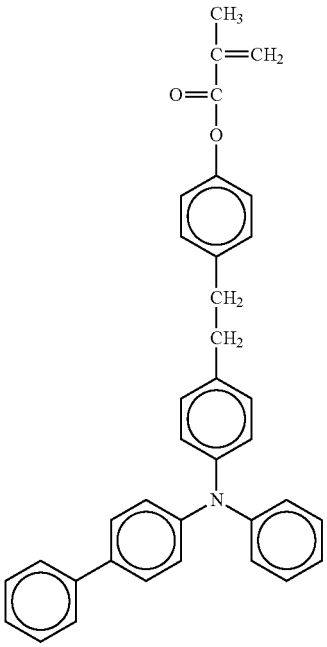
-continued
No. 98
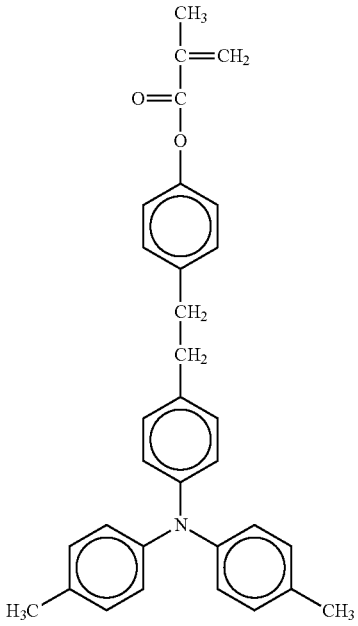
No. 97
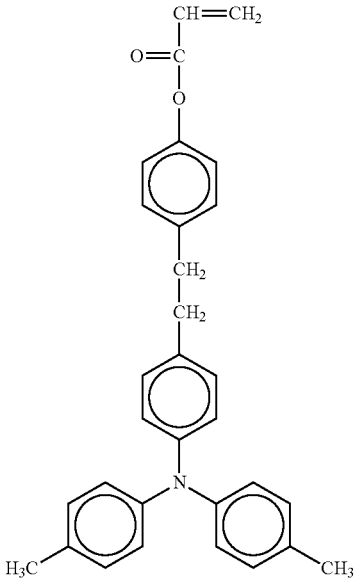
No. 99
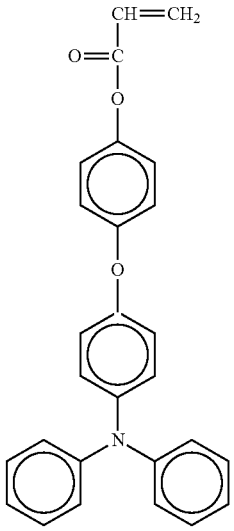

-continued
No. 100
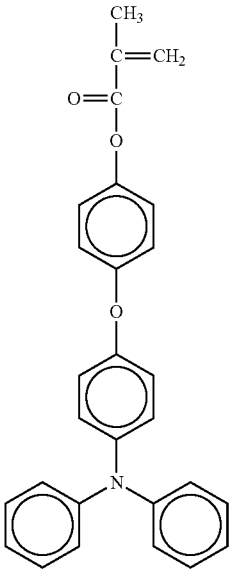
No. 101
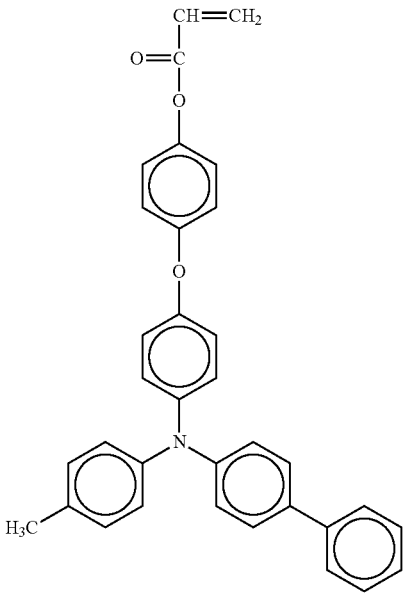
-continued
No. 102
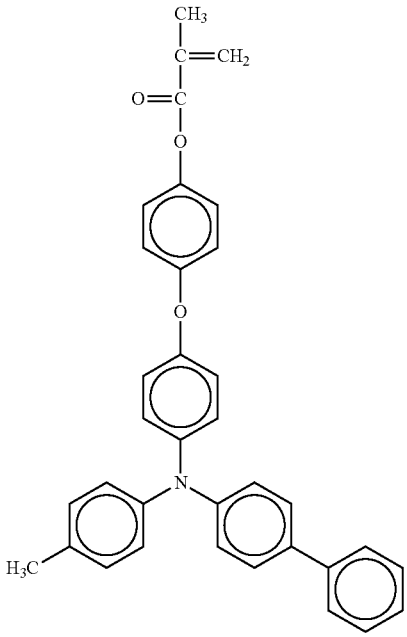
No. 103
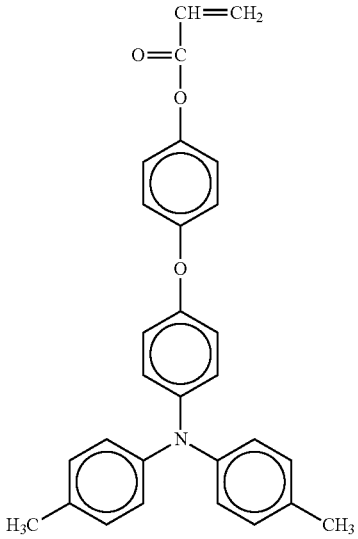

-continued
No. 104
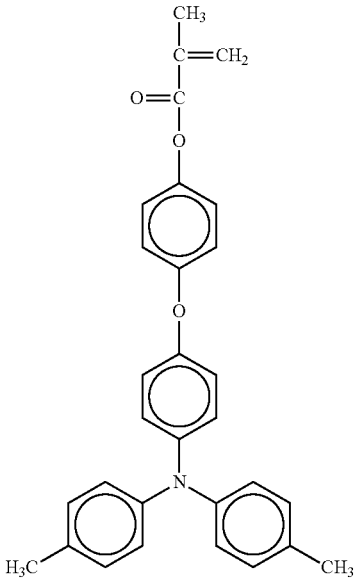
No. 105
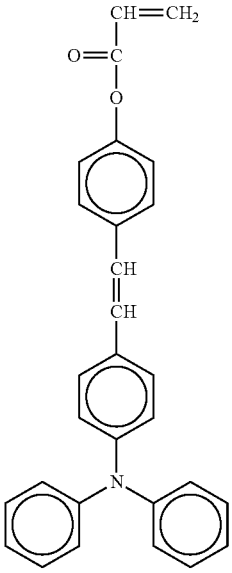
-continued
No. 106
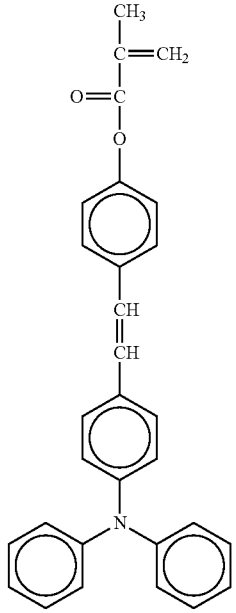
No. 107
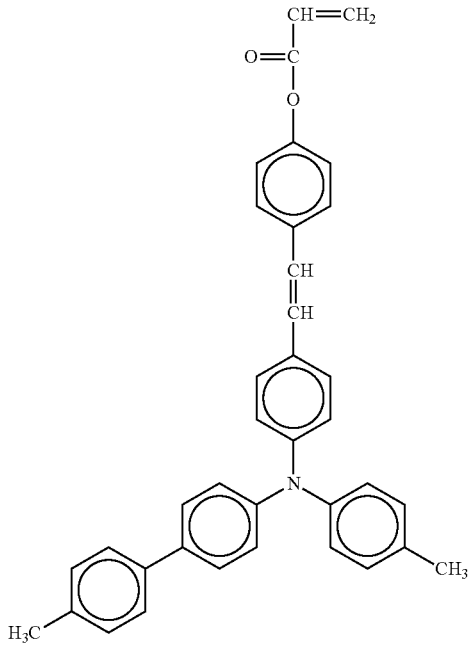

-continued
No. 108
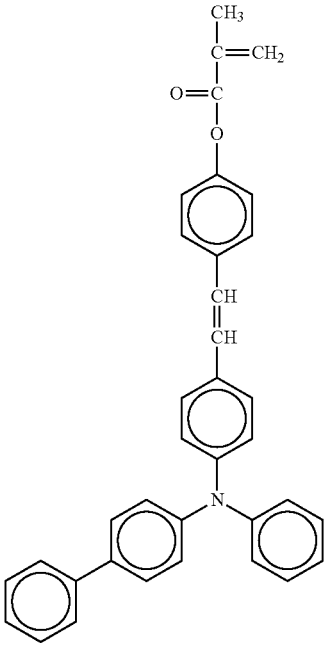
No. 109
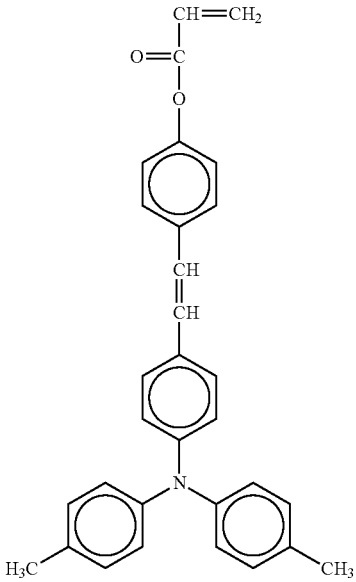
-continued
No. 110
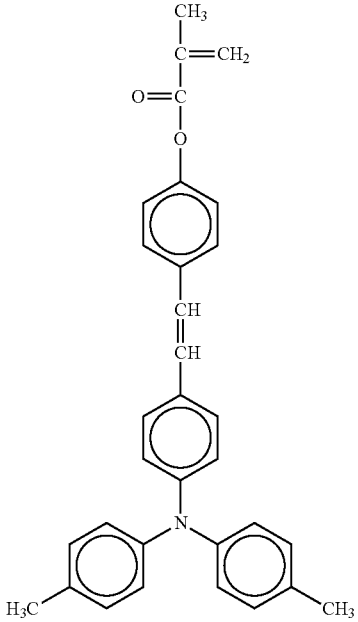
No. 111
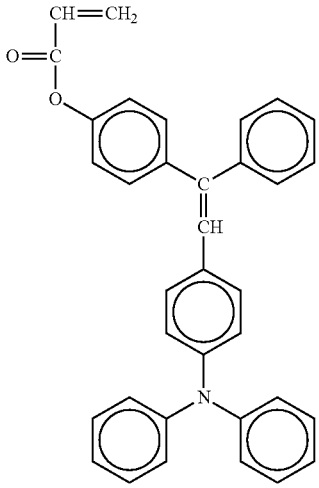
No. 112
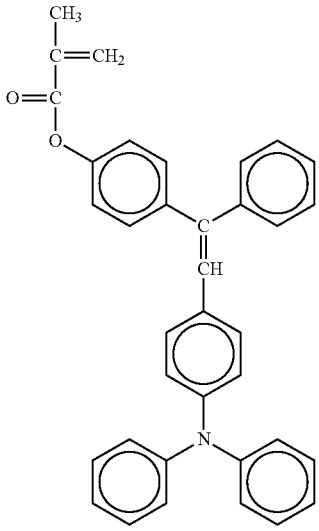

-continued
No. 113
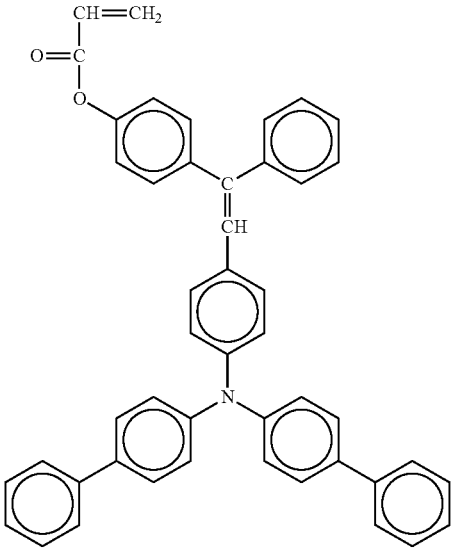
No. 114
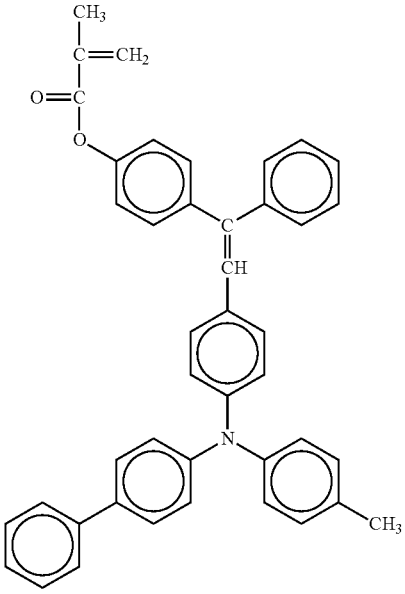
No. 115
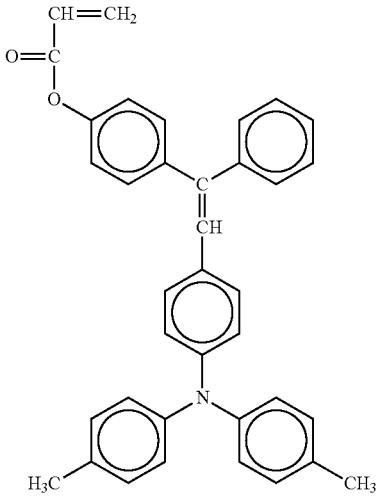
-continued
No. 116
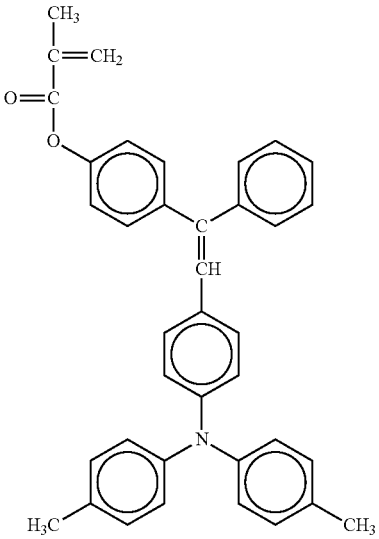
No. 117
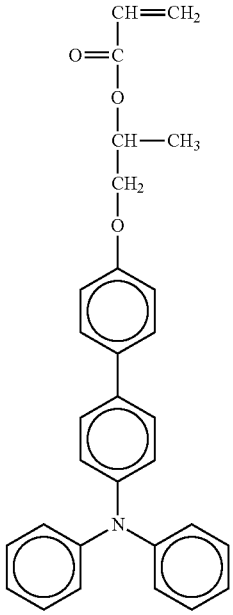

-continued
No. 118
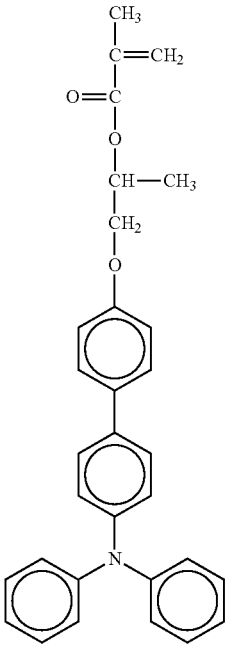
-continued
No. 120
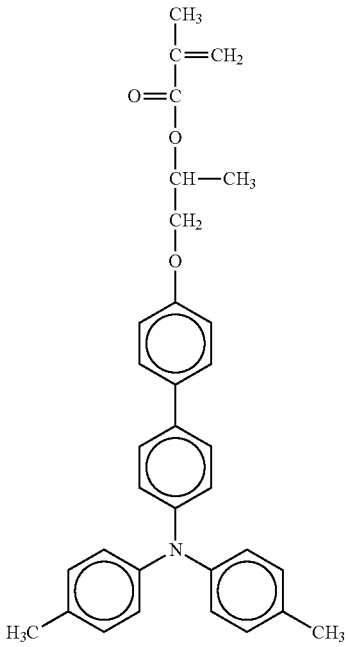
No. 119
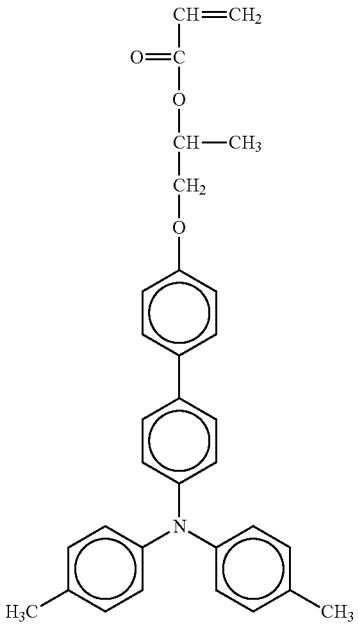
No. 121
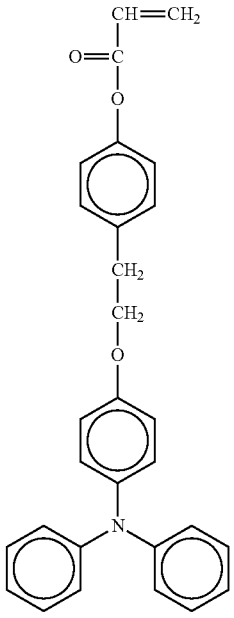

-continued
No. 122
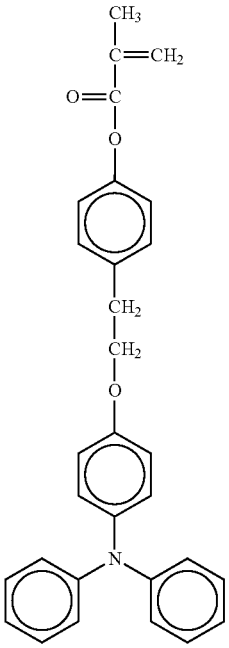
-continued
No. 124
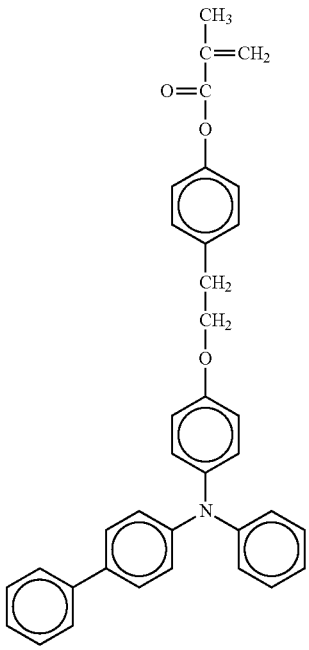
No. 123
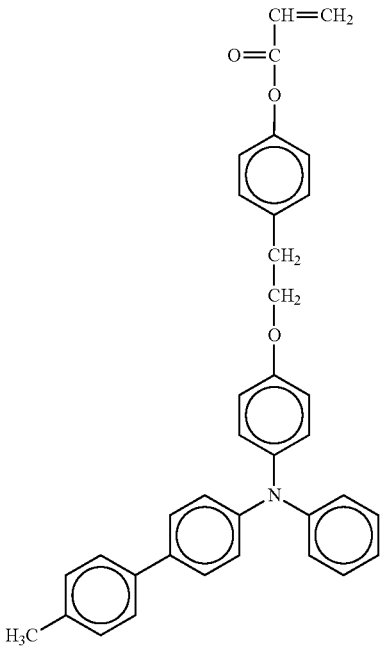
No. 125
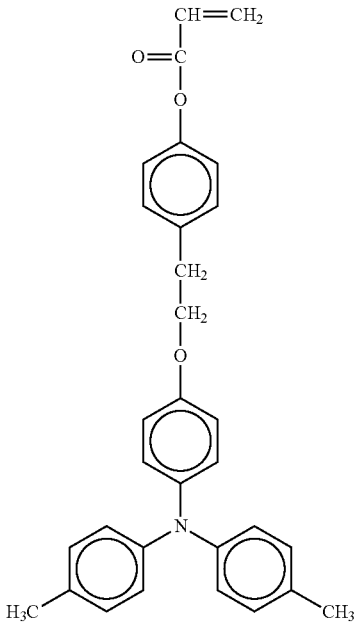

-continued
No. 126
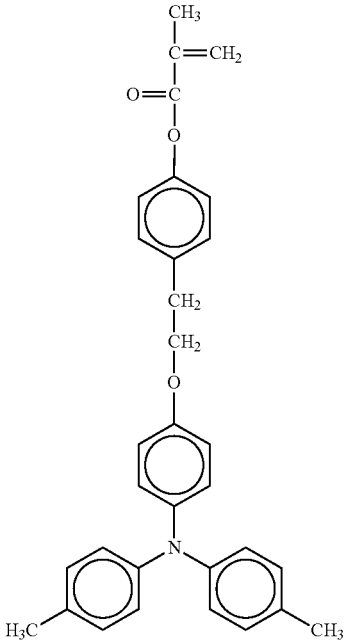
No. 127
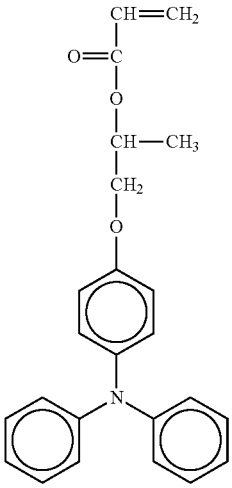
No. 128
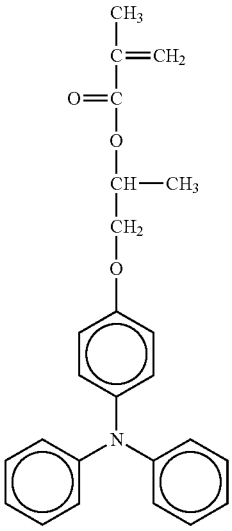
-continued
No. 129
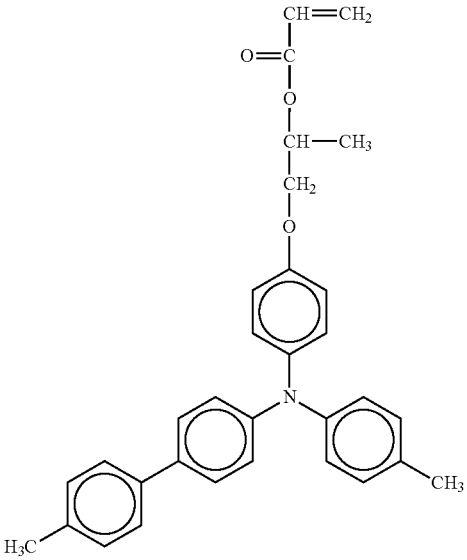
No. 130
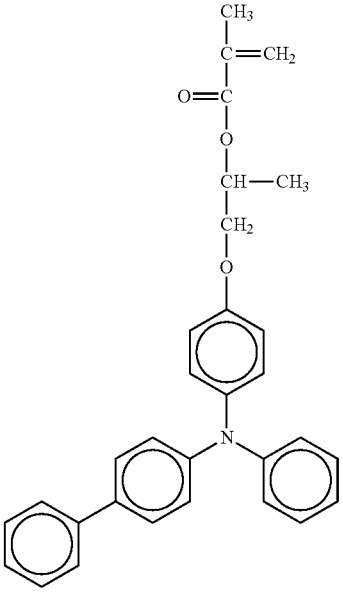
No. 131
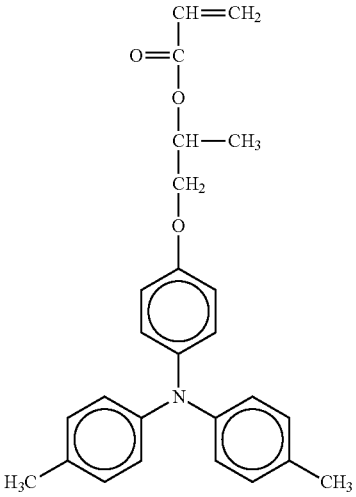

-continued
No. 132
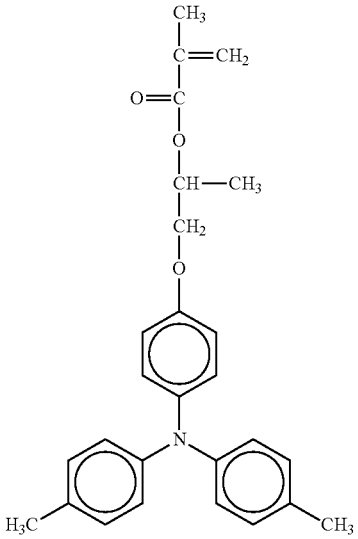
No. 133
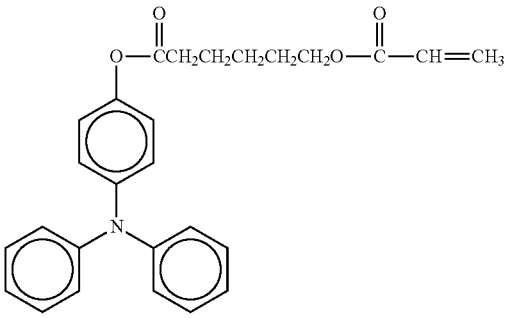
No. 134
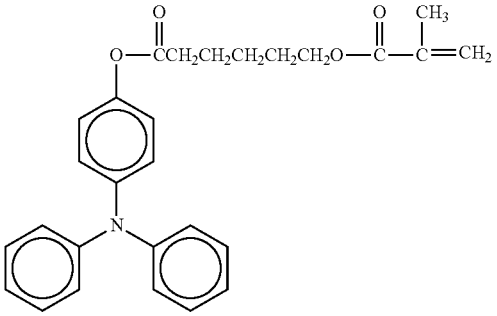
No. 135
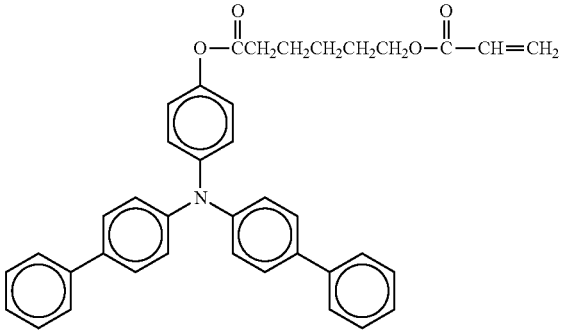
-continued
No. 136
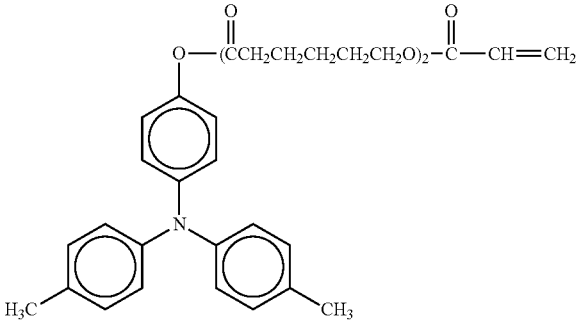
No. 137
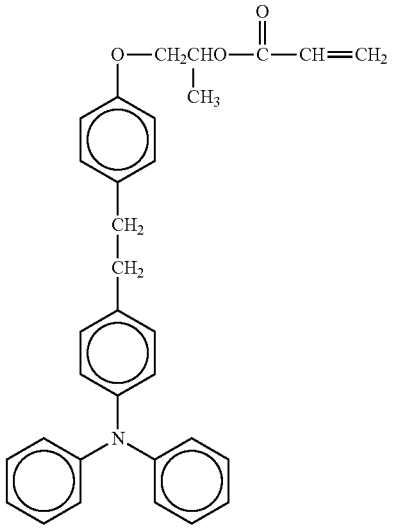
No. 138
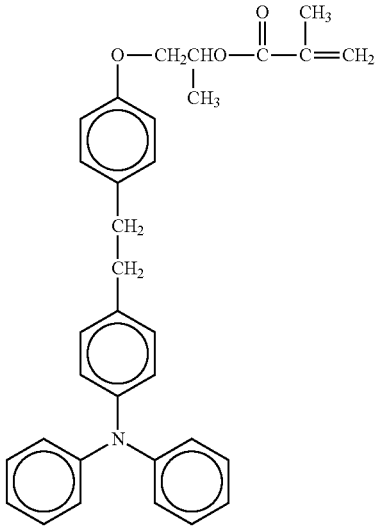

-continued
No. 139
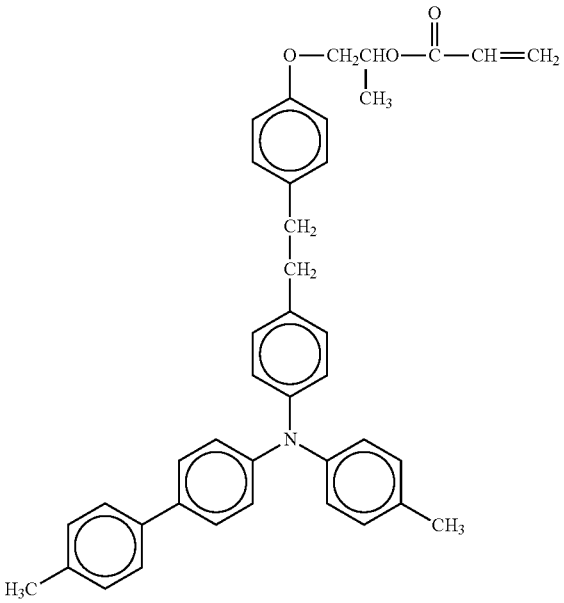
No. 140
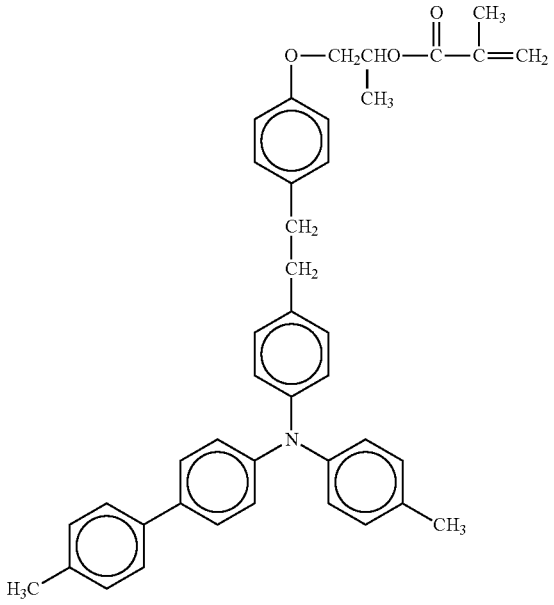
-continued
No. 141
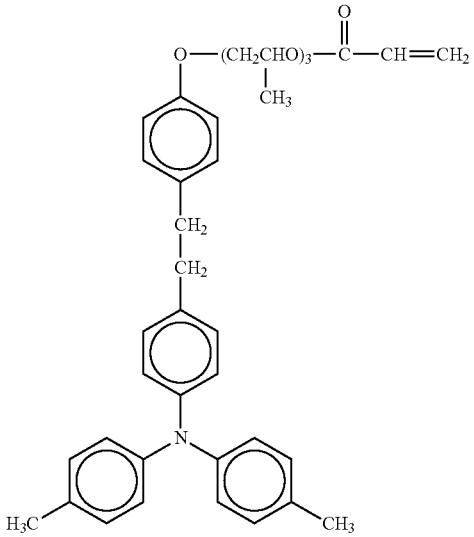
No. 142
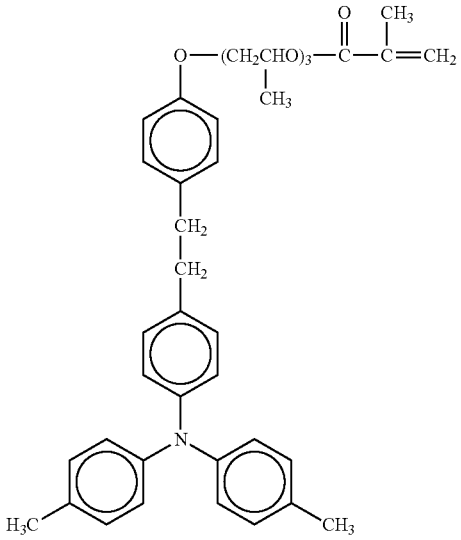
No. 143
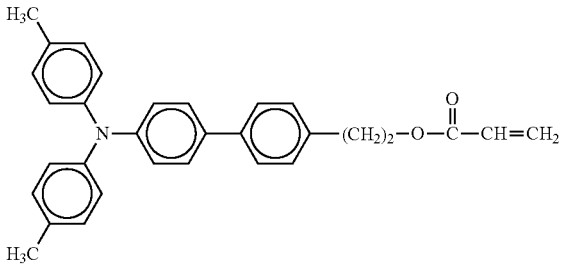

-continued
No. 144
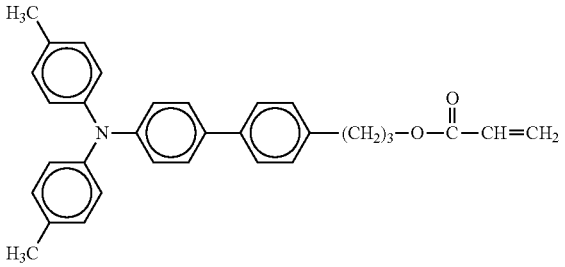
No. 145
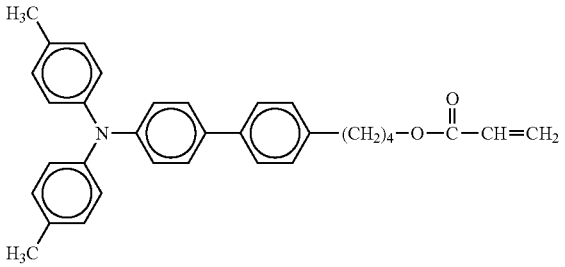
No. 146
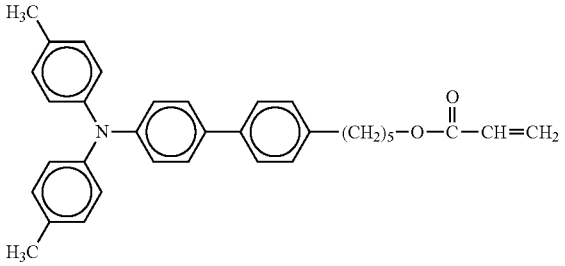
No. 147
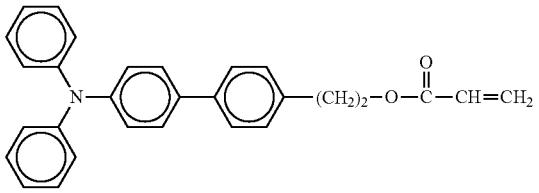
No. 148
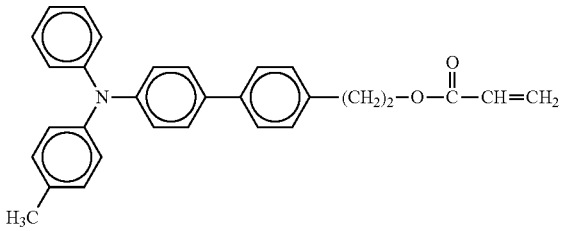
No. 149
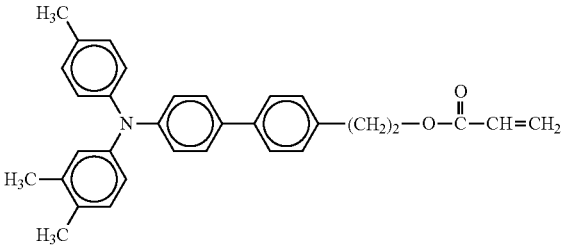
-continued
No. 150
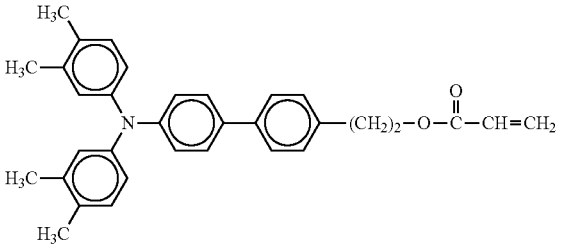
No. 151
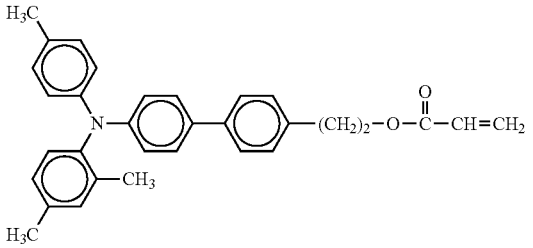
No. 152
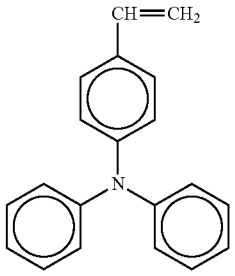
No. 153
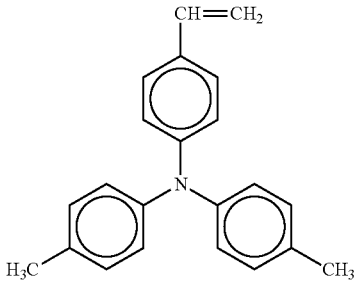
No. 154
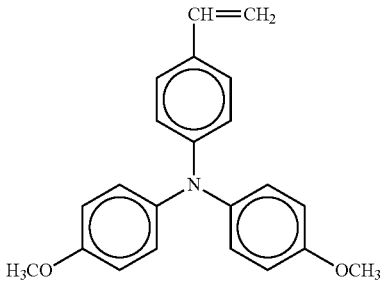

-continued
No. 155
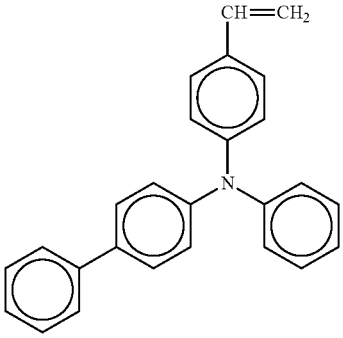
No. 156
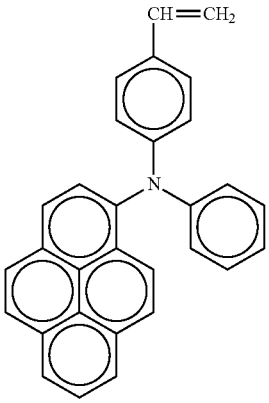
No. 157
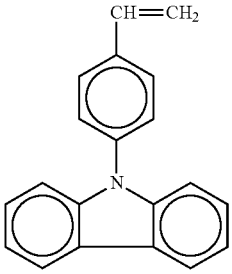
No. 158
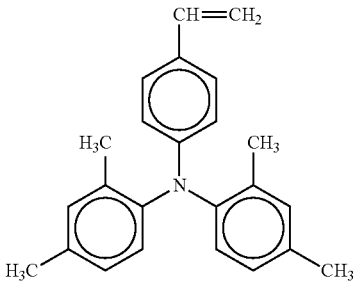
No. 159
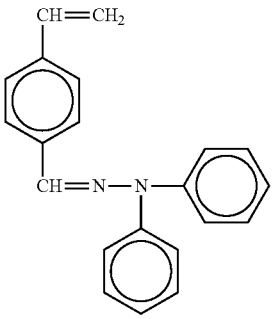
-continued
No. 160
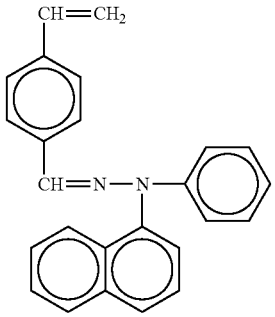
No. 161
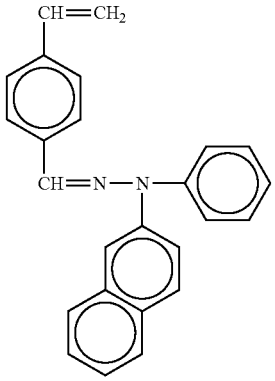
No. 162
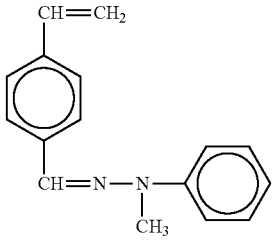
No. 163
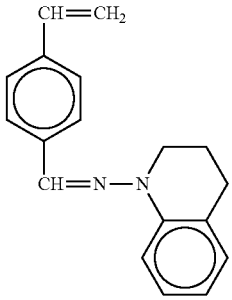
No. 164
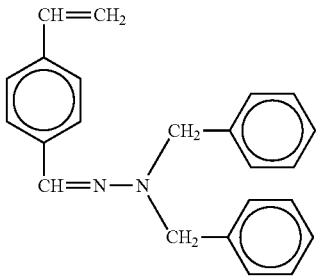

-continued

No. 165

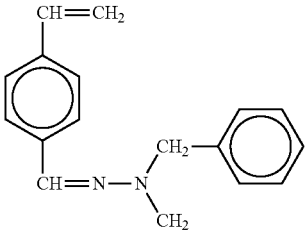

No. 166

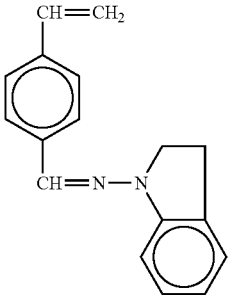

No. 167

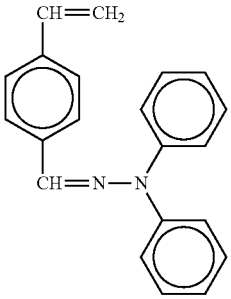

No. 168

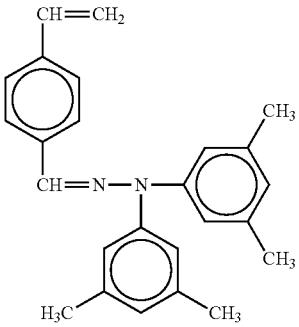

No. 169

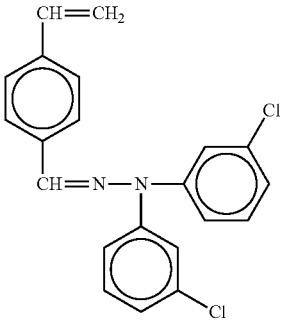

In addition, the radical polymerizable compound having a charge transport structure imparts a charge transport power to the protection layer, and the content ratio of the radical polymerizable compound having a charge transport structure is from 20 to 80% by weight, and preferably from 30 to 70% by weight based on the total weight of the protection layer. A content of the radical polymerizable compound having a charge transport structure that is excessively small tends to make it impossible to sustain the charge transport power of the protection layer, which leads to deterioration of electric characteristics such as sensitivity, and a rise of residual voltage over repetitive use. A content of the radical polymerizable monomer having a charge transport structure that is excessively large causes reduction of the content of a monomer having no charge transport structure. This easily leads to reduction of the cross linking density, which prevents demonstration of a high abrasion resistance.

Desired electrostatic characteristics and abrasion resistance vary depending on the process used. Therefore, it is difficult to jump to any conclusion but considering the balance of both, the range of from 30 to 70% by weight is most preferred.

The protection layer for use in the present disclosure is preferably formed by curing a polymerizable compound having a charge transport structure and a polymerizable compound having no charge transport structure. In addition to these compounds, a radical polymerizable monomer having one or two functional group, a functional monomer, and a radical polymerizable oligomer can be used in combination.

Any known radical polymerizable monomers and oligomers can be used.

Specific examples of such radical polymerizable monomers having one functional group include, but are not limited to, 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymerizable monomers having two functional groups include, but are not limited to, 1,3-butane diol acrylate, 1,4-butane diol acrylate, 1,4-butane diol dimethacrylate, 1,6-hexane diol diacrylate, 1,6-hexane diol dimethaacrylate, diethylene glycol diacrylate, neopentyl glycol diacrylate, bisphenol A-EO modified diacrylate, bisphenol F-EO modified diacrylate, and neopentyl glycol diacrylate.

Specific examples of such functional monomers include, but are not limited to, a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in unexamined published Japanese patent applications Nos. (hereinafter referred to as JPP) H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the polymerizable oligomers include, but are not limited to, an epoxy acrylate based oligomer, a urethane acrylate based oligomer, and a polyester acrylate based oligomer.

When such a radical polymerizable monomer having one or two functional group, and a radical polymerizable oligomer are contained in a large quantity, three-dimensional cross-linking density of the cross-linked surface layer may substantially decrease, thereby weakening the abrasion resistance.

Therefore, the content of such monomers and oligomers is preferably from 50 parts by weight or less and preferably 30 parts or less based on 100 parts by weight of the radical polymerizable monomer having three or more functional groups.

The cross-linked surface layer for use in the present disclosure is formed by applying a liquid application containing a cross-linkable resin monomer followed by polymerization and curing. To efficiently proceed the cross-linking reaction, a polymerization initiator, such as a thermal polymerization initiator, and a photopolymerization initiator is optionally used during coating of the liquid application.

Specific examples of the thermal polymerization initiators include, but are not limited to, a peroxide based initiator such as 2,5-dimethyl hexane-2,5-dihydroperoxide, dicumyl peroxide, benzoyl peroxide, t-butylcumyl peroxide, 2,5-dimethyl-2,5-di(peroxybenzoyl)hexine-3, di-t-butyl beroxide, t-butylhydro beroxide, cumenehydro beroxide, and lauroyl peroxide, and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include, but are not limited to, an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy) phenyl-(2-hydroxy-2-propyl)ketone, 2-benzyl-2-dimethylamino-1-(4-morpholinophenyl)butanone-1,2-hydroxy-2-methyl-1-phenyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator. Specific examples of such compounds include, but are not limited to, triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination. The content of such a polymerization initiator is from 0.5 to 40 parts by weight and preferably from 1 to 20 parts by weight based on 100 parts by weight of the compound having a radical polymerization property.

The filler contained in the protection layer of the present invention is described next. In the present disclosure, the protection layer may include a filler, which is preferable to improve the abrasion resistance, and cleaning performance, and reduce occurrence of filming.

Such improvement is obtained by addition of the filler to the protection layer even when a thermoplastic resin is used as the binder resin for the protection layer. In addition, the abrasion resistance and durability are furthermore improved when the filler is used in combination with the protection layer formed by a curable resin.

Specific examples of the fillers include, but are not limited to, the following:

Specific examples of organic filler materials include, but are not limited to, fluorine containing powder such as polytetrafluoroethylene, silicone resin powder, and carbon particulates.

The carbon articulates means particles having a structure mainly formed of carbon.

These are, for example, carbon having a structure of amorphous, diamond, graphite, patternless carbon, fullerene, Zeppelin, carbon nanotube, and carbon nanohorn.

Among these structures, particles having a diamond carbon structure containing hydrogen, or an amorphous carbon are suitable in terms of mechanical and chemical strength.

The diamond carbon structure containing hydrogen or amorphous carbon film are particles in which similar structures such as a diamond structure having sp3 orbit, a graphite structure having sp2 orbit, and amorphous carbon structure are mixed.

The diamond carbon or amorphous carbon particulates may contain other elements such as hydrogen, oxygen, nitrogen, fluorine, boron, phosphorous, chlorine, bromine, and iodine other than carbon.

Specific examples of the inorganic filler materials include, but are not limited to, powders of metals such as copper, tin, aluminum and indium; metal oxides such as silica, tin oxide, zinc oxide, titanium oxide, alumina, zirconia, indium oxide, antimony oxide, bismuth oxide; and inorganic materials such as potassium titanate, and boron nitride.

In terms of the hardness of a filler, the inorganic fillers are preferred.

In particular, metal oxides are preferable and among these, silica, titanium oxide and alumina are more preferable.

In addition, particulates of colloidal silica and colloidal alumina are also suitably used.

A filler that hardly causes image blur is preferable and is the one having a high specific resistance.

When an electrocondcutive filler is contained in the protection layer of an image bearing member, the charge moves horizontally if the resistance of the surface decreases, which causes image blur.

Particularly, a filler having a specific resistance of $10^{10}\Omega\cdot$cm or higher is preferable in terms of resolution. Specific examples thereof include, but are not limited to, alumina, zirconia, titanium oxide.

Among these, α-type alumina is highly light transmissive, and stable against heat, while having a hexagonal close-packed structure excellent for abrasion resistance and thus preferable to prevent the occurrence of image blur, and improve abrasion resistance, the quality of applied film, and light transmissiveness.

In addition, these fillers can be used alone or in combination, thereby controlling the surface resistance.

The specific resistance of the filler can be measured by, for example, using a resistance measuring instrument for powder.

Specific measuring processes are as follows: place metal oxide powder in a cell and pinch it with electrodes; adjust the amount of the metal oxide by load such that the metal oxide has a thickness of about 2 mm; apply a voltage between the electrodes; and measure the current to obtain the specific resistance of the metal oxide powder.

Furthermore, these fillers can be subject to a surface treatment using at least one kind of surface active agents, which is good for improvement in the dispersion property of the filler.

If the dispersion property of the filler deteriorates, the voltage at irradiated portions rises, transparency of the film deteriorates while causing film defect. Furthermore, the abrasion resistance may be degraded. Therefore, deterioration of the dispersion property may lead to a serious problem such as prevention of high durability and output of quality images.

Any known surface active agents can be used.

The average primary particle diameter of the filler is preferably from 0.01 to 1.0 μm and more preferably from 0.1 to 0.5 μm in terms of the light transmissiveness, or abrasion resistance.

When the average primary particle diameter of the filler is too small, the filler tends to agglomerate and the abrasion resistance tends to worsen. In addition, the surface area of the filler increases, thereby raising the voltage of the irradiated portion.

In addition, when the average primary particle diameter of the filler is too large, settling of the filler is easily accelerated, and due to the agglomeration of the filler, the image quality tends to deteriorate and abnormal images easily are produced.

In addition, the addition amount of the filler is preferably from 0.1 to 50% by weight, more preferably from 3 to 30% by weight, and furthermore preferably from 5 to 20% by weight based on all the solid portion contained in the protection layer.

When the addition amount of the filler is too small, obtained abrasion resistance may not be satisfactory. An addition amount of the filler that is too large tends to raise the residual voltage at the irradiated portion, reduce the resolution, and degrade the image quality.

Particularly, when a curable resin is used in the protection layer, the filler tends to inhibit curing reaction. Therefore, an excessive addition of the filler should be avoided.

The filler contained in the protection layer contributes to improve the abrasion resistance, but may have an impact on the rise in the voltage at the irradiated portion.

This is ascribable to the fact that the surface of the filler contains trap sites of charges. Particularly, this has a large impact when a metal oxide is hydrophilic.

A dispersant having an acid value is suitably added to limit this rise in the voltage at the irradiated portion.

The acid value is defined by a number of mg of potassium hydroxide required to neutralize carboxyl group contained in 1 g of a resin. The dispersant having an acid value is absorbed to the surface of a filler, particularly a hydrophilic metal oxide, and expected to fill the trap site that causes a rise of the residual voltage. Therefore, the rise in the voltage at the irradiated portion is limited and the dispersion property of the filler is improved even when a hydrophilic filler is contained.

Filming is prevented and the cleaning performance is improved by improving the dispersion property of the filler.

Preferred specific examples of the dispersant having an acid value include, but are not limited to, dispersants of polycarboxylic acid type having a carboxyl group in the structure.

The carboxylic acid portion in the dispersant imparts an acid value and plays a role of improving the dispersion property.

A hydrophilic inorganic filler that has a low affinity with an organic solvent and a binder resin prevents dispersion.

To the contrary, the dispersant specified above has a carboxylic acid portion having a good affinity with the inorganic filler, and other portions having a good affinity with a binder resin and an organic solvent. Therefore, the affinity of the inorganic filler with a binder resin and an organic solvent is improved via the dispersant.

Therefore, the dispersion property of the filler is greatly improved.

Among the dispersants, a polycarboxylic acid derivative having more carboxylic acid groups is more preferable to the dispersant having a single carboxylic acid group described above considering the impact on improvement in the dispersion property of the filler and reduction of the voltage in the irradiated portion.

Such a derivative improves the affinity with the filler and the dispersant. Also it improves the dispersion property of the filler and prevents settling of the filler by maintaining the affinity between the dispersant particles.

The acid value of the dispersant is preferably from 10 to 700 mg/KOH, and more preferably from 30 to 400 mgKOH/g.

A dispersant that has an excessively high acid value tends to cause image blur, and a dispersant that has an excessively low acid value tends to hardly reduce the voltage at the irradiated portion.

However, the acid value of the dispersant is determined based on the balance with the addition amount thereof.

In addition, it is preferable that the acid value and the addition amount of the dispersant are selected considering the structure and the molecular weight of the dispersant, and the kind and the particle diameter of the filler.

In the present disclosure, the addition amount of the dispersant preferably satisfies the following relationship and is more preferably set to be the minimum that satisfies the relationship.

$$1<(\text{Addition amount of dispersant}\times\text{Acid value of dispersant})/(\text{Addition amount of filler})<40$$

When the addition amount is too large, image blur tends to occur and the dispersion property may deteriorate to the contrary.

On the other hand, when the addition amount is too small, the dispersion property tends to be insufficient, or the voltage at the irradiated portion does not easily decrease, resulting in production of abnormal images.

These technologies are described in Japanese patent no. 3802787.

The filler material specified above can be dispersed in an organic solvent preferably with a dispersant with a typical device or method such as a ball mill, an attritor, a sand mill, and an ultrasonic.

Materials of typically used media sicu as zirconia, alumina, and agate can be used. Among these, taking into account the dispersion property of the filer, and the reduction of the voltage at irradiated portion, alumina is more preferable and $\alpha$ type alumina is particularly preferable in terms of abrasion resistance.

Zirconia is easily abraded during dispersion, and due to mingling of the abrasion powder, the residual voltage markedly increases, the dispersion property deteriorates, and the settling property of the filler significantly worsens.

When alumina is used as the media for dispersion, the amount of abrasion during dispersion is limited and the mingled abrasion powder has little impact on the residual voltage.

In addition, even if the abrasion powder is mingled, it has relatively little impact on the dispersion property in comparison with the other media Therefore, the media for use in dispersion is preferably alumina.

The dispersant limits the agglomeration and settling property of the filler in the liquid application, and improves the dispersion property thereof. Therefore, the dispersant is preferably added together with the filler and the organic solvent before dispersion.

On the other hand, although the binder resin and the charge transport material can be added before dispersion, the dispersion property may slightly deteriorate.

Therefore, it is preferable that the binder resin and the charge transport material are preliminarily dissolved and then added after dispersion.

Furthermore, various kinds of materials such as a charge transport material having a triaryl amine structure, an antioxidant, a plasticizer, a leveling agent, a lubricant, and an ultraviolet absorbent can be added to the protection layer in the present disclosure.

When the curable resin is used in the protection layer, the voltage at the irradiated portion can be lowered by causing the protection layer to contain a charge transport material having a triaryl amine structure.

In this case, the charge transport material contained in the protection layer is cross-linked so that the charge infusion property becomes low at the interface between the protection layer and the photosensitive layer or the charge transport layer formed below the protection layer, resulting in the rise in the voltage at the irradiated portion.

This particularly has an impact on the rise in the voltage in one job.

However, when the charge transport material is contained in the entire area of the protection layer, curing inhibition easily occurs.

Particularly in the case of curing by irradiation, the charge transport material contained in the protection layer absorbs light and is transmuted thereby, which may lead to acceleration of charge trap, and an increase in the voltage in the irradiated portion to the contrary.

Therefore, the charge transport material is preferably contained on the surface side of the protection layer.

In addition, containing an anti-oxidant in the protection layer is also preferable.

Specific examples of the anti-oxidants include, but are not limited to, known antioxidants such as phenol-based compounds, hindered phenol-based compounds, hindered amine-based compounds, paraphenylene diamines, hydroquinoenes, organic sulfur compounds, and organic phosphorous compounds.

With regard to reduction on image blur, it is possible to reduce image blur by using the diamine compound represented by the chemical structure. When an anti-oxidant is contained in combination, the limitation effect on the image blur increases. In addition, since the anti-oxidant prevents the transmutation of the diamine compounds represented by the chemical structure 1 during repetitive use, prevention on image blur sustains furthermore.

Consequently, the image bearing member becomes more durable and stabilized.

Also, the anti-oxidant may cause curing inhibition during curing of the protection layer so that the anti-oxidant is preferably present less on the surface side of the protection layer than the other side thereof.

In addition, containing a plasticizer in the protection layer is also preferable.

When a plasticizer is added, the internal stress on the protection layer is relaxed, the occurrence of cracking is prevented, and the adhesion property is improved.

Known additives can be used as these additives. A typical resin such as dibutylphthalate and dioctyl phthalate can be used as the plasticizer. The content thereof is not greater than 20% by weight and preferably not greater than 10% based on the total solid portion of the liquid application.

In addition, containing a leveling agent in the protection layer is also preferable.

Such a leveling agent reduces occurrence of film defects, contributes to form a uniform layer, and improves the lubricity of the surface, thereby preventing filming, and attachment of foreign objects.

Specific examples of such leveling agents include, but are not limited to, silicone oils such as dimethyl silicone oil, methyl phenyl silicone oil and a polymer or an oligomer having a perfluoroalkyl group in its side chain. Particularly, a leveling agent having a polymerizable functional group is preferable.

The content thereof is suitably not greater than 3% by weight based on the total solid portion of the liquid application.

The protection layer can be applied by using any known application method such as a spray coating method, a dip coating method, a ring coating method, and a bead coating method.

Among these, the spray coating method is most preferable to obtain a uniformly thin layer.

The liquid application can be diluted by a solvent before use. Specific examples of such solvents include, but are not limited to, an alcohol such as methanol, ethanol, propanol and butanol; a ketone such as acetone, methyl ethyl ketone, methyl isobutyl ketone, and cycle hexanone; an ester such as ethyl acetate and butyl acetate; an ether such as tetrahydrofuranm dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosove and cellosolve acetate.

These solvents can be used alone or in combination.

The density of the solid portion of the liquid application can be arbitrarily determined considering the solubility of the composition and the target film thickness.

The layer thickness of the protection layer is preferably from 1 to 10 μm and more preferably from 2 to 6 μm.

When the film thickness is too thin, the image blur tends to be trouble and to the contrary, when the film thickness is too thick, the voltage at the irradiated portion may markedly rise.

The protection layer of the present invention is formed by applying the liquid application followed by curing according to the energy provided from outside.

Heat, light and radiation ray can be used as external energy in any application method.

Heat can be applied to the protection layer from the application surface side or the substrate side using a gas such as air and nitrogen, vapor, or various kinds of heat media, infra-red radiation and electromagnetic wave.

The heating temperature is not lower than 100° C. and preferably not higher than 170° C. When the heating temperature is too low, the reaction speed tends to be slow so that the curing reaction may not be complete.

A heating temperature that is too high tends to cause non-uniform curing reaction, thereby significantly distorting the inside of the protection layer.

A method of heating the cross linked surface layer at a relatively low temperature, for example lower than 100° C., followed by heating at a relatively high temperature, for example, higher than 100° C., is suitable to uniformly conduct curing reaction.

As light energy, a UV irradiation light source such as a high pressure mercury lamp or a metal halide lamp having a main emission wavelength in the ultraviolet area is used. A visible light source can be selected depending on the absorption wavelength of a compound containing a radical polymerizable monomer and a photopolymerization initiator.

The irradiation light amount is from 50 mW/cm$^2$, or higher, preferably 500 mW/cm$^2$, or higher, and more preferably 1,000 mW/cm$^2$.

An irradiation light having a strong intensity, e.g., 1,000 mW/cm$^2$, is suitable to increase the processing speed of the polymerization reaction and form a uniform protection layer.

Beams of electron can be used as the radiation ray energy.

When the protection layer is cured by a light energy or a radiation ray energy, drying is preferably conducted to remove a residual solvent after curing.

The drying temperature and time can be freely determined considering the melting point of the solvent for use in the liquid application for the protection layer and are typically from about 100 to about 150° C. and from about 10 to about 30 minutes.

Undercoating Layer

In the method of manufacturing the image bearing member of the present disclosure, an undercoating layer can be provided between the electroconductive substrate and the photosensitive layer or the charge generation layer.

Typically, such an undercoating layer is mainly made of a resin. Considering that the photosensitive layer is applied to such an undercoating layer (i.e., resin) in a form of solvent, the resin is preferably hardly soluble in a known organic solvent.

Specific examples of such resins include, but are not limited to, water soluble resins such as polyvinyl alcohol, casein, and sodium polyacrylate, alcohol soluble resins such as copolymerized nylon and methoxymethylized nylon and curable resins which form a three dimensional network structure, such as polyurethane, melamine resins, phenolic resins, alkyd-melamine resins, and epoxy resins.

In addition, inclusion of inorganic pigments in the undercoating layer is suitable to prevent the occurrence of moiré fringe and reduce the residual voltage.

The moiré fringe is a kind of image deficiency caused by an interference pattern referred to as a moiré due to the optical interference when an image is written by a coherent light beam such as a laser beam. Basically, the moiré fringe is prevented because the undercoating layer scatters the incident laser beam. Therefore, the undercoating layer contains a material having a large refraction index.

One of usable inorganic pigments is white pigment and specific examples thereof include, but are not limited to, metal oxide such as titanium oxide, zinc oxide, calcium fluoride, silicon oxide, magnesium oxide, aluminum oxide, tin oxide, zirconium oxide, and indium oxide.

Powder pigments of metal oxides such as titanium oxide, silica, alumina, zirconium oxide, tin oxide, and indium oxide.

Furthermore, the undercoating layer preferably has a function of transferring charges having the same polarity as that of the charges on the surface of an image bearing member from the charge generation layer to the electroconductive substrate to reduce the voltage at the irradiated portion and the inorganic pigment mentioned above bears that function.

For example, when an image bearing member of a negative charging type is used, the undercoating layer can reduce the voltage at the irradiated portion by having an electron conductivity.

The metal oxides mentioned above are suitably used as these inorganic pigments. However, although the voltage at the irradiated portion is reduced by the existence of inorganic pigments having a low resistance and an increase in the addition ratio thereof, the background fouling may worsen.

Therefore, the layer structure and the layer thickness of the undercoating layer in an image bearing member and an addition amount of the inorganic pigments is adjusted to have a good combination between the reduction on the background fouling and the voltage at the irradiated portion.

In consideration of prevention of moiré fringes, an increase of the voltage at the irradiated portion and background fouling, titanium oxide is most suitable among the metal oxides mentioned above.

Such an undercoating layer is mainly formed of a binder resin, and an inorganic pigment (metal oxide) and a liquid dispersion for application is obtained by wet dispersion in a state in which a solvent is contained. Acetone, methylethylketone, methanol, ethanol, butanol, cyclohexanone, dioxane and a solvent mixture thereof are suitably used as the solvent. The inorganic pigments are dispersed with a binder resin in a solvent by a typical method using such as a ball mill, sand mill, and an attritor to prepare the liquid application.

The binder resin can be added before dispersion and after dispersion as a resin solution.

In addition, an agent, an additive, a curing promoter, etc. can be optionally added for curing (cross-linking) and a dispersion agent can be added to improve the dispersion property of the inorganic pigment.

Using such a liquid application, the undercoating layer is formed on an electroconductive substrate using a known method such as a dip coating method, a spray coating method, a ring coating method, a bead coating method and a nozzle coating method.

After application of the liquid, the undercoating layer is formed by optional curing treatment such as light irradiation for drying or curing.

The layer thickness of the undercoating layer varies depending on the kind of the inorganic pigment contained therein and is preferably from 0 to 20 μm and more preferably from 2 to 10 μm.

In addition, an intermediate layer can be provided between the electorconductive substrate and the undercoating layer or the undercoating layer and the charge generation layer.

The intermediate layer is provided to reduce the infusion of positive holes from the electroconductive substrate and the main purpose of the intermediate layer is to prevent the background fouling.

Generally, the intermediate layer is mainly formed of a binder resin.

Specific examples of the resins include, but are not limited to, polyamide, alcohol soluble polyamide (soluble nylon), water soluble polyvinylbutyral, polyvinyl butyral, and polyvinyl alcohol.

The method described above and known application methods are employed as the intermediate layer formation method.

The layer thickness of the intermediate layer is suitably from about 0.05 to 2 μm.

By having a two layer structure of the intermediate layer and the undercoating layer, the effect of reducing the background fouling is drastically improved.

Additives to Respective Layers

Furthermore, in the present disclosure, additives such as an anti-oxidant, a plasticizer, a lubricant, and an ultraviolet absorbent can be added to each layer, i.e., the protection layer, the photosensitive layer (the charge generation layer, the charge transport layer), the undercoating layer, other layers such as the intermediate layer to improve the environmental resistance, in particular, to prevent the degradation of sensitivity and the rise in residual potential.

Specific examples of the anit-oxidants that can be added to each layer include, but are not limited to, the following.

(a) Phenol Compounds 2,6-di-t-butyl-p-cresol, butylated hydroxyanisol, 2,6-di-t-butyl-4-ethylphenol, n-octadcyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4, 4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

(b) Paraphenylene Diamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

(c) Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

(d) Organic Sulfur Compounds dilauryl-3,3-thiodipropionate, distearyl-3,3'-thiodipropionate, and ditetradecyle-3,30f-thiodipropionate.

(e) Organic Phosphorous Compounds triphenyl phosphine, tri(nonylphenyl)phosphine, tri(dinonylphenyl)phosphine, tricresyl phosphine, and tri(2,4-dibutylphenoxy)phosphine.

Specific examples of the plasticizers that can be added to each layer include, but are not limited to, the following (a) Phosphoric Ester Based Plasticizer Triphenyl phosphate, tricresyl phosphate, trioctyl phosphate, octyldiphenyl phosphate, trichloroethyl phosphate, cresyl diphenyl phosphate, tributyl phosphate, tri-2-ethylhexyl phosphate, and triphenyl phosphate.

(a) Phthalic Ester Based Plasticizer

Dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzil phthalate, butyllauryl phthalate, methyloleyl phthalate, octyldecyl phthalate, dibutyl fumarate, and dioctyl fumarate.

(c) Aromatic Carboxyl Ester Based Plasticizer

Trioctyl trimellitic acid, tri-n-octyl trimellitic acid, and octyl oxybenzoate.

(d) Aliphatic Dibasic Acid Ester Based Plasticizer

Dibutyl adipate, n-hexyl adipate, di-2-ethylhexyl adipate, di-n-octyl adipate, n-octyl-n-decyl adipate, diisodecyl adipate, dicapryl adipate, di-2-ethyl-ethylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophyalate, and di-n-octyl tetrahydrophtalate.

(e) Aliphatic Ester Derivative

Butyl oleate, glycerin monoloeic acid ester, methyl acetyl ricinolate, pentaerythritol ester, dipentaerythritol hexaester, and triacetine, and tributyrin.

(f) Oxic Acid Ester Based Plasticizer

Methyl acetyl ricinoleate, butyl acetyl ricinoleate, butylphthalyl butyl glicolate, and tributyl acetyl citrate.

(g) Epoxy Plastic Agent

Epoxidized soy bean oil, epoxidized linseed oil, butyl epoxy stearate, decyl epoxy stearate, octyl epoxy stearate, benzyl epoxy stearate, dioctyl epoxy hexahydrophthalate, and didecyl epoxyhexahydrophyalate.

(h) Diol Ester Based Plasticizer

Diethylene glycol dibenzoate, and triethylene glycol di-2-ethyl butylate.

(i) Choline Containing Plasticizer

Clorinated paraffin, chlorinated diphenyl, chlorinated aliphatic methyl, and methoxychlorinated aliphatic methyl.

(j) Polyestel Based Plasticizer

Polypropylene adipate, polypropylene cebacate, polyester, and acetylized polyester.

(k) Sulfuric Acid Derivatives p-toluene sulfone amide, o-toluene sulfone amide, p-toluene sulfone ethyl amide, o-toluene sulfone ethyl amide, toluene sulfone-N-ethyl amide, and p-toluene sulfone-N-cyclohexyl amide.

(i) Citric Acid Derivatives

Triethyl citrate, triethyl acetyl citrate, tributyl citrate, tributyl acetyl citrate, tri-2-ethyl hexyl acetyl citrate, and acetyl citrate-n-octyl decyl.

(m) Others

Terphenyl, partially hydrogenerated terphenyl, camphort, 2-nitrodiphenyl, dinonyl naphthaline, and methyl abietate.

Specific examples of the lubricants that can be added to each layer include, but are not limited to, the following.

(a) Hydrocarbon Compounds

Liquid paraffin, paraffin wax, microwax, and low polymerized polyethylene.

(d) Aliphatic Compounds

Lauric acid, myristic acid, paltimic acid, stearic acid, arachidic acid, and behenic acid.

(c) Aliphatic Amide Based Compound

Stearyl amide, palmitic amide, oleic amide, methylene bisstearoamide, and ethylene bisstaroamide.

(d) Esterified Compounds

Lower alcohol ester of an aliphatic acid, multi-valent alcohol ester of an aliphatic acid, and aliphatic acid polyglycol esters.

(e) Alcohol Based Compounds

Cetyl alcohol, stearyl alcohol, ethylene glycol, polyethylene glycol, and polyglycerol.

(f) Metal Soap

Lead stearate, cadmium stearate, barium stearate, calcium stearate, zinc stearate, and magnesium stearate.

(g) Natural Wax

Carnauba wax, candelila wax, bees wax, whale wax, insect wax and montan wax (h) Others Silicone Compounds, and Fluorinated Compounds Specific examples of the ultraviolet abosorber that can be added to each layer include, but are not lmited to, the following.

(a) Benzophenones 2-hydrosybenzophenone, 2,4-dihydroxybenzophenone, 2,2',4-trihydroxybenzophenone, 2,2',4,4'-tetrahydroxy benzophenone, and 2,2'-dihydroxy-4-methoxy dibenzophenone.

(b) Salicylates

Phenylsalicylate, and 2,4-di-t-butylphenyl-3,5-di-t-butyl-4-hydroxybenzoate.

(c) Benzotriazoles (2'-hydroxyphenyl)benzotriazole, (2'-hydroxy-5'-methylphenyl)benzotriazole, (2'-hydroxy-5'-methyl phenyl)benzotriazole, and (2'-hydroxy-3'-tertiary butyl-5'-methylphenyl)-5-chlorobenzotriazole.

(d) Cyanoacrylates

Ethyl-2-cyano-3,3-diphenylacrylate, and methyl-2-carbomethoxy-3(paramethoxy)acrylate.

(e) Quenchers (Metal Salts)

Nickel (2,2'-thiobis(4-t-octyl)phenolate)normalbutyl amine, nickeldibutyldithiocarbamate, nickel dibutyldithiocarbamate, and cobalt dicyclohexyldithiophosphate.

(f) HALS (Hindered amine)

Figure 2:
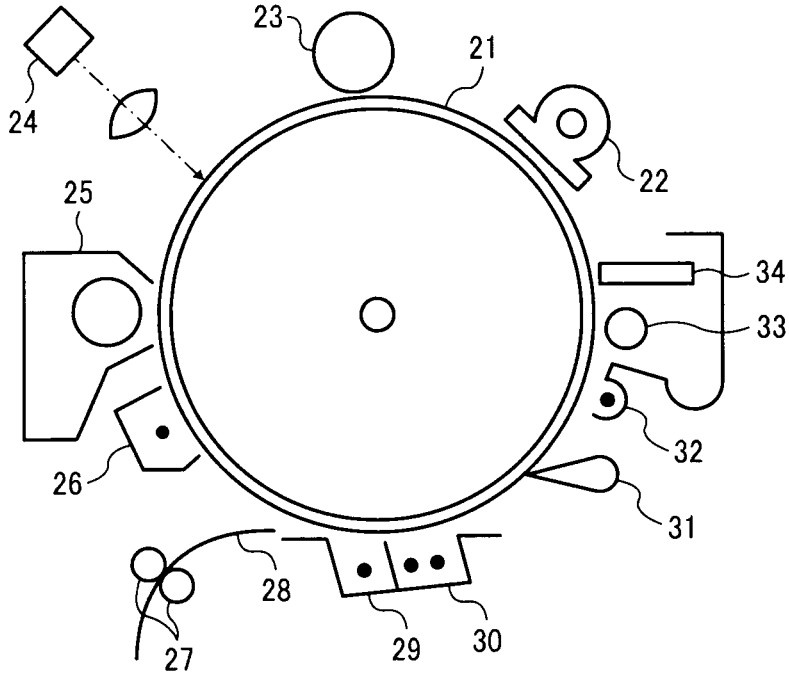
FIG. 2 is a schematic diagram illustrating an embodiment of the image forming apparatus of the present disclosure.

Bis(2,2,6,6-tetramethyl-4-piperidyl)cebacate, bis(1,2,2,6,6-pentamethyl-4-piperidyl)cebacate, 1-[2-[3-(3,5-di-t-butyl-4-hydroxyphenyl)propionyloxy]ethyl]-4-[3-(3,5-di-t-butyl-4-hydroxyphenyl)propionyloxy-2,2,6,6-tetramethylpyridine, 8-benzil-7,7,9,9-tetramethyl-3-octyl-1,3,8-triazaspiro[4,5]undecane-2,4-dione, and 4-benzoyloxy-2,2,6,6-tetramethyl piperidine Image Forming Apparatus Next, the image forming apparatus is described in detail with reference to FIG. 2. The image forming apparatuses of the present invention includes a charging device, a latent electrostatic image formation device, a development device, a transfer device, a fixing device, a cleaning device, and a discharging device on a necessity basis. Other devices can be optionally provided to the image forming apparatus. This is only a representative example and the present invention is not limited thereto. The variations that are described later are also within the scope of the present invention.

An image bearing member 21 has a drum form but is not limited thereto. An image bearing member may employ a sheet form or an endless belt form.

The reference numerals 22, 23, 24, 25, 26, 27, 28, 29, 30, 31, 32, 33, and 34 represent a discharging lamp, a charger, an image irradiation portion, a development unit, a pre-transfer charger, a registration roller, a transfer sheet, a transfer charger, a separation charger, a separation claw, a pre-cleaning charger, a fur brush, and a blade, respectively.

There can be used known charging devices employing, for example, a corona charging system such as a corotron, or a scoroton in which a high voltage is applied to a wire, a solid discharging system in which a high frequency voltage is applied to electrodes pinching an insulation board instead of wire, a contact type roller charging system in which a high voltage is applied to a member having a roller to charge an image bearing member while the member is in contact with the image bearing member, a vicinity disposition type roller charging system in which a member having a roller form charges an image bearing member with a gap between the roller and an image formation area of 100 μm or less, or a contact charging system using a brush, a film, a blade, etc., to charge an image bearing member while they are in contact with the image bearing member as the charging device.

In the corona charging system, a high voltage is applied to a wire having a diameter of from 50 to 100 μm, thereby ionizing the air around and the ionized air is transferred toward the image bearing member to charge the image bearing member.

Corona charging system is typified into corotron and scorotron.

A scorotron has a structure in which screen electrodes (grid) are arranged on a corotron. The screen electrodes are arranged with a gap between them of from 1 to 3 mm and stretched at a position 1 to 2 mm away from an image bearing member.

Therefore, when a charging time is elongated, the charging voltage is restricted by a voltage applied to the grid electrodes so that the surface voltage saturates. Therefore, the charging voltage can be controlled by the grid potential to conduct uniform charging.

For a high speed performance, a double wire type in which two wires are suspended is particularly preferable.

In addition, among the two wire type, a structure in which the two wires are separated is also suitable.

A space having a breadth of 1.5 mm or broader per 1 kV is provided to prevent discharging between the wires or the wire and the casing.

The charging system having a roller form applies a voltage to an electroconductive roller and contacts with the image bearing member to impart charges.

In comparison with the corona charging system, the roller system applies a low voltage and is advantageous in terms of size reduction and the production amount of ozone, which is extremely small.

However, when the performance speed is too high, contamination and abrasion of the roller tends to be accelerated, which degrades the chargeability, thereby shortening the working life thereof.

In addition, the roller system can be provided in the vicinity of an image bearing member as well as in contact therewith regard to the image formation area.

Therefore, the charging roller is contaminated with development material and paper dust during repetitive use. Thus, the charging reduction, production of abnormal images and abrasion can be limited.

The charging roller is disposed in the vicinity of the image bearing member in the image formation area by providing a gap in the no-image formation area of the charging roller or the image bearing member.

Figure 3:
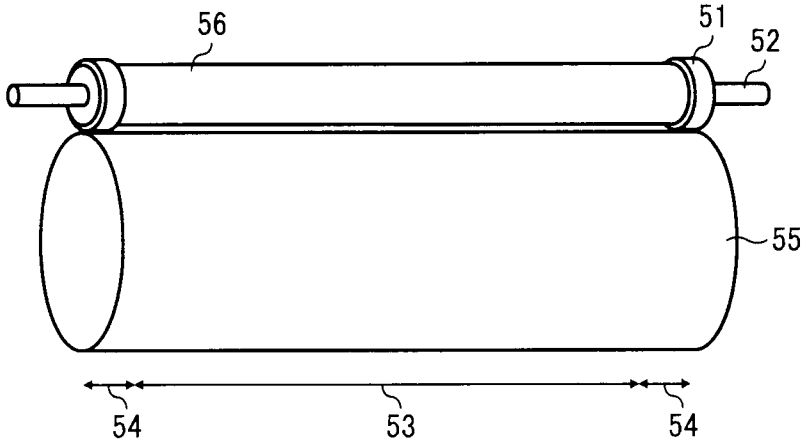
FIG. 3 is a diagram illustrating an example of the non-contact type charging roller provided in the vicinity of the image bearing member of the present disclosure.

For example, as illustrated in FIG. 3, a gap tape, i.s., gap formation member 51 having a uniform thickness, is provided to a charging roller 56 to maintain a gap.

Reference numerals 52, 53, 54, and 55 represent an image bearing member, a metal shaft, an image formation area, and a non-image formation area, respectively.

The gap between the image bearing member and the charging roller is preferably small, which is 100 μm or less, and more preferably 50 μm or less.

Since the charging roller and the image bearing member are arranged not in contact with each other, discharging accordingly becomes uneven, and thus charging of the image bearing member may not be stabilized.

To stabilize the charging, the applied bias for charging is preferably formed of overlapping an AC component to a DC component.

Any irradiation device that irradiates an image bearing member with light that is absorbed by the charge generation material of the image bearing member can be used as the latent electrostatic formation device.

The charged image bearing member is irradiated with light by the electrostatic image formation device, which is absorbed by the charge generation material to generate a pair of charges. One charge of the pair moves to the surface to cancel the surface charge and thus a latent electrostatic image is formed thereon.

Typical illuminating sources, for example, a fluorescent lamp, a tungsten lamp, a halogen lamp, a mercury lamp, a sodium lamp, a light emitting diode (LED), a semiconductor laser (LD), electroluminescence (EL), etc. can be used as the light source of the irradiation device as long as the light source satisfies the condition mentioned above.

Among these, the light emitting diode or the semi-conductor laser is advantageous and most suitable in terms of high speed performance and size reduction of an image forming apparatus.

Various kinds of optical filters, for example, a sharp cut filter, a band-pass filter, a near infrared filter, a dichroic filter, a coherent filter and a color conversion filter, can be used in combination with these light sources to irradiate an image bearing member with light having only a desired wavelength.

In addition, a multi-beam irradiation device, particularly a surface emitting laser, is preferable.

Also, the speed of the performance of an image forming apparatus is improved by increasing the number of rotation of a polygon mirror and the number of image scanning frequency in the sub-scanning direction. However, there is a limit to an increase in the number of rotation of a polygon mirror. Thus, a multi-beam scanning irradiation method using a multi-beam recording head is employed in which multiple light beam sources are arranged in the sub-scanning direction to scan an image bearing member with multiple beams in the primary scanning direction in one scanning. According to the method using the multi-beam recording head, the number of rotation of a polygon mirror required in the case of one-beam light source is reduced to 1/n thereof for a light source using "n" light beams. That is, the rotation speed can be "n" times as fast as that in a single light beam light source. In addition, the scanning speed has thus an allowance and the scanning density can be increased so that an image with a high definition can be output at a high speed.

Figure 4:
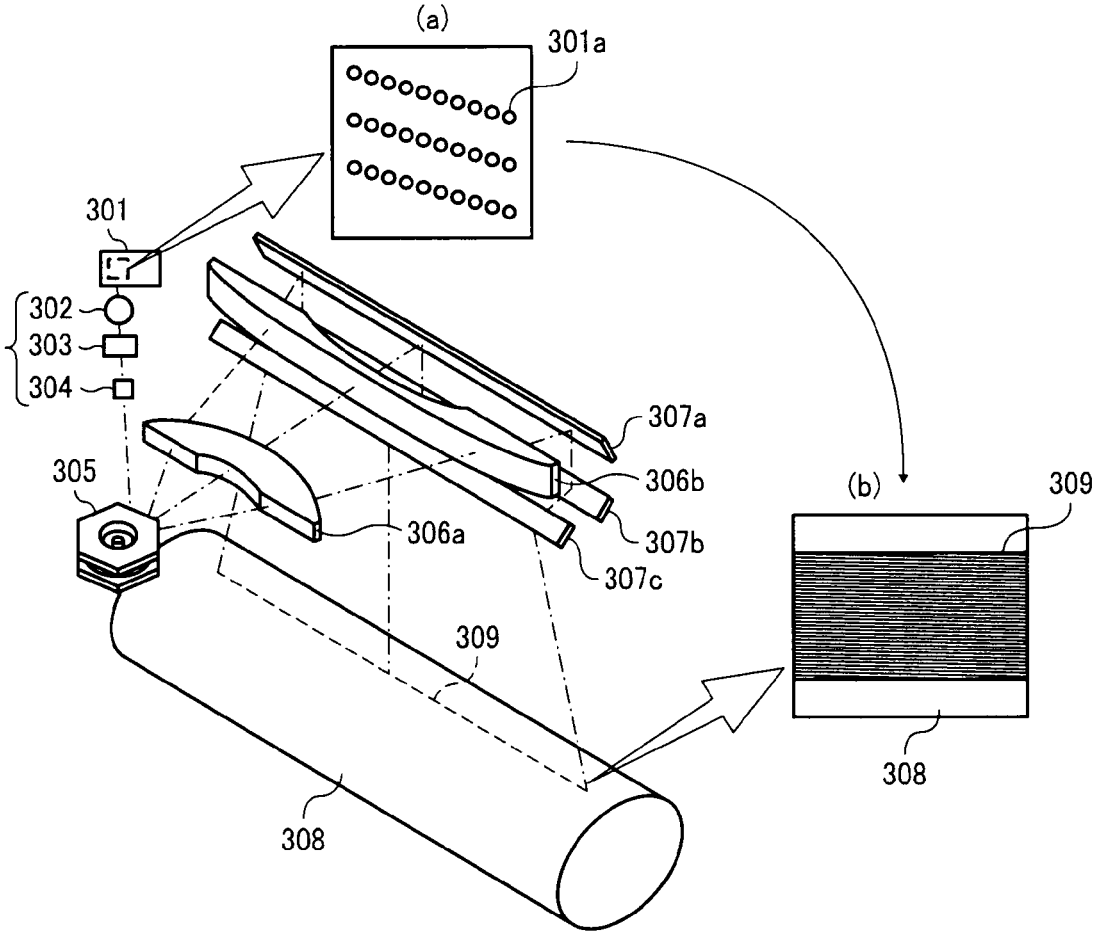
FIG. 4 is a schematic diagram illustrating an example of the multiple beam irradiation device for use in the image forming apparatus of the present disclosure.

FIG. 4 is a diagram illustrating an example of the multi-beam irradiation device for use in the present disclosure.

A collimate lens 302 collimates multiple laser beams emitted from a light source 301 having multiple luminous points 301*a* arranged in one or two dimensions to parallel or significantly parallel beams of light. Then, the laser beams are deflected to the main scanning direction by a polygon mirror 305 via a cylindrical lens 303, and an aperture 304.

The laser beams deflected by the polygon mirror 305 are converged by a scanning lens 306*a* and 306*b* and focused on a surface 308 of the image bearing member via reflection mirrors 307*a*, 307*b*, and 307*c* to scan the surface 308 along the main scanning direction.

A side emitting laser or a vertical-cavity surface-emitting laser can be used as the light source of the multi-beam irradiation device.

Particularly, the vertical-cavity surface-emitting laser can be formed by molding a laser array having luminous points arranged in the two dimension and thus is advantageous in terms of the high speed performance of the image forming apparatus, size reduction, and improvement on definition of an image.

The reference numerals 302, 303, and 304 are combinations referred to as a coupling optical systems.

In addition, (a) is an enlarged diagram illustrating the light source and (b) is an enlarged diagram illustrating scanning.

As described above, high speed performance of the image bearing member is made possible by using multiple beam irradiation device irrespective of the rotation speed of the polygon mirror.

In addition, since the phenomenon ascribable to overlapping of the multiple laser beams is limited, a combination of the technology of the present disclosure and the multiple beam irradiation is particularly suitable.

The development process is a process in which a latent electrostatic image formed by the latent electrostatic image formation device is developed with toner to form a toner image on the image bearing member.

A negative image, i.e., reverse development, is obtained when the latent electrostatic image is developed with toner having the same polarity with that of the image bearing member, and, a positive image, when developed with toner having an opposite polarity to that of the image bearing member.

Development system is typified into a single component development system using only toner, and a two component development system using a mixture of toner and carriers. Both systems are suitable in the present invention.

In addition, when a full color image is developed by overlapping multiple color toner images each other on an image bearing member according to a development method in which a toner image is developed while in contact with the image bearing member, a toner image may disturb the previously developed toner image when overlapped.

Thus, a system, for example, a jumping development system, in which an image is developed without a contact between the image bearing member and the development device is preferably used.

The transfer process is a process of transferring the toner image formed on the image bearing member to a transfer material, i.e., transfer medium such as paper.

A charging device can be used as the transfer device. For example, a transfer charger or a combination thereof with a separation charger can be suitably used.

The transfer system can be classified into a direct transfer system in which a toner image is directly transferred from the image bearing member to a transfer medium by the transfer device described above, and an intermediate transfer system in which a toner image on the image bearing member is temporarily transferred to an intermediate transfer body and then transferred to a transfer medium such as paper. Both transfer systems can be suitably used.

The intermediate transfer system is suitable for improvement on the image quality, and thus preferable for a full color image forming apparatus. However, that system is disadvantageous for high speed performance and size reduction. Therefore, the transfer system is selected considering the purpose of use.

In addition, a fixed voltage system or a fixed current system can be employed when an image is transferred. The fixed current system is more preferable because it is stable and the amount of transfer charge is maintained at the same level.

The higher the transfer current, the better the transferability. As the linear speed of the image bearing member increases, the transferability tends to deteriorate. Thus, an increase in the transfer current is preferable.

The fixing process is a process of fixing a toner image transferred to a transfer medium such as paper thereon by heat and pressure.

Any method can be employed as the fixing method as long as it fixes toner on the transfer medium.

To be specific, heat and/or pressure is applied. A combination of a heating roller and a pressure roller, or a combination thereof with an endless belt is also suitable.

The cleaning process is a process of cleaning the surface of an image bearing member of toner remaining thereon after development and transfer. Any method can be employed as long as it cleans the surface of the image bearing member.

Specific examples of the cleaning devices include, but are not limited to, a fur brush, a blade or a combination thereof.

Also, a magnetic brush, an electrostatic brush, and a magnetic roller are suitably used.

The surface of the image bearing member is contaminated with various kinds of foreign objects such as development material, paper dust, and products by discharging in addition to the toner remaining on the image bearing member, which have an adverse impact on the image quality. Therefore, such foreign objects are also removed in the cleaning process. From this point of view, the cleaning blade is most preferable.

The discharging process is a process of discharging the image bearing member to remove a latent electrostatic residual contrast image after removal of the residual toner in the cleaning process because the latent electrostatic residual contrast image may be visualized or result in a ghost image in the next image formation cycle.

Any device can be used as long as the charge generation material absorbs the light emitted from the device. For example, a fluorescent lamp, a tungsten lamp, a halogen lamp, a mercury lamp, a sodium lamp, a light emitting diode (LED), a semiconductor laser (LD), a xenon lamp and electroluminescence (EL) can be used as the discharging device and a combination of these and the optical filter mentioned above in the irradiation device is also suitable.

In addition to the optical light irradiation system, a method of discharging by application of a reversed bias can be employed, which is preferable in terms of limiting the metal fatigue.

In embodiments of present disclosure, a mechanism of applying a lubricant to the surface of the image bearing member is suitably provided.

Such a lubricant prevents turning inward and/or outward of a cleaning blade and its anticipated adverse result such as bad cleaning performance. In addition, since a lubricant is applied to the surface of the image bearing member, the surface of the image bearing member can be prevented from deterioration by charging.

That is, this is a good method to have an image bearing member having a good combination of a long working life and the image quality.

Therefore, the abrasion resistance and durability of the image bearing member are furthermore improved.

The application method of a lubricant includes a method of solidifying a lubricant, scraping the solid lubricant with a brush and applying it to an image bearing member, a method in which a lubricant is directly brought into contact with an image bearing member, a method in which a powder mixture of a lubricant with a development agent is prepared, and supplied and applied to the surface of an image bearing member in the development process, etc. In the present disclosure, a lubricant that is applied to the surface of an image bearing member can be used in any manner. Among the methods, the method of applying the lubricant by scraping it with a brush is most preferable.

Figure 5:
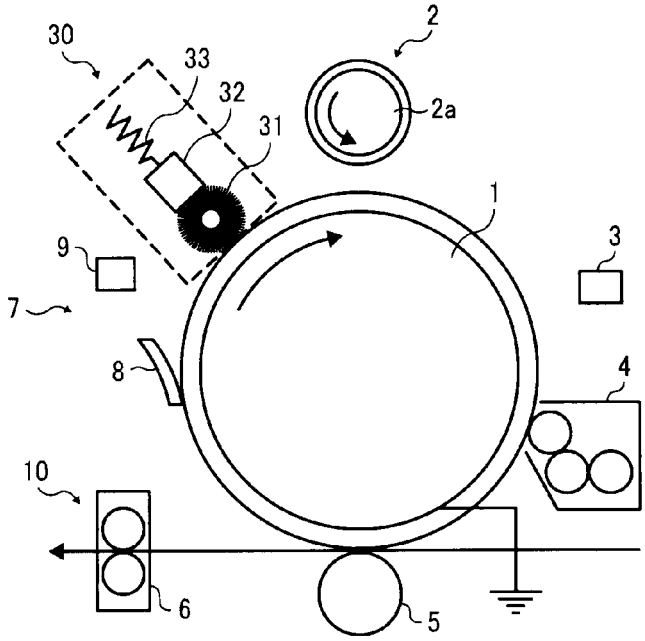
FIG. 5 is a diagram illustrating an embodiment of the lubricant applicator.

For example, the lubricant application device illustrated in FIG. 5 includes a fur brush 31 as an application member, a lubricant 32, and a pressure spring that presses the lubricant 33 to the direction of the fur brush 31. The lubricant 32 is a solid lubricant having a bar form and is pressed by the pressure spring 33 with a predetermined pressure. The lubricant 32 is scraped by rotation of the fur brush 31 and applied to the surface of the image bearing member 1. The pressure spring 33 is advantageous because it helps to constantly apply the same amount of the lubricant 32 to the surface of the image bearing member 1 by the fur brush 31 even when the lubricant 32 is reduced over time.

In addition, another method is preferably used in which a blade is brought into contact with the surface of an image bearing member to uniformly extend coated lubricant thereon while in contact therewith.

In this method, the cleaning blade can assume this function as the application blade or an application blade dedicated for application of a lubricant can be separately provided apart from the cleaning blade.

The application mechanism of a lubricant is preferably located after the cleaning process.

Any lubricant that uniformly attaches the surface of an image bearing member and resultantly imparts lubricant properties thereto can be used as the lubricant for use in the present invention.

For example, the material for the waxes and the lubricants are preferably used.

Specific examples thereof include, but are not limited to, metal salts of aliphatic acid such as lead oleate, zinc oleate, zinc oleate, zinc stearated, copper oleate, cobalt oleate, ferric stearate, copper stearate, calcium stearate, aluminum stearate, zinc palmitate, copper palmitate, and zinc linolenate, and fluorine-based resins such as polytetrafluoroethylene, polycholoro trifluolo ethylene, polyvinilydene fluoride, polytrifluorochloroethylene, dichlorodifluoroethylene, copolymers of tetrafluoroethylene-ethylene.

In addition, waxes can also be used and ester-based waxes or olefin-based waxes are preferable.

The ester based waxes represent compounds having an ester bonding, e.g., natural waxes such as carnauba wax, candelilla wax, and rice wax, and montan wax.

Specific examples of the olefin based waxes include, but are not limited to, synthesis waxes such as polyethylene wax, and polypropylene wax.

Among these, metal salts of stearic acid, more specifically, zinc stearate, are preferably used in the present invention in terms of the amount of application, and protection of the surface of an image bearing member from charging.

Image Forming Apparatus Employing Tandem System

A tandem system image forming apparatus includes the same number of image bearing members as development units separately provided for corresponding color toners, thereby independently conducting development of each color toner in parallel followed by overlapping of each color toner image to obtain a full color image. To be specific, at least four color development units and image bearing members of yellow (Y), magenta (M), cyan (C), and black (K) required for full color printing are provided, thereby achieving extremely high speed full color printing in comparison with a single drum system in which processes are repeated four times to obtain a full color image. Therefore, the tandem system is particularly suitable for the present invention.

Figure 6:
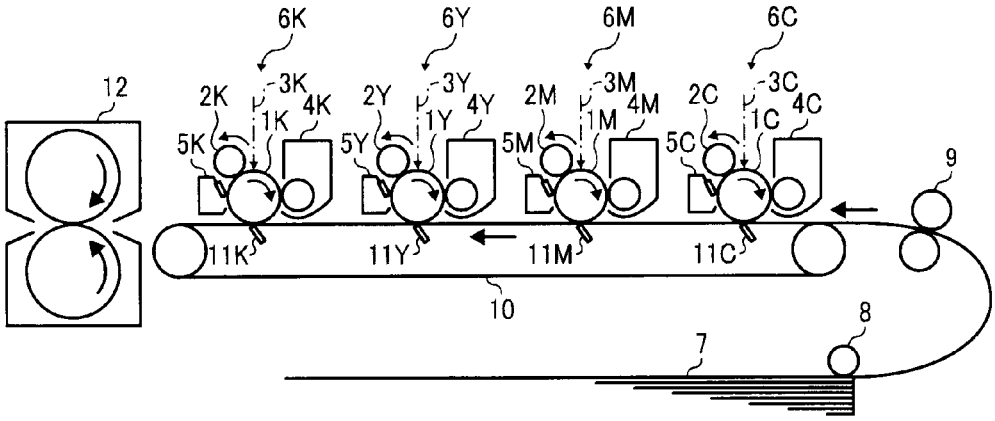
FIG. 6 is a diagram illustrating an embodiment of the full color image forming apparatus employing a tandem system of the present disclosure.

FIG. 6 is a schematic diagram illustrating a full color image forming apparatus employing a tandem system for use in the present invention.

In FIG. 6, the reference numerals 1C, 1M, 1Y, and 1K represent image bearing member having a drum form for use in the present disclosure.

The image bearing members 1C, 1M, 1Y, and 1K rotate in the direction indicated by an arrow and there are provided therearound at least charging devices 2C, 2M, 2Y, and 2K, development device 4C, 4M, 4Y, and 4K, and cleaning devices 5C, 5M, 5Y, and 5K arranged according to the rotation direction of the image bearing members.

An irradiation device (not shown) emits laser beams 3C, 3M, 3Y, and 3K from the rear side of the image bearing members between the charging devices 2C, 2M, 2Y, and 2K and the development device 4C, 4M, 4Y, and 4K to form latent electrostatic images on the image bearing members 1C, 1M, 1Y, and 1K.

Four development components 6C, 6M, 6Y, and 6K including the image bearing members 1C, 1M, 1Y, and 1K are arranged along a transfer belt 10 functioning as a transfer medium conveyor device.

The transfer belt 10 is in contact with the image bearing members 1C, 1M, 1Y, and 1K between the development device 4C, 4M, 4Y, and 4K and the cleaning devices 5C, 5M, 5Y, and 5K of each development component 6C, 6M, 6Y, and 6K. Transfer brushes 11C, 11M, 11Y, and 11K that apply a transfer bias are provided on the side of the transfer belt 10 reverse to the side thereof on which the image bearing members 1C, 1M, 1Y, and 1K are in contact.

Each image formation component 6C, 6M, 6Y, and 6K is of the same structure except that toners contained in the development devices 4C, 4M, 4Y, and 4K have different colors from each other.

The full color image forming apparatus having the structure illustrated in FIG. 6 forms images as follows.

In the image formation component 6C, 6M, 6Y, and 6K, the image bearing members 1C, 1M, 1Y, and 1K are charged by the charging devices 2C, 2M, 2Y, and 2K that rotate in the direction indicated by an arrow (the same direction as the rotation direction of the image bearing members 1C, 1M, 1Y, and 1K) and irradiated with the laser beams 3C, 3M, 3Y, and 3K by the irradiation device (not shown) situated outside the image bearing members 1C, 1M, 1Y, and 1K to form latent electrostatic images corresponding to an image of each color.

Then, the latent electrostatic images are developed by the development devices 4C, 4M, 4Y, and 4K to form toner images.

The development devices 4C, 4M, 4Y, and 4K develop the latent electrostatic images with toner of C (cyan), M (magenta), Y (yellow), and K (black), respectively. Respective toner images formed on the four image bearing members 1C, 1M, 1Y, and 1K are overlapped on a transfer medium 7.

The transfer medium 7 is sent out from a tray by a feeding roller 8, temporarily held at a pair of registration rollers 9 and fed to the transfer belt 10 in synchronization with image formation on the image bearing members 1C, 1M, 1Y, and 1K. The transfer medium 7 held on the transfer belt 10 is transferred to the contact point (transfer portion) with the image bearing members 1C, 1M, 1Y, and 1K where each color toner image is transferred.

The toner images on the image bearing members 1C, 1M, 1Y, and 1K are transferred to the transfer medium 7 by an electric field formed by a potential difference between the transfer bias applied to the transfer brushes 11C, 11M, 11Y, and 11K and the voltage of the image bearing members 1C, 1M, 1Y, and 1K.

The transfer medium 7 on which four color toner images are overlapped through the four transfer portions are conveyed to a fixing device 12 where the toner is fixed followed by discharging of the transfer medium 7 to a discharging portion (not shown). In addition, toner which has not been transferred to the image bearing members 1C, 1M, 1Y, and 1K and remains thereon are collected by the cleaning devices 5C, 5M, 5Y, and 5K.

The image formation elements are arranged in the sequence of C (cyan), M (magenta), Y (yellow), and K (black) from the upstream to the downstream relative to the transfer direction of the transfer medium, but are not limited thereto. The sequence of the color is arbitrary.

In addition, when a document of only black color is output, a mechanism to suspend the image formation elements 6C, 6M, and 6Y) other than the black color is particularly suitable for the present invention.

Furthermore, the charging device illustrated in FIG. 6 is in contact with the image bearing member. Alternatively, the vicinity type roller charging system having a suitable gap (about 10 to about 200 micro meter) between both as illustrated in FIG. 3 is suitably applicable. By using this system, toner filming on the charging device is limited.

Process Cartridge

The image formation device as described above can be assembled into a photocopier, a facsimile machine, or a printer in a fixed manner and each image formation element can be incorporated into such an apparatus in a form of a process cartridge.

The process cartridge is a device, i.e., a part, including an image bearing member and at least one device selected from other optional devices such as a charging device, a latent electrostatic image formation device, a development device, a transfer device, a cleaning device, a discharging device, and a lubricant applicator, and detachably attachable to the main body of an image forming apparatus.

Figure 7:
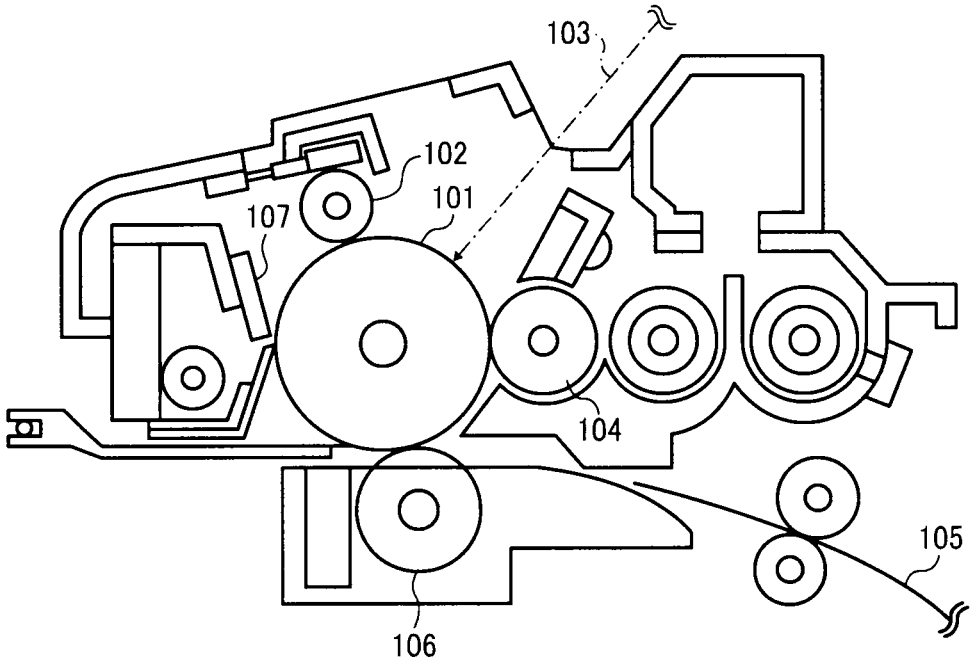
FIG. 7 is a diagram illustrating an embodiment of the process cartridge of the present disclosure.

There is no specific limit to the form of a process cartridge but a typical form thereof is as illustrated in FIG. 7.

The process cartridge is a device, i.e., a part, including the image bearing member 101, and at least one device selected from other optional devices such as the charging device 102, the development device 104, the transfer device 106, the cleaning device 107 and a discharging device (not shown) and detachably attachable to the main body of an image forming apparatus.

In the device illustrated in FIG. 7 and the image formation process, a latent electrostatic image is formed on the surface of an image bearing member 101 by charging by a charging device 102, and the irradiation by an latent electrostatic image formation device 103 according to the irradiation image, and the latent electrostatic image is developed with toner by a development device 104. Then, the toner image is transferred to a transfer body 105 by a transfer device 106 and thereafter output.

Next, the surface of the image bearing member after image transfer is cleaned by a cleaning device 107 and discharged by the discharging device (not shown) and then this sequential operation is repeated.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Titanylphthalocyanine Crystal

The method of synthesizing titanyl phthlocyanine crystal for use in the present disclosure is described below.

Titanyl phthalocyanine is synthesized according to JOP 2004-83859.

That is, 292 parts of 1,3-diiminoisoindoline and 1,800 parts of sulfolane are mixed and 204 parts of titanium tetrabutoxido is dropped thereto in nitrogen atmosphere.

Thereafter, the temperature is raised to 180° C., and the resultant is stirred to conduct reaction for 5 hours while the reaction temperature is maintained in a range of from 170 to 180° C.

After the reaction is complete, the resultant is naturally cooled down and the precipitation is filtered. The filtered resultant is washed with chloroform until the obtained powder indicates the color of blue. Next, the resultant powder is washed with methanol several times. Further, the resultant is washed with hot water of 80° C. several times and dried to obtain a coarse titanyl phthalocyanine.

The coarse titanyl phthalocyanine is dissolved in strong sulfuric acid the amount of which is 20 times as much as that of the titanyl phthalocyanine. The resultant is dropped to iced water the amount of which was 100 times as much as the resultant. The precipitated crystal is filtered and washed with de-ionized water (pH: 7.0, specific conductivity: 1.0 μS/cm) repeatedly until the washing water indicates neutral (the pH of the de-ionized water after washing is 6.8 and the specific conductivity thereof is 2.6 microS/cm). Thus, a wet cake (water paste) of titanyl phthalocyanine pigment is obtained.

40 parts of the thus obtained wet cake (water paste) is put in 200 parts of tetrahydrofuran and vigorously stirred with HOMOMIXER (MARKII f model, KENIS, Ltd.) (at 2,000 rpm) at room temperature until the color of the paste changed from navy blue to light blue (20 minutes after initiation of stirring), followed by immediate filtration with a reduced pressure. The crystals obtained on the filtration device are washed with tetrahydrofuran to produce a wet cake of the pigment.

The wet cake is then dried for 2 days at 70° C. under a reduced pressure (5 mmHg) to produce 8.5 parts of a titanyl phthalocyanine crystal.

Hereinafter, this is referred to as "Pigment 1".

The solid portion density of the wet cake is 15% by weight.

The weight ratio of the solvent for crystal conversion to the wet cake is 33.

No halogenated material is used in the raw material of this synthesis.

The thus obtained titanyl phthalocyanine powder measured under the following conditions has a CuKα X ray diffraction spectrum having a wavelength of 1.542 Å such that a maximum diffraction peak is observed at a Bragg (2θ) angle of 27.2±0.2°, main peaks are observed at a Bragg (2θ) angle of 9.4±0.2°, 9.6±0.2°, and 24.0±0.2°, and a peak is observed at a Bragg (2θ) angle of 7.3±0.2° as the lowest angle diffraction peak, while there is no peak between 9.4 and 7.3° and there is no peak at 26.3°.

Figure 8:
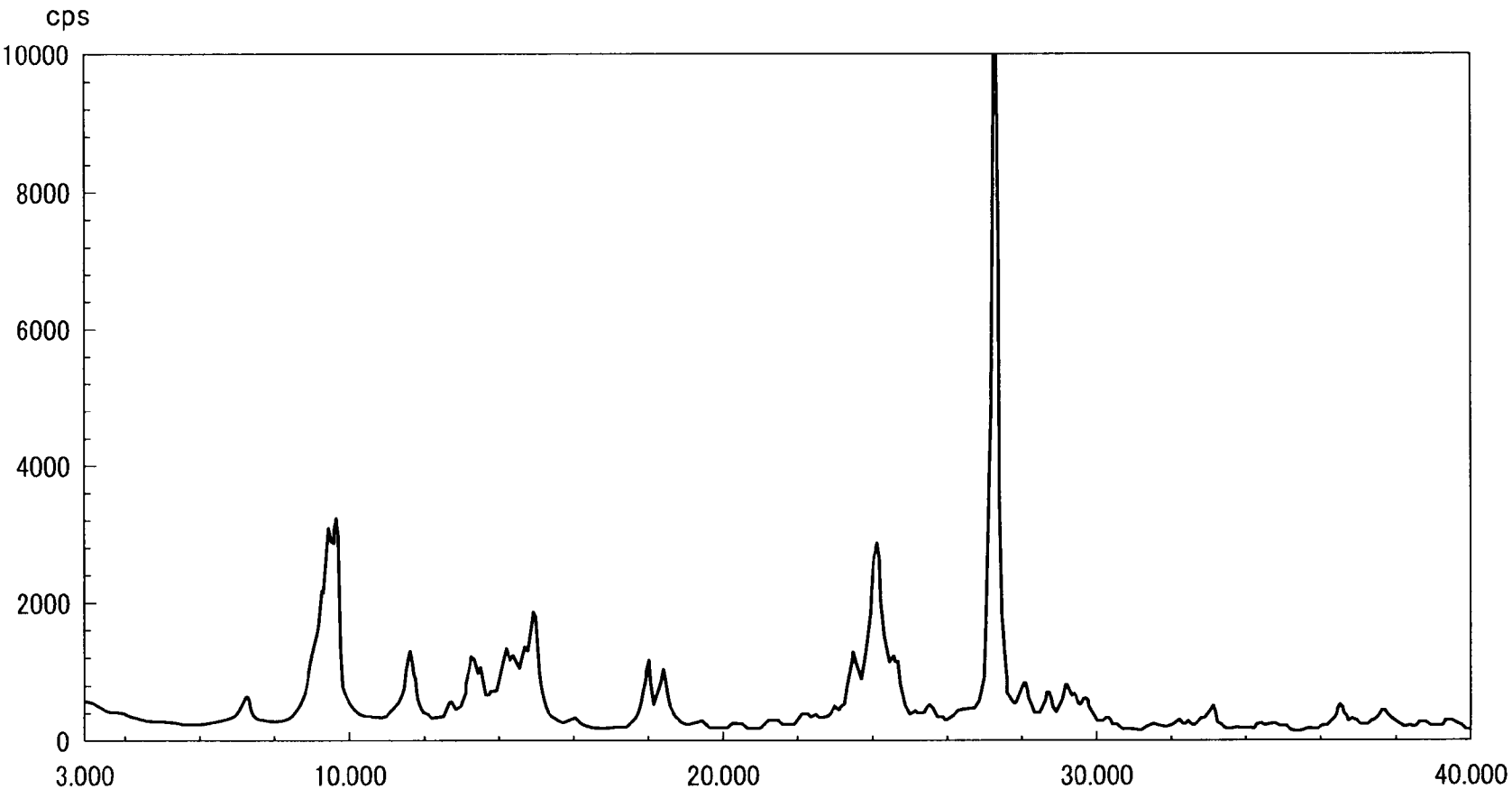
FIG. 8 is a graph illustrating X-ray diffraction spectrum of titanylphthalocyanine preferably used as the charge generation material.

The results are shown in FIG. 8.

Measuring Conditions of X Ray Diffraction Spectrum

X ray tube: Cu

Voltage: 50 kV

Current: 30 mA

Scanning speed: 2°/minute

Scanning area: 3° to 40°

Time constant: 2 seconds

Synthesis of Azo Pigment

The following azo pigment used in Examples and Comparative Examples is prepared according to the method described in Japanese patent no. 3026645.

Synthesis Example of Radical Polymerizable Compound Having Charge Transport Structure The polymerizable compound having the charge transport structure in the present disclosure is synthesized according to the method described in, for example, Japanese patent no. 3164426.

An example of the methods of manufacturing compound having the charge transport structure is as follows.

Synthesis of Radical Polymerizable Compound Having Triaryl Amine Structure (1) Synthesis of Hydroxyl Group Substituted Triarylamine Compound Represented by Following Chemical Structure B 240 ml of sulfolane is added to 113.85 g (0.3 mol) of methoxy group substituted triarylamine compound represented by the following chemical structure A and 138 g, i.e., 0.92 mol, of sodium iodide followed by heating to 60° C. in nitrogen atmosphere.

99 g, i.e., 0.91 mol, of trimethyl chlorosilane is dropped to the liquid in one hour and the resultant is stirred at about 60° C. for four and a half hours to complete the reaction. About 1.5 litter of toluene is added to the reaction liquid. Subsequent to cooling down to room temperature, the liquid is repeatedly washed with water and sodium carbide aqueous solution. Thereafter, the solvent is removed from the toluene solution. The toluene solution is refined with column chromatography treatment {absorption medium (silica gel), development solvent (toluene: ethyl acetate=20:1)}. Cyclohexane is added to the obtained light yellow oil to precipitate crystal.

88.1 g (yield ratio=80.4%, melting point: 64.0 to 66.0° C., Element analysis value (%); shown in Table 1) of the white crystal represented by the following chemical structure B is thus obtained.

TABLE 1

| Element Analysis Value (%) | | | |
|---|---|---|---|
| | C | H | N |
| Measured value | 85.06 | 6.41 | 3.73 |
| Calculated value | 85.44 | 6.34 | 3.83 |

Chemical Structure A

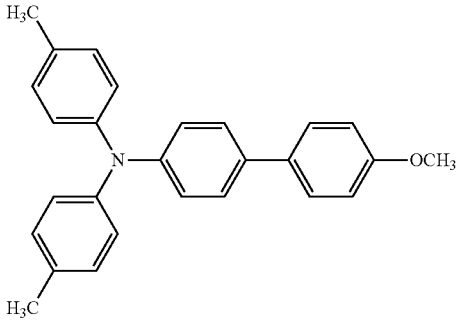

Chemical Structure B

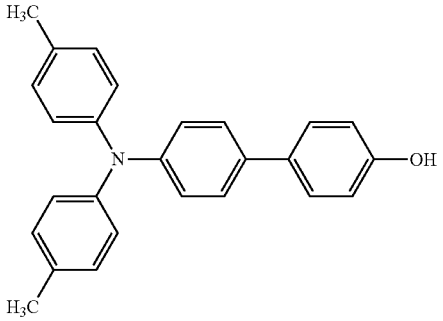

(2) Synthesis of Triaryl Amino Group Substituted Acrylate Compound (Illustrated Chemical Compound No. 54)

82.9 g, i.e., 0.227 mol, of the hydroxy group substituted triarylamine compound represented by the chemical structure B obtained in (1) is dissolved in 400 ml of tetrahydrofuran and sodium hydroxide (NaOH: 12.4 g, $H_2O$: 100 ml) is dropped to the liquid in nitrogen atmosphere. The solution is cooled down to 5° C. and 25.2 parts (0.272 mol) of chloride acrylate is dropped thereto in 40 minutes. Thereafter, the solution is stirred for 3 hours at 5° C., and the reaction is terminated. The resultant reaction liquid is poured to water and extracted by toluene. The extracted liquid is repeatedly washed with sodium acid carbonate and water.

Thereafter, the solvent is removed from the toluene aqueous solution and refined by column chromatography treatment (absorption medium: silica gel, development solvent: toluene). n-hexane is added to the obtained colorless oil to precipitate crystal.

80.73 g of the white crystal with a yield ratio of 84.8% and having a melting point of from 117.5 to 119.0° C. represented by the illustrated compound No. 54 is thus obtained.

The element analysis (%) is shown in Table 2.

TABLE 2

| Element Analysis Value (%) | | | |
|---|---|---|---|
| | C | H | N |
| Measured value | 83.13 | 6.01 | 3.16 |
| Calculated value | 83.02 | 6.00 | 3.33 |

Synthesis Example of Acrylate Compound (1) Preparation of 2-hydroxybenzyl diethyl phosphonate 38.4 g of 2-hydroxy benzyl alcohol (manufactured by Tokyo Chemical Industry Co., Ltd.), 80 ml of o-xylene are placed in a reaction container equipped with a stirrer, a thermometer, and a drip funnel and 62.8 g of triethyl phosphite (manufactured by Tokyo Chemical Industry Co., Ltd.) at 80° C. is slowly dripped to the reaction container in nitrogen atmosphere followed by one hour reaction at 80° C.

Thereafter, 66 g of 2-hydroxy benzyl diethyl phosphonate having a boiling point of 120.0° C./1.5 mmHg with a yield ratio of 90% is obtained by removing produced ethanol, the solvent of o-xylene, and non-reacted triethyl phosphite.

(2) Preparation of 2-hydroxy-4'-{N,N-bis(4-methylphenyl)amino}stilbene 14.8 g of potassium-tert-buthoxide, and 50 ml of tetrahydrofuran are placed in a reaction container equipped with a stirrer, a thermometer, and a drip funnel and a solution in which 9.90 g of 2-hydroxydibenzyl diethyl phosphonate and 5.44 g of 4-(N,N-bis(4-methylphenyl)amino)benzaldehyde are dissolved in tetrahydrofuran is slowly dripped to the reaction container in nitrogen atmosphere at room temperature followed by two hour reaction at room temperature.

Thereafter, while the system is cooled in water, water is added and then 2 normal hydrochloride aqueous solution is added for acidization. Thereafter, tetrahydrofuran is removed by an evaporator and coarse products are extracted by toluene.

The obtained toluene phase is washed with water, an aqueous solution of sodium hydrogen carbonate, and saturated saline in that sequence and dehydrated by adding magnesium sulfate.

Subsequent to filtration, the toluene is removed to obtain an oily coarse product followed by column cleanup using silica gel. The resultant is crystallized in hexane and 5.09 g of 2-hydroxy-4'-(N,N-bis(4-methylphenyl)amino)stilbene having a melting point of from 136.0 to 138.0° C. is obtained with a yield ratio of 7.2%.

(3) Preparation of 4'-(N,N-bis(4-methylphenyl)amino)stilbene-2-ylacrylate)

14.9 g of 2-hydroxy-4'-(N,N-bis(4-methylphenyl)amino)stilbene, and 100 of tetrahydrofuran are placed in a reaction container equipped with a stirrer, a thermometer, and a drip funnel and 21.5 g of an aqueous solution of sodium hydroxide having a concentration of 12% is added to the reaction container in nitrogen atmosphere at 5° C. followed by three hour reaction at 5° C.

The reaction liquid is poured to water. Subsequent to extraction by toluene and concentration, the resultant is subject to column cleanup by silica gel.

The obtained coarse product is re-crystallized by ethanol to obtain 13.5 g of 4'-(N,N-bis(4-methylphenyl)amino)stilbene-2-ylacrylate (Illustrated compound No. 109), which is a yellow needle-like crystal and has a melting point of from 104.1 to 105.2° C., is obtained with a yield ratio of 79.8%. The element analysis (%) is shown in Table 3.

TABLE 3

| Element Analysis Value (%) | | | |
|---|---|---|---|
| | C | H | N |
| Measured value | 83.46 | 6.06 | 3.18 |
| Calculated value | 83.57 | 6.11 | 3.14 |

As described above, many kinds of derivatives of 2-hydroxy stilbene are synthesized by reacting derivatives of 2-hydroxybenzyl phosphonate with derivatives of amino substituted benzaldehyde. In addition, many kinds of acrylate compounds are synthesized by acrylization or methacrylization of the derivatives of amino substituted benzaldehyde.

Example 1

The liquid application for an intermediate layer, the liquid application of an undercoating layer, the liquid application of a charge generation layer, and the liquid application of a charge transport layer having the following recipes are applied to an aluminum cylinder having an outer diameter of 60 mum, in that order, by a dip coating method followed by drying in an oven to obtain an intermediate layer having a thickness of about 0.5 μm, an undercoating layer having a thickness of about 2.5 μm, a charge generation layer having a thickness of about 0.2 μm, and a charge transport layer having a thickness of about 22 μm.

The drying condition for each layer is: 130° for 10 minutes for the intermediate layer; 130° C. for 20 minutes for the undercoating layer; 90° C. for 20 minutes for the charge generation layer; and 120° C. for 20 minutes for the charge transport layer.

| Liquid Application for Intermediate Layer | |
|---|---|
| N-methoxy methylated nylon (FR-101, manufactured by Namariichi Co., Ltd.) | 5 parts |
| Methanol | 70 parts |
| n-butanol | 30 parts |

| Liquid Application for Undercoating Layer | |
|---|---|
| Titanium oxide A (CR-EL, manufactured by Ishihara Sangyo Kaisha Ltd.: Average primary particle diameter: about 0.25 μm | 50 parts |
| Titanium oxide B (PT-401Ml, manufactured by Ishihara Sangyo Kaisha Ltd.: Average primary particle diameter: about 0.07 μm | 20 parts |
| Alkyd resin (Beckolite M6401-50, solid portion: 50%, manufactured by Dainippon Ink and Chemicals, Inc.) | 14 parts |
| Melamine resin (L-145-60, solid portion: 60%, manufactured by Dainippon Ink and Chemicals, Inc.) | 8 parts |
| 2-butanone | 70 parts |
| **Liquid Application for Charge Generation Layer** | |
| Titanylphthalocyanine having an X-ray diffraction spectrum illustrated in FIG. 8 (ionization potential: 5.27 eV) | 8 parts |
| Polyvinylbutyral (BX-1, manufactured by Sekisui Chemical Co., Ltd.) | 4 parts |
| 2-butanone | 400 parts |

A pigment and 2-butanone solution where polyvinyl butyral is dissolved are put in a marketed bead mill dispersion device using PSZ balls having a diameter of 0.5 mm. Dispersion is performed for 120 minutes at 3,000 rpm to prepare a liquid dispersion.

| Liquid Application for Charge Transport Layer | |
|---|---|
| Polycarbonate (Z polika, manufactured by Teijin Chemicals Ltd. | 10 parts |
| Charge transport material represented by CTM 14 (ionization potential: 5.25 eV) | 12 parts |
| Diamine compound represented by the illustrated diamine compound no. 7. | 0.5 parts |
| Anti-oxidant represented by the following chemical formula 21 | 0.5 parts |

Chemical formula 21

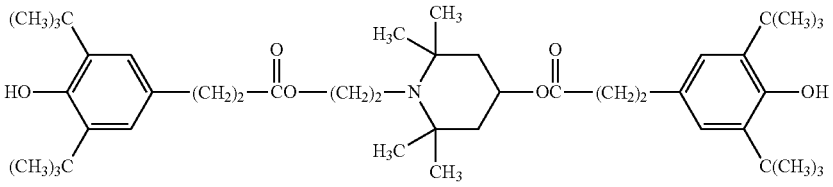

| | |
|---|---|
| Tetrahydrofuran | 100 parts |
| Tetrahydrofuran solution of 1% silicone oil (KF-50-100CS, manufactured by Shin-Etsu Chemical Co., Ltd. | 0.2 parts |

A protection layer is formed on the charge transport layer by spray-coating the liquid application for the protection layer having the following recipe.

Alumina balls having a Φ of 5 mm are placed in a glass pot having a volume of 70 cc and in addition, the following filler, polycarboxylic acid compound and cyclopentaanone are placed therein to conduct dispersion at 150 rpm for 24 hours by a ball mil. Thereafter, tetrahydrofuran is added thereto followed by stirring to obtain a mill base. The mill base is mixed with a solution in which other materials are preliminarily mixed to prepare the liquid applications 1 and 2 for the protection layer.

First, the liquid application 1 is spray-coated on the charge transport layer. Subsequent to natural drying for 5 minutes while in rotation, the liquid application 2 is also spray-coated.

After natural drying for 5 minutes, the protection layer is irradiated with UV with a UV lamp system (manufactured by UV Systems Japan KK) using a metal halide lamp while rotating the substrate at 30

The lamp for irradiation of UV is a V valve and the distance between the ultraviolet lamp and the UV irradiation is conducted with a distance between the UV lamp and the surface of the image bearing member of 52 m, an irradiation intensity of 500 mW/cm$^2$, and an irradiation time of 60 seconds.

After the UV irradiation, a protection layer having a thickness of about 3 μm is obtained by drying at 130° C. for 15 minutes to manufacture the image bearing member of the present disclosure.

| Mill Base | |
|---|---|
| Alumina filler (SUMICORUNDUM AA-03, manufactured by Sumitomo Chemical Co., Ltd.; Average primary particle diameter: 0.3 μm) | 8 parts |
| Polycarboxylic acid compound (BYK-P104, manufactured by BYK-Chemie U.S. Inc.; non-volatile portion: 50%) | 0.2 parts |
| Cyclopentanone | 8 parts |
| Tetrahydrofuran | 12 parts |

| Liquid Application 1 for Protection Layer | |
|---|---|
| Mill base prepared as described above | 7 parts |
| Diamine compound represented by the illustrated diamine compound no. 7. | 0.6 parts |
| Radical polymerizable compound having no charge transport structure: (KAYARAD TMPTA, manufactured by Nippon Kayaku Co., Ltd., molecular weight of 296; 3 functional groups; molecular weight/number of functional groups = 99)] | 10 parts |
| Radical polymerizable compound having no charge transport structure: (Illustrated chemical compound no. 54) | 12 parts |
| Illustrated Compound No. 54 | 3 parts |
| Photo polymerization initiator (1-hydroxy-cyclohexyl-phenyl-ketone (IRGACURE 184, manufactured by Chiba Specialty Chemicals)} | 1 part |
| Leveling agent (BYK-UV3570, manufactured by BYK-Chemie U.S. Inc.) | 0.2 parts |
| Tetrahydrofuran | 140 parts |

| Liquid Application 2 for Protection Layer | |
|---|---|
| Mill base prepared above | 7 parts |
| Radical polymerizable compound having no charge transport structure: (KAYARAD TMPTA, manufactured by Nippon Kayaku Co., Ltd., molecular weight of 296; 3 functional groups; molecular weight/number of functional groups = 99)] | 10 parts |
| Radical polymerizable compound having no charge transport structure: (Illustrated chemical compound no. 54) | 13 parts |
| Illustrated Compound No. 54 | 3 parts |
| Photo polymerization initiator (1-hydroxy-cyclohexyl-phenyl-ketone (IRGACURE 184, manufactured by Chiba Specialty Chemicals)} | 1 part |
| Leveling agent (BYK-UV3570, manufactured by BYK-Chemie U.S. Inc.) | 0.2 parts |
| Tetrahydrofuran | 115 parts |

Example 2

The image bearing member of Example 2 is manufactured in the same manner as in Example 1 except that the diamine compound represented by the illustrated diamine compound no. 7 is changed to the diamine compound represented by the illustrated diamine compound no. 3 having a molecular weigh of 194.32.

Example 3

The image bearing member of Example 2 is manufactured in the same manner as in Example 1 except that the diamine compound represented by the illustrated diamine compound no. 7 is changed to the diamine compound represented by the illustrated diamine compound no. 5 having a molecular weigh of 372.56.

Example 4

The image bearing member of Example 4 is manufactured in the same manner as in Example 1 except that the diamine compound represented by the illustrated diamine compound no. 7 is changed to the diamine compound represented by the illustrated diamine compound no. 11 having a molecular weigh of 496.70.

Example 5

The image bearing member of Example 5 is manufactured in the same manner as in Example 1 except that the diamine compound represented by the illustrated diamine compound no. 7 is changed to the diamine compound represented by the illustrated diamine compound no. 14 having a molecular weigh of 448.66.

Example 6

The image bearing member of Example 6 is manufactured in the same manner as in Example 1 except that the diamine compound represented by the illustrated diamine compound no. 7 is changed to the diamine compound represented by the illustrated diamine compound no. 17 having a molecular weigh of 572.80.

Example 7

The image bearing member of Example 7 is manufactured in the same manner as in Example 1 except that the diamine compound represented by the illustrated diamine compound no. 7 is changed to the diamine compound represented by the illustrated diamine compound no. 18 having a molecular weigh of 572.80.

Example 8

The image bearing member of Example 8 is manufactured in the same manner as in Example 1 except that the diamine compound represented by the illustrated diamine compound no. 7 is changed to the diamine compound represented by the illustrated diamine compound no. 27 having a molecular weigh of 609.90.

Example 9

The image bearing member of Example 9 is manufactured in the same manner as in Example 1 except that the diamine compound represented by the illustrated diamine compound no. 7 is changed to the diamine compound represented by the illustrated diamine compound no. 25 having a molecular weigh of 733.06.

Example 10

The image bearing member of Example 10 is manufactured in the same manner as in Example 1 except that the diamine compound represented by the illustrated diamine compound no. 7 is changed to the diamine compound represented by the illustrated diamine compound no. 28 having a molecular weigh of 914.30.

Example 11

The image bearing member of Example 11 is manufactured in the same manner as in Example 1 except that the anti-oxidant agent represented by chemical formula 22 is added in an amount of 0.3 parts to the liquid application 1 for the protection layer.

Chemical formula 22

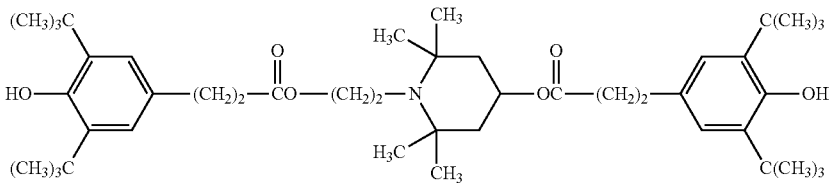

Example 12

The image bearing member of Example 12 is manufactured in the same manner as in Example 1 except that the mill base is not added to the liquid applications 1 and 2.

Example 13

The image bearing member of Example 13 is manufactured in the same manner as in Example 1 except that the mill base is not added to the liquid application 2.

Example 14

The image bearing member of Example 14 is manufactured in the same manner as in Example 1 except that the addition amount of the diamine compound contained in the liquid application for the charge transport layer is changed to 1.5 parts, the diamine compound contained in the liquid application 1 for the protection layer is not added, and the drying condition for the protection layer after curing by UV irradiation is changed to 140° C. and 30 minutes.

Example 15

The image bearing member of Example 15 is manufactured in the same manner as in Example 1 except that the liquid application for the charge generation layer having the following recipe, and the liquid application for the charge transport layer having the following recipe are applied to form a charge generation layer, and a charge transport layer, and the liquid application for the protection layer is formed by the following recipe without curing treatment by irradiation. The drying condition for each layer is: 130° C. for 10 minutes for the intermediate layer; 130° C. for 20 minutes for the undercoating layer; 130° C. for 20 minutes for the charge generation layer; and 150° C. for 20 minutes for the protection layer. The following azo pigment is prepared according to the method described in Japanese patent mo. 3026645.

In addition, the cyclohexanone solution in which polyvinyl butyral is dissolved and the following azo pigment are put in a ball mill dispersion device using PSZ balls having a diameter of 10 mm. Dispersion is performed for 7 days at 85 μm followed by dilution and mixing by cyclohexanone and 2 butanone to prepare a liquid dispersion for the charge transport layer.

| Liquid Application for Charge Generation Layer | |
|---|---|
| Asymmetric bisazo pigment represented by the following chemical formula 23 | 5 parts |
| Chemical formula 23 | |

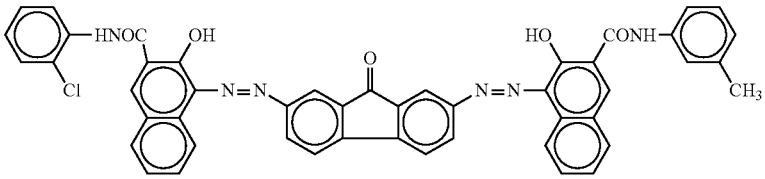

| | |
|---|---|
| Polyvinylbutyral (BM -S, manufactured by Sekisui Chemical Co., Ltd.) | 1.5 parts |
| Cyclohexanone | 250 parts |
| 2-butanone | 100 parts |

| Liquid Application for Charge Transport Layer | |
|---|---|
| Polycarbonate (Z polika, manufactured by Teijin Chemicals Ltd. | 10 parts |
| Compound represented by the charge transport material no. 17 illustrated above | 7 parts |
| Silicone oil (1 $cm^2/s$ (100 cSt), manufactured by Shin-etsu Chemical Co., Ltd.) | 0.002 parts |
| Tetrahydrofuran | 100 parts |
| Anti-oxidant represented by the following chemical structure | |
| Chemical formula 24 | |

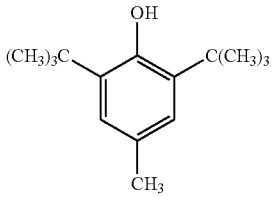

-continued

| Liquid Application for Charge Transport Layer | |
|---|---|
| Anti-oxidant represented by the following chemical formula 25 | 0.07 parts |
| Chemical formula 25 | |

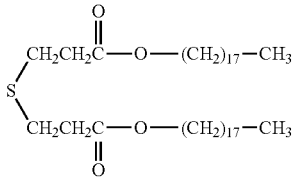

| Liquid Application 1 for Protection Layer | |
|---|---|
| Mill Base | 7 parts |
| Polycarbonate (Z polika, manufactured by Teijin Chemicals Ltd. | 10 parts |

-continued

| | |
|---|---|
| Compound represented by the charge transport material no. 17 illustrated above | 7 parts |
| Diamine compound represented by the illustrated diamine compound no. 16. | 1 part |
| Anti-oxidant B represented by the following chemical formula 26 | 0.5 parts |
| Chemical formula 26 | |

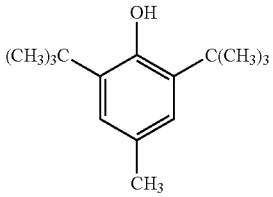

| | |
|---|---|
| Tetrahydrofuran | 500 parts |
| Cyclohexanone | 150 parts |

| Liquid Application 2 for Protection Layer | |
|---|---|
| Mill Base | 7 parts |
| Polycarbonate (Z polika, manufactured by Teijin Chemicals Ltd. | 10 parts |
| Compound represented by the charge transport material no. 17 illustrated above | 7 parts |

-continued

| | |
|---|---|
| Anti-oxidant B represented by the chemical formula 26 illustrated above | 0.3 parts |
| Tetrahydrofuran | 500 parts |
| Cyclohexanone | 150 parts |

Example 16

The image bearing member of Example 16 is manufactured in the same manner as in Example 1 except that the diamine compound contained in the charge transport layer is not added.

Comparative Example 1

The image bearing member of Comparative Example is manufactured in the same manner as in Example 1 except that the diamine compounds contained in the charge transport layer and the liquid application 1 for the protection layer are not added at all.

Comparative Example 2

The image bearing member of Comparative Example 2 is manufactured in the same manner as in Example 1 except that the diamine compound contained in the liquid application 1 for the protection layer is not added.

Comparative Example 3

The image bearing member of Comparative Example 3 is manufactured in the same manner as in Example 1 except that the diamine compound contained in the liquid application 1 for the protection layer is equally contained in the liquid application 2 for the protection layer.

Comparative Example 4

The image bearing member of Comparative Example 4 is manufactured in the same manner as in Example 1 except that the diamine compound contained in the liquid application 1 for the protection layer is contained in the liquid application 2 for the protection layer in an amount of twice as much as in the liquid application 1.

Comparative Example 5

The image bearing member of Comparative Example 5 is manufactured in the same manner as in Example 1 except that the diamine compound contained in the liquid application 1 for the protection layer is replaced with the anti-oxidant contained in the charge transport layer.

Comparative Example 6

The image bearing member of Comparative Example 6 is manufactured in the same manner as in Example 1 except that the diamine compound represented by the illustrated diamine compound no. 7 is changed to the amine compound having a molecular weigh of 287.40 represented by the following chemical formula 27.

Chemical formula 27

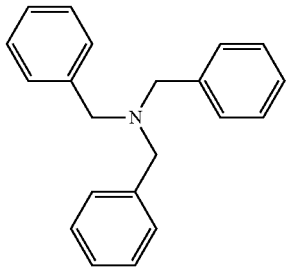

Comparative Example 7

The image bearing member of Comparative Example 7 is manufactured in the same manner as in Example 1 except that the diamine compound represented by the illustrated diamine compound no. 7 is changed to the amine compound having a molecular weigh of 313.44 represented by the following chemical formula 28.

Chemical formula 28

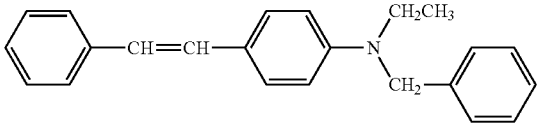

Comparative Example 8

The image bearing member of Comparative Example 8 is manufactured in the same manner as in Example 1 except that the diamine compound in the liquid application 1 for the protection layer is changed to the diamine compound having a molecular weigh of 468.65 represented by the following chemical formula 29.

Chemical formula 29

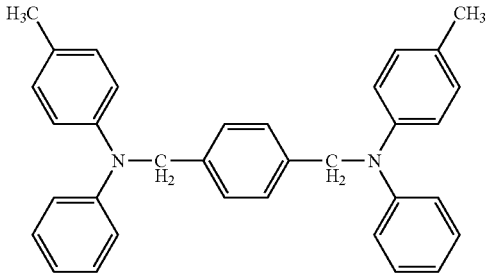

Comparative Example 9

The image bearing member of Comparative Example 9 is manufactured in the same manner as in Example 1 except that the diamine compound contained in the liquid application 1 for the protection layer is changed to the amine compound having a molecular weigh of 287.40 represented by the following chemical formula 30.

Chemical formula 30

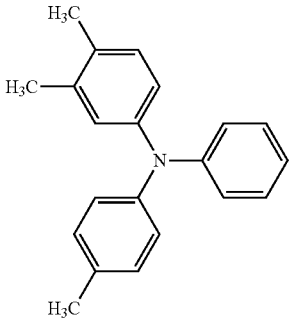

Comparative Example 10

The image bearing member of Comparative Example 10 is manufactured in the same manner as in Example 1 except that the diamine compound contained in the liquid application 1 for the protection layer is changed to the amine compound having a molecular weigh of 219.29 represented by the following chemical formula 30.

Chemical formula 30

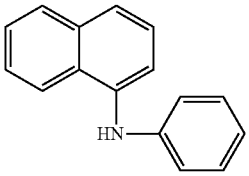

Comparative Example 11

The image bearing member of Comparative Example 15 is manufactured in the same manner as in Example 15 except that the diamine compound contained in the liquid application 1 for the protection layer is not added.

Comparative Example 12

The image bearing member of Comparative Example 12 is manufactured in the same manner as in Example 15 except that 1.2 parts of the diamine compound contained in the liquid application 1 for the protection layer is added to the liquid application 2 for the protection layer.

The content of the diamine compound on the surface side of the protection layer and on the photosensitive layer side thereof is analyzed for comparison with regard to the image bearing member manufactured as described above.

First, the image bearing member is cut to a square piece of 2 cm×2 an and the square is severed by SAICAS in a slanted direction relative to the surface of the image bearing member.

This cut surface is analyzed by MARDI TOFMS for the surface side and the photosensitive layer side of the protection layer.

MARDI represents Matrix Assisted Laser Desorption/Ionization, and MARDI TOFMS is an analysis method which is a combination of MARDI and TOF (=Time of Flight) type mass spectrometer.

That is, a matrix that absorbs a laser beam is mixed with a sample. The sample is ionized by irradiation of the laser beam. Then, the mass of these components are measured to compare the mass of a particular material at different positions.

Whether the diamine compound represented by the chemical structure 1 in the protection layer of the image bearing member of the present disclosure is present more on the photosensitive layer side than the surface side of the protection layer is confirmed by analysis by MALDI TOFMS.

The image bearing member is cut from the surface thereof slantedly by SAICAS and the surface of the image bearing member and the cut surface are locally analyzed into the inside of the image bearing member repetitively. As a result, peaks corresponding to the molecular weight of the diamine compound are confirmed to be present in the protection layer area and the peaks on the photosensitive layer side of the protection layer are stronger than those on the surface side thereof. That is, the diamine compound is contained more on the photosensitive layer side than the surface layer side.

These results are obtained in any of Examples.

In Example 14, the diamine compound is not contained in the liquid application for the protection layer but the content of the diamine compound in the charge transport layer is increased and the drying temperature after formation of the protection layer is raised. Therefore, the diamine compound in the charge transport layer oozes into the protection layer, which is thought to be detected.

In the present disclosure, irrespective of addition of the diamine compound to the liquid application for the protection layer, the image bearing member that contains the diamine compound in the protection layer with a higher density on the photosensitive layer side than the surface side of the protection layer is suitable as an example.

In addition, such an analysis can be made by Fourier transform infrared spectroscopy-attenuated total reflectance (FT-IR ATR) method.

As described above, the image bearing member is cut from the surface and the cut surface is measured by FTIR ATR method and the positional imbalance of the diamine compound is confirmed by comparing the peak strength ratio of the diamine compound on the surface layer side and the photosensitive layer side of the protection layer.

A similar analysis can be made using FT-Raman spectrometric method.

Any method that can compare the content of materials such as the diamine compound, the charge transport material, or anti-oxidants on the surface side and the photosensitive layer side can be used in the present disclosure.

However, it is difficult to make judgment by the ATR method when the peaks deriving from the diamine compound are overlapped with the peaks deriving from the charge transport material.

From this point of view, MARDI TOFMS is most preferable.

Then, the image bearing members manufactured as described above are evaluated.

The image bearing members of Examples and Comparative Examples are set in a process cartridge and the process cartridge is installed on a full color digital photocopier employing tandem system remodeled based on imagio MPC 7500.

The charger is of a roller charging system provided in the vicinity of the image bearing member as illustrated in FIG. 3. The irradiation device is a semiconductor laser emitting light having a wavelength of 655 nm.

In addition, a polymerization toner having an average particle diameter of about 6 μm is filled in the development device. The transfer device is an intermediate transfer belt and the cleaning device is a blade.

In addition, a solidified bar formed of zinc stearate is used as the lubricant of the lubricant applicator. As illustrated in FIG. 5, a pressure spring and a fur brush are of a structure in which the fur brush scrapes zinc stearate to supply it to the surface of the image bearing member.

Furthermore, an application blade is provided to uniformly apply zinc stearate to the surface of the image bearing member so that excessive attachment of zinc stearate on the surface of the image bearing member is avoided after zinc stearate is attached to the surface of the image bearing member.

First, irradiation voltage VL at the irradiated portion of the image bearing member at the initial stage is measured by a surface electrometer. Then, the voltage at the irradiation portion is measured after five jobs while one job is a run length of continuous printing of 50 sheets. The variation of the voltage at the irradiation portion in one job is evaluated.

Next, the irradiation voltage is measured and the image bearing member is evaluated after a run length of 100,000 images.

With regard to the variation of the voltage at irradiation portion in one job, evaluation results on whether these can be corrected sufficiently for the process are shown in addition to the measuring results themselves.

In addition, the durability and the cleaning property of the image bearing member are evaluated from the status after the 100,000 prints.

These results are shown in Tables 4-1 and 4-2.

TABLE 4-1

| | Initial stage | | |
|---|---|---|---|
| | VL (−V) | Intra-job fluctuation (V) | |
| Example 1 | 100 | 11 | E |
| Example 2 | 105 | 15 | E |
| Example 3 | 100 | 12 | E |
| Example 4 | 100 | 9 | E |
| Example 5 | 100 | 11 | E |
| Example 6 | 95 | 9 | E |
| Example 7 | 95 | 8 | E |
| Example 8 | 120 | 18 | E |
| Example 9 | 110 | 14 | E |
| Example 10 | 125 | 19 | E |
| Example 11 | 100 | 11 | E |
| Example 12 | 100 | 9 | E |
| Example 13 | 95 | 8 | E |
| Example 14 | 65 | 5 | E |
| Example 15 | 70 | 10 | E |
| Example 16 | 95 | 8 | E |
| Comparative Example 1 | 95 | 6 | E |
| Comparative Example 2 | 100 | 8 | E |
| Comparative Example 3 | 100 | 24 | G |
| Comparative Example 4 | 105 | 31 | F |
| Comparative Example 5 | 115 | 17 | E |
| Comparative Example 6 | 95 | 9 | E |
| Comparative Example 7 | 110 | 15 | E |
| Comparative Example 8 | 95 | 8 | E |
| Comparative Example 9 | 95 | 7 | E |

TABLE 4-1-continued

| | Initial stage | | |
|---|---|---|---|
| | VL (−V) | Intra-job fluctuation (V) | |
| Comparative Example 10 | 120 | 23 | G |
| Comparative Example 11 | 65 | 8 | E |
| Comparative Example 12 | 75 | 16 | E |

TABLE 4-2

| | After a run length of 100,000 | | | | |
|---|---|---|---|---|---|
| | VL (−V) | Intra-job fluctuation (V) | | Durability | Cleaning property |
| Example 1 | 95 | 14 | E | E | E |
| Example 2 | 110 | 22 | G | E | E |
| Example 3 | 105 | 16 | E | E | E |
| Example 4 | 95 | 12 | E | E | E |
| Example 5 | 95 | 15 | E | E | E |
| Example 6 | 90 | 12 | E | E | E |
| Example 7 | 90 | 10 | E | E | E |
| Example 8 | 125 | 28 | G | E | E |
| Example 9 | 105 | 18 | E | E | E |
| Example 10 | 135 | 29 | G | E | E |
| Example 11 | 100 | 14 | E | E | E |
| Example 12 | 90 | 12 | E | G | G |
| Example 13 | 90 | 11 | E | E | E |
| Example 14 | 80 | 7 | E | G | G |
| Example 15 | 125 | 13 | E | G | G |
| Example 16 | 90 | 11 | E | E | E |
| Comparative Example 1 | 80 | 8 | E | E | E |
| Comparative Example 2 | 75 | 10 | E | E | E |
| Comparative Example 3 | 110 | 38 | F | E | E |
| Comparative Example 4 | 115 | 47 | B | E | E |
| Comparative Example 5 | 100 | 25 | G | E | E |
| Comparative Example 6 | 85 | 13 | E | E | E |
| Comparative Example 7 | 115 | 24 | G | E | E |
| Comparative Example 8 | 80 | 12 | E | E | E |
| Comparative Example 9 | 80 | 10 | E | E | E |
| Comparative Example 10 | 145 | 44 | B | E | E |
| Comparative Example 11 | 105 | 10 | E | G | G |
| Comparative Example 12 | 145 | 36 | F | G | G |

Criteria for Variation in One Job at Voltage at the irradiation
E (Excellent): No problem
G (Good): Slight change, but is correctable
F (Fair): Change clearly seen, which is slightly beyond the limit.
B (Bad): Significant change, causing problems.
Criteria on Durability
E (Excellent): No problem
G (Good): Slight damage, but is correctable
F (Fair): Noticeable damage, which is anticipated to cause problems if a run continues.
B (bad): Much damage, which is already determined as problematic.
Criteria on Cleaning Property
E (Excellent): No problem
G (Good): ignorable slight bad cleaning
F (Fair): Filming and bad cleaning occur, which is anticipated to cause problems if a run continues.
B (Bad): Filming and bad cleaning occurs much, which is already determined as problematic.

Next, polyimide film (manufactured by 3M) is attached to part of the image bearing member and then the image bearing member is placed in an $NO_x$ gas exposure tester to conduct an accelerated deterioration test by gas exposure.

The exposure is conducted in an environment of 35 and 60 5 RH with an NO density of 40 ppm, and $NO_2$ density of 10 ppm for 7 days.

After exposure, the polyimide tape is peeled off and images are output by the photocopier. The obtained image sample is observed with a microscope to evaluate the definition to check the image blur, and variation of the image density by comparison between the portion masked by the film and the exposed portion.

With regard to the definition, the image sample is enlarged and observed by a microscope for evaluation.

On the other hand, with regard to the variation of the image density, the portion masked by the film and the exposed portion are measured by a Macbeth densitometer and the average of five points are calculated to obtain the difference in the density between the masked portion and the exposed portion.

The definition and the variation in the image density are evaluated according to the following criteria.

Furthermore, 10,000 images are output for these image bearing members followed by the test described above.

The results are shown in Table 5.

TABLE 5

| | After exposed to $NO_x$ | | After a run length of 10,000 | |
|---|---|---|---|---|
| | Definition | Variation on image density | Definition | Variation on image density |
| Example 1 | E | E | E | E |
| Example 2 | E | E | E | E |
| Example 3 | E | E | E | E |
| Example 4 | E | E | E | G |
| Example 5 | E | E | E | E |
| Example 6 | E | E | E | G |
| Example 7 | E | E | E | G |
| Example 8 | E | E | E | E |
| Example 9 | E | E | E | E |
| Example 10 | G | G | G | G |
| Example 11 | E | E | E | E |
| Example 12 | E | E | E | E |
| Example 13 | E | E | E | E |
| Example 14 | E | E | E | E |
| Example 15 | E | G | E | G |
| Example 16 | G | G | G | G |
| Comparative Example 1 | B | B | B | B |
| Comparative Example 2 | F | F | F | F |
| Comparative Example 3 | E | E | E | E |
| Comparative Example 4 | E | E | E | E |
| Comparative Example 5 | F | F | B | B |
| Comparative Example 6 | F | F | F | F |
| Comparative Example 7 | F | F | F | F |
| Comparative Example 8 | B | B | B | B |
| Comparative Example 9 | B | B | B | B |
| Comparative Example 10 | G | G | F | F |

TABLE 5-continued

| | After exposed to $NO_x$ | | After a run length of 10,000 | |
|---|---|---|---|---|
| | Definition | Variation on image density | Definition | Variation on image density |
| Comparative Example 11 | B | B | B | B |
| Comparative Example 12 | E | F | E | F |

Criteria on Definition
E (Excellent): No problem recognized
G (Good): Definition slightly degraded but acceptable
F (Fair): Definition apparently degraded, beyond the acceptable level.
B (Bad): Image blur observed, causing problems.
Criteria on Variation on Image Density
E (Excellent): slight density difference, which is difficult to observe with naked eyes.
G (Good): Slight increase in density difference, which is acceptable
F (Fair): Density difference clearly seen, which is beyond the acceptable limit.
B (Bad): Significant definition difference, causing problems.

Judging from the results, it is apparent that image blur caused by $NO_x$ gas is limited by the particular diamine compound contained in the protection layer which is present more on the photosensitive layer side of the protection layer than the surface side thereof without increasing the variation of the voltage at the irradiation portion in one job.

When the diamine is not contained, significant image blur is observed. Also, it is apparent that the variation of the voltage at irradiation portion in one job markedly increases when the diamine compound is contained equally on the photosensitive layer side and the surface side or more on the surface side than the photosensitive layer side.

In addition, it is apparent that when $A_1$, $A_2$, $A_3$, and $A_4$ of the diamine compound represented by the chemical structure 1 are aryl groups at the same time, the image blur is not limited.

Furthermore, when the diamine compound contains only one amino group, or the diamine compound having a molecular weight outside the range of from 300 to 600 is used, the image blur is not properly limited or the variation in the voltage at the irradiation portion is not reduced, either.

In addition, when a curing resin and a filler are used in the protection layer, the durability and the cleaning property are improved, thereby improving the durability of the image bearing member.

This document claims priority and contains subject matter related to Japanese Patent Application no. 2009-209007, filed on Sep. 10, 2009, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member comprising:

an electroconductive substrate;

a photosensitive layer overlying the electroconductive substrate; and a protection layer overlying the photosensitive layer, the protection layer comprising a diamine compound represented by a chemical structure 1, more of the diamine compound being disposed on a photosensitive layer side than a surface side relative to a midpoint in a depth direction of the protection layer:

Chemical structure 1

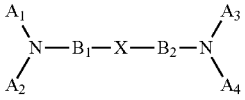

where X represents a substituted or non-substituted arylene group, or a compound represented by a chemical structure 2:

Chemical structure 2

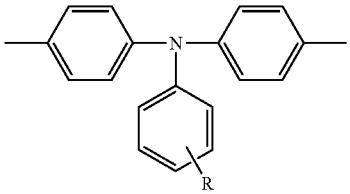

where R represents a hydrogen atom, an alkyl group having 1 to 4 carbon atoms, or an alkoxy group having 1 to 4 carbon atoms, where $A_1$, $A_2$, $A_3$, and $A_4$ independently represent (i) an alkyl group having 1 to 4 carbon atoms, (iii) a substituted or non-substituted aryl group, or (ii) $—CH_2(CH_2)_mZ$, where Z represents a substituted or non-substituted aryl group, a substituted or non-substituted cycloalkyl group, and a substituted or non-substituted heterocycloalkyl group, and m represents 0 or 1, and a case in which each of $A_1$, $A_2$, $A_3$, and $A_4$ is (iii) is excluded, and where $B_1$ and $B_2$ represent $—CH_2—$, $—CH_2CH_2—$, $—CH_2—Ar_a—$, $—Ar_a—CH_2—$, $—CH_2CH_2—Ar_a—$, and $—Ar_a—CH_2CH_2—$, and $Ar_a$ represents a substituted or non-substituted arylene group, where the protection layer further comprises a cured material formed by a radical polymerizable compound having a charge transport structure and a radical polymerizable compound having no charge transport structure, where the photosensitive layer comprises a laminate structure including a charge generation layer and a charge transport layer, and where the diamine compound is included in the charge transport layer.

2. The image bearing member according to claim 1, wherein the diamine compound has a molecular weight of from 300 to 900.

3. The image bearing member according to claim 1, wherein the diamine compound is represented by the chemical structure 3, Chemical structure 3

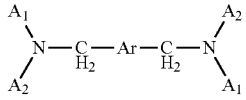

where Ar represents a substituted or non-substituted arylene group.

4. The image bearing member according to claim 1, wherein the protection layer comprises an anti-oxidant.

5. The image bearing member according to claim 4, wherein more of the anti-oxidant is disposed on the photosensitive layer side than the surface side relative to the midpoint in the depth direction of the protection layer.

6. The image bearing member according to claim 4, wherein the anti-oxidant is included in the charge transport layer.

7. The image bearing member according to claim 1, wherein the protection layer comprises a filler.

8. An image forming apparatus comprising:

the bearing member of claim 1;

a charger that charges the image bearing member;

a latent electrostatic image formation device that forms a latent electrostatic image on the charged image bearing member; and a development device that develops the latent electrostatic image with toner to obtain a visual image.

9. The image forming apparatus according to claim 8, employing a tandem system comprising a plurality of the image bearing members, a plurality of the charger, a plurality of the latent electrostatic image formation device, and a plurality of the development device are provided.

10. The image forming apparatus according to claim 8, further comprising a lubricant applicator that applies a lubricant to a surface of the image bearing member.

11. The image forming apparatus according to claim 9, wherein the lubricant comprises zinc stearate.

12. A process cartridge detachably attachable to an image forming apparatus, comprising:

the image bearing member of claim 1; and at least one of a charger that charges the image bearing member, a latent electrostatic image formation device that forms a latent electrostatic image on the charged image bearing member, a development device that develops the latent electrostatic image with toner to obtain a visual image, a transfer device that transfers the visual image to a recording medium, a cleaning device that cleans a surface of the image bearing member, a discharging device that discharges the surface of the image bearing member, and a lubricant applicator that applies a lubricant to the surface of the image bearing member.

* * * * *